US007804473B2

(12) United States Patent
Kumeta

(10) Patent No.: US 7,804,473 B2
(45) Date of Patent: Sep. 28, 2010

(54) LCD PANEL DRIVE ADOPTING TIME-DIVISION AND INVERSION DRIVE

(75) Inventor: Masayuki Kumeta, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 836 days.

(21) Appl. No.: 11/561,545

(22) Filed: Nov. 20, 2006

(65) Prior Publication Data

US 2007/0115231 A1 May 24, 2007

(30) Foreign Application Priority Data

Nov. 21, 2005 (JP) ..... 2005-336234

(51) Int. Cl.
*G09G 3/36* (2006.01)

(52) U.S. Cl. ..... 345/96; 345/88; 345/89; 345/94

(58) Field of Classification Search ..... 345/88, 345/89, 96, 98, 100, 102
See application file for complete search history.

(56) References Cited

U.S. PATENT DOCUMENTS

| | | | | |
|---|---|---|---|---|
| 6,803,894 | B1 * | 10/2004 | Hirota et al. | 345/88 |
| 7,038,652 | B2 * | 5/2006 | Kang et al. | 345/98 |
| 7,304,628 | B2 * | 12/2007 | Hashimoto | 345/98 |
| 7,369,124 | B2 * | 5/2008 | Nakano et al. | 345/204 |
| 2004/0179014 | A1 * | 9/2004 | Nakano et al. | 345/501 |
| 2004/0246210 | A1 * | 12/2004 | Azami | 345/76 |
| 2005/0041488 | A1 * | 2/2005 | Ito et al. | 365/199 |
| 2005/0078078 | A1 * | 4/2005 | Morita | 345/100 |
| 2005/0156862 | A1 * | 7/2005 | Hirayama et al. | 345/100 |
| 2005/0200582 | A1 * | 9/2005 | Goto et al. | 345/89 |
| 2006/0028426 | A1 * | 2/2006 | Hiratsuka | 345/103 |
| 2006/0087484 | A1 * | 4/2006 | Kumeta et al. | 345/96 |

FOREIGN PATENT DOCUMENTS

| | | | |
|---|---|---|---|
| JP | 11-327518 | A | 11/1999 |
| JP | 2003-215540 | A | 7/2003 |

* cited by examiner

*Primary Examiner*—Amare Mengistu
*Assistant Examiner*—Dmitriy Bolotin
(74) *Attorney, Agent, or Firm*—Sughrue Mion, PLLC

(57) ABSTRACT

A method of operating a liquid crystal display device includes: (A) time-divisionally driving pixels in a certain line of an LCD panel so that pixels adjacent in a horizontal direction are driven with data signals of opposite polarities. The (A) step includes: (A1) generating a first data signal of a first polarity on a first output terminal of a driver, and then driving a first pixel out of said pixels in the certain line through electrically connecting the first output terminal to the first pixel; and (A2) generating a second data signal of the first polarity on the first output terminal and then driving a second pixel out of said pixels in the certain line through electrically connecting the first output terminal to the second pixel, in succession to the drive of the first pixel.

13 Claims, 49 Drawing Sheets

Fig. 2

| R1 | G1 | B1 | R2 | G2 | B2 | |
|---|---|---|---|---|---|---|
| + | − | + | − | + | − | 1ST LINE |
| − | + | − | + | − | + | 2ND LINE |
| + | − | + | − | + | − | 3RD LINE |
| − | + | − | + | − | + | 4TH LINE |
| + | − | + | − | + | − | 5TH LINE |
| − | + | − | + | − | + | 6TH LINE |

< 1ST LINE >

< 2ND LINE >

< 1ST LINE >

< 2ND LINE >

< 1ST LINE >

< 2ND LINE >

< 1ST LINE >

< 2ND LINE >

< 1ST LINE >

< 2ND LINE >

LCD PANEL DRIVE ADOPTING TIME-DIVISION AND INVERSION DRIVE

BACKGROUND OF THE INVENTION

1. Field of the Invention

The present invention relates to a liquid crystal display device and a method of driving an LCD panel, more particularly to an LCD panel drive technique for achieving both of time-division drive and inversion drive.

2. Description of the Related Art

The time-division drive, in which a set of data lines (signal lines) are sequentially selected and data signals are time-divisionally written into desired pixels, is one of the commonly-used techniques in driving the LCD panel (See Japanese Laid-Open Patent Application No. JP-A Heisei 11-327518, and JP-A 2003-215540, for example). One advantage of the time-division drive is that the time-division drive effectively reduces the number of output amplifiers integrated within the LCD driver. A liquid crystal display device using the time-division drive can achieve driving pixels with a fewer number of output amplifiers than the number of data lines of the liquid crystal display panel. This effectively reduces the power consumption and chip size of the LCD driver. Another advantage is that the time-division drive effectively reduces the number of connection lines between the LCD driver and the LCD panel through incorporating a switch circuitry within the LCD panel for selecting data lines. The switch circuitry incorporated within the LCD panel effectively reduces the number of connection lines that provides electrical connections between the LCD driver and the LCD panel below the number of data lines within the LCD panel. The reduction in the number of connection lines between the LCD driver and the LCD panel effectively facilitates the installation of the LCD driver and the LCD panel, and effectively reduces the EMI (electromagnetic interference). The recent increase in the number of the pixels integrated within the LCD panel necessitates an increase in the number of data lines that are time-divisionally driven.

The inversion drive is another commonly-used technique for driving the LCD panel. The inversion drive is a technique in which the polarities of data signals are inverted at predetermined spatial and time cycles for avoiding the "burn-in" phenomenon. The inversion drive reduces DC components of drive voltages fed to respective pixels, and thereby effectively avoids the "burn-in" phenomenon.

Generally speaking, there are two kinds of inversion drive: the common constant drive and the common inversion drive. The common constant drive technique designates a technique in which the data signals are inverted with the voltage level of the common electrode (or the backplane electrode) kept constant at a certain voltage level, which is referred to as the common level $V_{COM}$, hereinafter. The common inversion drive technique designates a technique in which both of the voltage levels of the data signals and the common electrode are inverted. The common constant drive technique advantageously stabilizes the voltage level of the common electrode compared to the common inversion drive technique, and this leads to significant reduction in the flicker of the image on the LCD panel, as known in the art. As described in the following, the present invention is directed to the common constant drive technique.

The dot inversion drive, which is one sort of the common inversion drive technique, is a technique in which data signals with opposite polarities are written into adjacent pixels. It should be noted that the polarity of a data signal is defined with respect to the common voltage level $V_{COM}$ (that is, the voltage level of the common electrode). When a data signal has a signal level higher than the common voltage level $V_{COM}$, the polarity of the data signal is defined as being "positive". When a data signal has a signal level lower than the common voltage level $V_{COM}$, on the other hand, the polarity of the data signal is defined as being "negative". Advantageously, the dot inversion drive further improves the stability in the voltage level of the common electrode by feeding positive and negative data signals to the LCD panel at the same time, and thereby effectively reduces the flicker on the LCD panel.

FIG. 1A is a circuit diagram illustrating a typical structure of a liquid crystal display device adopting both of the time-division drive and the dot inversion drive, which is denoted by the numeral 100. It should be noted that a liquid crystal display device adopting both of the time-division drive and the dot inversion drive is disclosed in the above-mentioned Japanese Laid-Open Patent Application No. JP-A Heisei 11-327518, for example. The liquid crystal display device 100 is provided with an LCD panel 101 and an LCD driver 102. The LCD panel 101 is provided with gate lines (scan lines) 111, data lines (signal lines) 112, and pixels 113 arranged in rows and columns. The gate lines 111 are used to select the rows of the pixels 113. Although only a portion of the LCD panel 101 is illustrated in FIG. 1A, it is understood that the LCD panel 101 further includes gate lines 111, data lines 112, and pixels 113 which are not shown. The pixels 113 connected to the gate line $\mathbf{111}_i$ may be referred to as the pixels 113 in the i-th line. As shown in FIG. 1B, the pixels 113 are each provided with a TFT 114, and a pixel electrode 115. The pixel electrodes 115 are opposed to the common electrode (backplane electrode) 116, and liquid crystal capacitors are formed between the respective pixel electrodes 115 and the common electrode 116. Although the common electrode 116 is illustrated as being separately provided in each pixel 113 in FIG. 1B, it is understood that the common electrode 116 is a single large electrode, as well known in the art.

Referring back to FIG. 1A, the LCD panel 101 additionally includes one input node 117 for three data lines 112. Hereinafter, the input nodes 117 positioned in the odd-numbered position may be referred to as the odd input nodes $\mathbf{117}_O$, and the input nodes 117 positioned in the even-numbered position may be referred to as the even input nodes $\mathbf{117}_E$.

It should be noted that a set of data lines 112 connected to a certain input node 117 (through switch elements) may be referred to as the data lines 112 "associated with" the certain input node 117. In the liquid crystal display device 100 shown in FIG. 1A, three data lines associated with the same input node 117 are time-divisionally driven.

Correspondingly, pixels 113 connected to a certain input node 117 (through data lines 112) may be referred to as the pixels 113 "associated with" the certain input node 117. In FIG. 1A, the pixels 113 which are connected with the same gate line 111 and associated with the same input node 117 are time-divisionally driven.

Referring back to FIG. 1A, the pixels 113 includes pixels used to display the red color (referred to as R pixels, hereinafter), pixels used to display the green color (referred to as G pixels, hereinafter), and pixels used to display the blue color (referred to as B pixels, hereinafter). Hereinafter, R pixels associated with the odd input node $\mathbf{117}_O$ may be referred as the R pixels $\mathbf{113}_{R1}$, and R pixels associated with the even input node $\mathbf{117}_E$ may be referred as the R pixels $\mathbf{113}_{R2}$. Correspondingly, G pixels associated with the odd input node $\mathbf{117}_O$ may be referred as the G pixels $\mathbf{113}_{G1}$, and G pixels associated with the even input node $\mathbf{117}_E$ may be referred as the G pixels $\mathbf{113}_{G2}$. Furthermore, B pixels associated with the odd input node $117_O$ may be referred as the B pixels $113_{B1}$, and B pixels associated with the even input node $117_E$ may be referred as the B pixels $113_{B2}$.

The pixels 113 connected to the same data line 112 are associated with the same color. Hereinafter, the data lines connected to the R pixels $113_{R1}$ and $113_{R2}$ may be referred to as the data lines $112_{R1}$ and $112_{R2}$, respectively. Correspondingly, the data lines connected to the G pixels $113_{G1}$ and $113_{G2}$ may be referred to as the data lines $112_{G1}$ and $112_{G2}$, respectively, and the data lines connected to the B pixels $113_{B1}$ and $113_{B2}$ may be referred to as the data lines $112_{B1}$ and $112_{B2}$, respectively.

The data lines $112_{R1}$, $112_{G1}$, and $112_{B1}$ are connected to the associated odd input nodes $117_O$ through switches $119_{R1}$, $119_{G1}$, and $119_{B1}$, respectively, and the data lines $112_{R2}$, $112_{G2}$; and $112_{B2}$ are connected to the associated even input nodes $117_E$ through switches $119_{R2}$, $119_{G2}$, and $119_{B2}$. The switches $119_{R1}$, $119_{G1}$, $119_{B1}$, $119_{R2}$, $119_{G2}$, and $119_{B2}$ are turned on and off in response to control signals RSW, GSW, and BSW. The selection of desired data lines is achieved by turn-on of desired ones of the switches $119_{R1}$, $119_{G1}$, $119_{B1}$, $119_{R2}$, $119_{G2}$, and $119_{B2}$.

The input nodes 117 of the LCD panel 101 are connected to output terminals of the LCD driver 102, respectively. The output terminals of the LCD driver 102 may be denoted by the symbols "Source1", "Source2" . . . , respectively.

The LCD driver 102 feeds data signals having desired signal levels to selected pixels, that is, the pixels 113 connected to selected data lines 112 and a selected gate line 111. The pixels 113 are set to the grayscale levels associated with the signal levels of the data signals fed thereto.

It is necessary to determine the polarities of the data signals developed on the respective output terminals of the LCD driver 102 so as to be adapted to the dot inversion drive and the time-division drive. In the dot inversion drive, as shown in FIG. 2, two pixels 113 adjacent in the horizontal or vertical direction are fed with data signals with opposite polarities. It should be noted that the horizontal direction is the direction in which the gate lines (scan lines) are extended, and the vertical direction is the direction in which the data lines (signal lines) are extended. It should be also noted that the symbols "R1", "G1", "B1", "R2", "G2", and "B2" indicate the R pixels $113_{R1}$, G pixels $113_{G1}$, B pixels $113_{B1}$, R pixels $113_{R2}$, G pixels $113_{G2}$, and B pixels $113_{B2}$, respectively.

With respect to the pixels 112 in the first line, as shown in FIG. 1A, the R pixels $113_{R1}$, B pixels $113_{B1}$, and G pixels $113_{G2}$ are fed with data signals with the positive polarity, and the G pixels $113_{G1}$, R pixels $113_{R2}$, and B pixels $113_{B2}$ are fed with data signals with the negative polarity. In FIG. 1A, the polarities of the respective data signals fed to the pixels 113 in the first line are indicated by the signals "+" and "−" superposed on the data lines 112.

On the other hand, three data lines 112 associated with the same input node 117 are sequentially selected in each horizontal period from end to end. In other words, as shown in FIG. 3, the pixels 113 connected to the same gate lines are driven in this order of R pixels, G pixels, and B pixels. As shown in FIG. 4, driving the pixels 113 in such order can be achieved by activating the control signals RSW, GSW, and BSW in this order.

From the viewpoint of the drive sequence of the pixels 113 and the polarities of the data signals fed thereto, it is necessary that the polarities of the respective data signals sequentially outputted from the output terminals Source1 and Source2 of the LCD driver 102 are set as shown in FIG. 5. Specifically, in the first horizontal period (that is the period for driving the pixels 113 in the first line), a data signal of the positive polarity, a data signal of the negative polarity, and another data signal of the positive polarity are sequentially outputted from the output terminal Source1, while a data signal of the negative polarity, a data signal of the positive polarity, and another data signal of the negative polarity are sequentially outputted from the output terminal Source2. In the second horizontal period, on the other hand, a data signal of the negative polarity, a data signal of the positive polarity, and another data signal of the negative polarity are sequentially outputted from the output terminal Source1, while a data signal of the positive polarity, a data signal of the negative polarity, and another data signal of the positive polarity are sequentially outputted from the output terminal Source2.

It should be noted that the data signals developed on the output terminals Source1 and Source 2 of the LCD driver 102 are always opposite, that is, data signals of the positive and negative polarities are always written into the selected pixels at the same time. This is important for reducing the change in the voltage level of the common electrode.

One issue is that such liquid crystal display device requires frequently inverting the voltage levels on the nodes along the paths used to distribute data signals to the respective data lines (such as, the output terminals of the LCD driver 102). For example, the operation shown in FIG. 5 requires inverting the polarities of the data signals developed on the output terminals of the LCD driver 102 three times per one horizontal period. Frequent inversion of the data signals undesirably causes a significant increase in the power consumption of the LCD driver 102, since the output terminals of the LCD driver 102 has a considerable load capacitance.

Japanese Laid-Open Patent Application No. JP-A 2003-215540, on the other hand, discloses a technique adapted to the time-division drive, in which the frequency of the inversion of the data signals outputted from an LCD driver is reduced down to once per two horizontal periods. In this technique, however, the spatial frequency of the inversion of the data signals fed to the respective pixels 112 are two pixels. In other words, this technique does not provide the dot inversion drive.

As thus described, the conventional liquid crystal display devices suffer from a problem that the use of both of the time-division drive and the dot inversion drive is inevitably accompanied by the frequent inversion of the voltage levels on the nodes along the paths used to distribute data signals to the respective data lines, causing the increase in the power consumption of the LCD driver.

SUMMARY OF THE INVENTION

In an aspect of the present invention, a method of operating a liquid crystal display device includes:

(A) time-divisionally driving pixels in a certain line of an LCD panel so that pixels adjacent in a horizontal direction are driven with data signals of opposite polarities.

The (A) step includes;

(A1) generating a first data signal of a first polarity on a first output terminal of a driver, and then driving a first pixel out of said pixels in the certain line through electrically connecting the first output terminal to the first pixel; and (A2) generating a second data signal of the first polarity on the first output terminal in succession to the drive of the first pixel, and then driving a second pixel out of said pixels in the certain line through electrically connecting the first output terminal to the second pixel.

Such operating method eliminates the need for inverting the voltage level of the first output terminal of the driver in the drive of the second pixel followed by the drive of the first pixel. This effectively reduces the power consumption of the liquid crystal display device.

BRIEF DESCRIPTION OF THE DRAWINGS

The above and other advantages and features of the present invention will be more apparent from the following description taken in conjunction with the accompanied drawings, in which:

FIG. 2 is a diagram illustrating the polarities of data signals fed to the respective pixels in the dot inversion drive;

DESCRIPTION OF THE PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

First Embodiment (LCD Device Structure)

Figure 6:
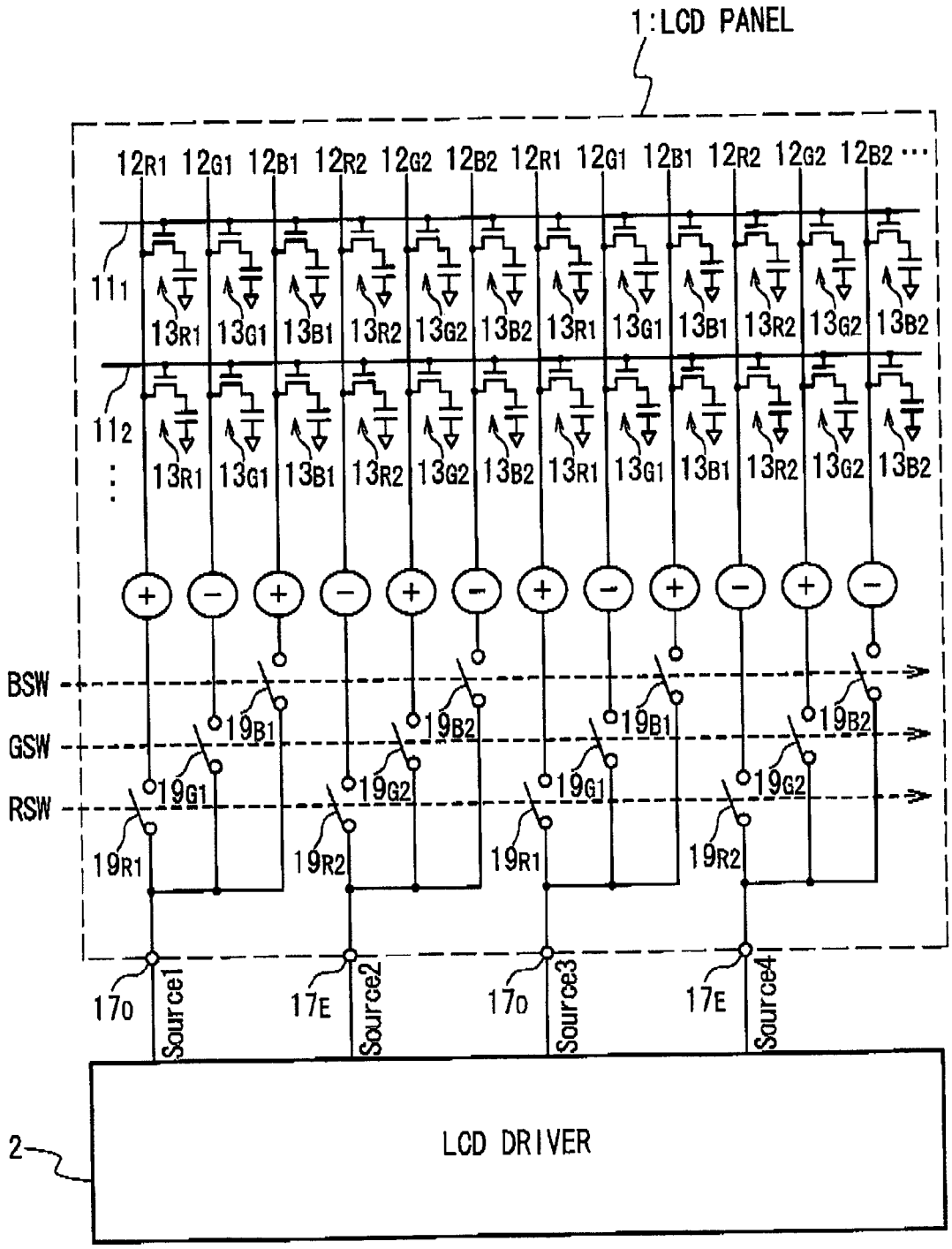
FIG. 6 is a diagram illustrating an exemplary structure of a liquid crystal display device in a first embodiment of the present invention.

FIG. 6 is a block diagram illustrating an exemplary structure of a liquid crystal display device in a first embodiment of the present invention. The liquid crystal display device in this embodiment is provided with an LCD panel and an LCD driver 2.

Figure 1A:
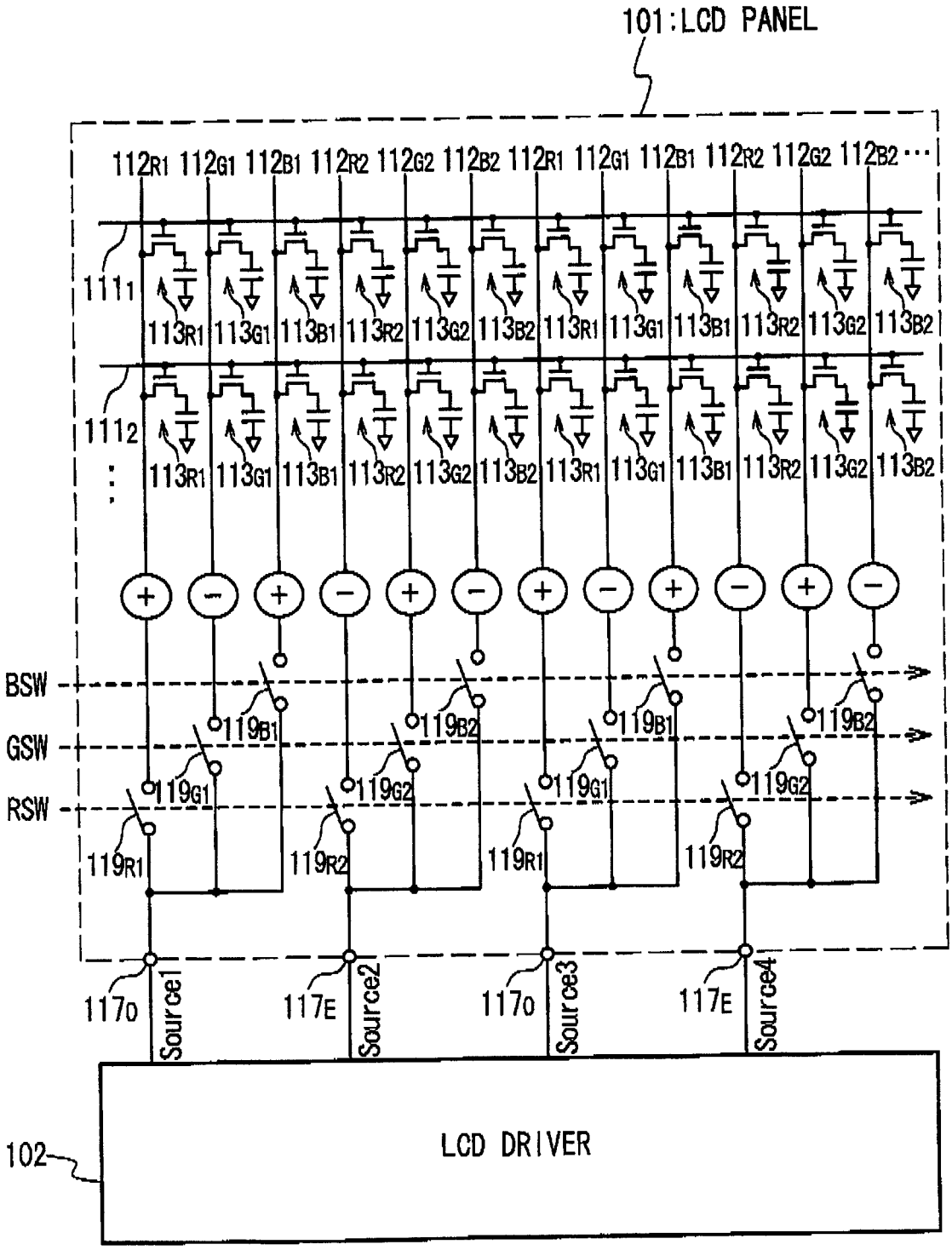
FIG. 1A is a diagram illustrating the structure of a conventional liquid crystal display device.
Figure 1B:
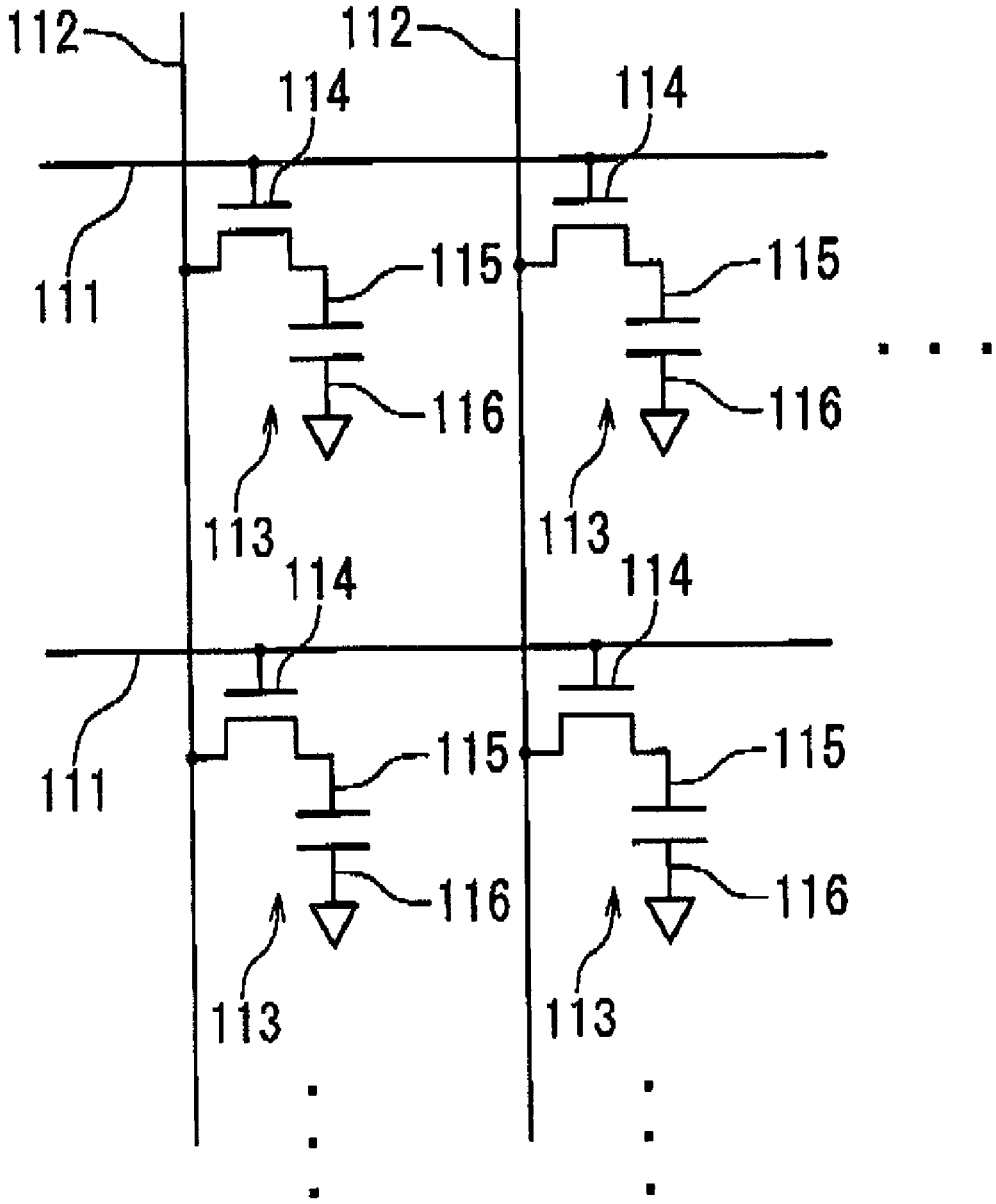
FIG. 1B is a circuit diagram illustrating the structure of a pixel within an LCD panel.
Figure 3:
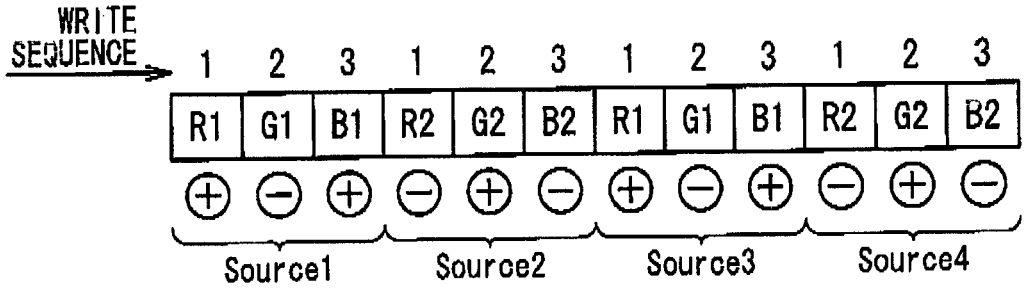
FIG. 3 is a diagram illustrating the write sequence of the pixels and the polarities of data signals fed to the respective pixels in the conventional liquid crystal display device.
Figure 3:
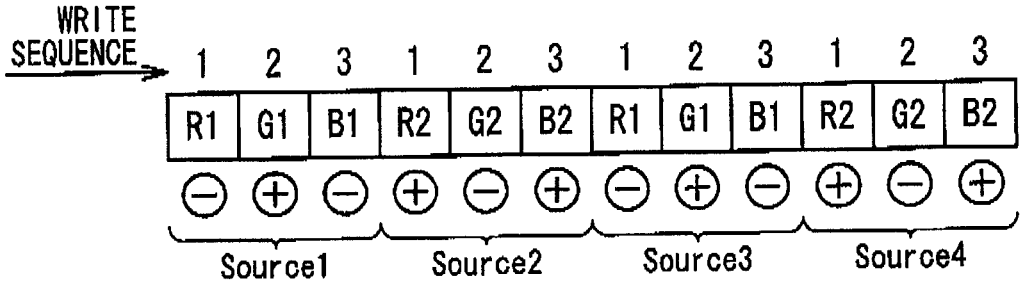
Figure 4:
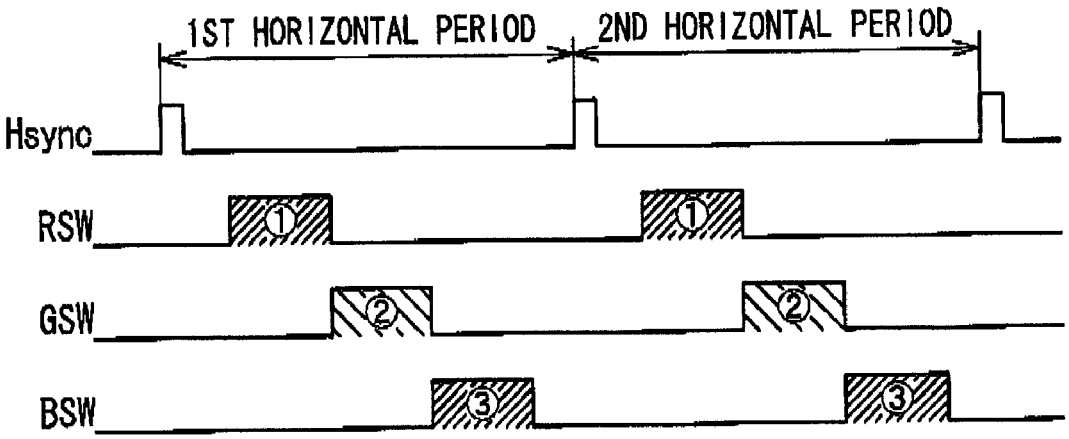
FIG. 4 is a timing chart illustrating operations of the conventional liquid crystal display device.
Figure 5:
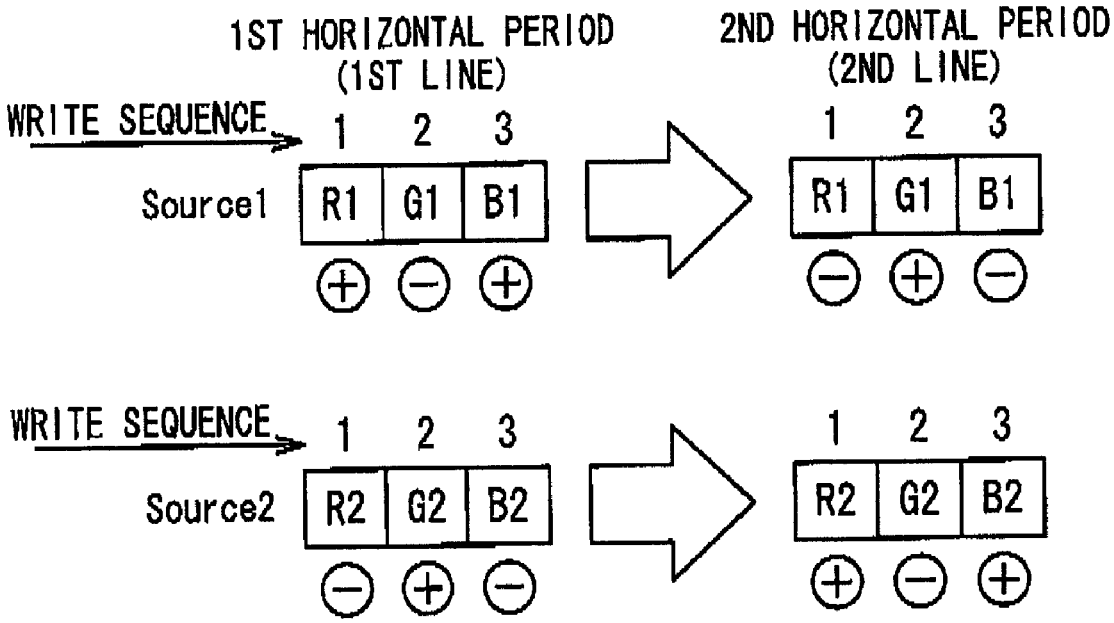
FIG. 5 is a diagram illustrating pixels into which data signals outputted from respective output terminals of the LCD driver are written, and the polarities of the respective data signals.

The structure of the LCD panel 1 is similar to that of the LCD panel 101 illustrated in FIG. 1A. In detail, the LCD panel 1 is provided with gate lines 11, data lines 12, and pixels 13 arranged in rows and columns. The structure of the respective pixels 13 is as shown in FIG. 1B. The LCD panel 1 is provided with one input node 17 for three data lines 12.

The pixel 13 includes R pixels $\mathbf{13}_{R1}$, $\mathbf{13}_{R2}$ used to display the red(R) color, G pixels $\mathbf{13}_{G1}$, $\mathbf{13}_{G2}$ used to display the green(G) color, B pixels $\mathbf{13}_{B1}$, $\mathbf{13}_{B2}$ used to display the blue (B) color. It should be noted that the R pixels $\mathbf{13}_{R1}$, G pixels $\mathbf{13}_{G1}$, and B pixels $\mathbf{13}_{B1}$ are associated with odd input nodes $\mathbf{17}_{O}$, and the R pixels $\mathbf{13}_{R2}$, G pixels $\mathbf{13}_{G2}$, and B pixels $\mathbf{13}_{B2}$ are associated with even input nodes $\mathbf{17}_{E}$.

The pixels 13 connected to the same data line 12 are associated with the same color. Hereinafter, the data lines connected to the R pixels $\mathbf{13}_{R1}$ and $\mathbf{13}_{R2}$, may be referred to as the data lines $\mathbf{12}_{R1}$ and $\mathbf{12}_{R2}$, respectively. Correspondingly, the data lines connected to the G pixels $\mathbf{13}_{G1}$ and $\mathbf{13}_{G2}$ may be referred to as the data lines $\mathbf{12}_{G1}$ and $\mathbf{12}_{G2}$, respectively, while the data lines connected to the B pixels $\mathbf{13}_{B1}$ and $\mathbf{13}_{B2}$ may be referred to as the data lines $\mathbf{12}_{B1}$ and $\mathbf{12}_{B2}$, respectively.

The data lines $\mathbf{12}_{R1}$, $\mathbf{12}_{G1}$ and $\mathbf{12}_{B1}$ are connected to associated odd input nodes 17, through switches $\mathbf{19}_{R1}$, $\mathbf{19}_{G1}$ and $\mathbf{19}_{B1}$, respectively, while the data lines $\mathbf{12}_{R2}$, $\mathbf{12}_{G2}$ and $\mathbf{12}_{B2}$ are connected to associated even input nodes $\mathbf{17}_{E}$ through switches $\mathbf{19}_{R2}$, $\mathbf{19}_{G2}$ and $\mathbf{19}_{B2}$. These switches 19 are turned on and off in response to control signals RSW, GSW and BSW received from the LCD driver 2. Specifically, the switches $\mathbf{19}_{R1}$ and $\mathbf{19}_{R2}$ are operated in response to the control signal RSW, the switches $\mathbf{19}_{G1}$ and $\mathbf{19}_{G2}$ are operated in response to the control signal GSW, and the switches $\mathbf{19}_{B1}$ and $\mathbf{19}_{B2}$ are operated in response to the control signal BSW. The selection of desired data lines 12 are achieved by turning on desired ones of the switches 19.

The input nodes 17 of the LCD panel 1 are connected to the output terminals of the LCD driver 2, respectively. The output terminals of the LCD driver 2 may be denoted by the symbols "Source1", "Source2" . . . . It should be noted that the odd-numbered output terminals Source1, Source3 . . . may be collectively referred to as odd output terminals, while the even-numbered output terminals Source2, Source4 . . . may be collectively referred to as even output terminals.

Figure 7:
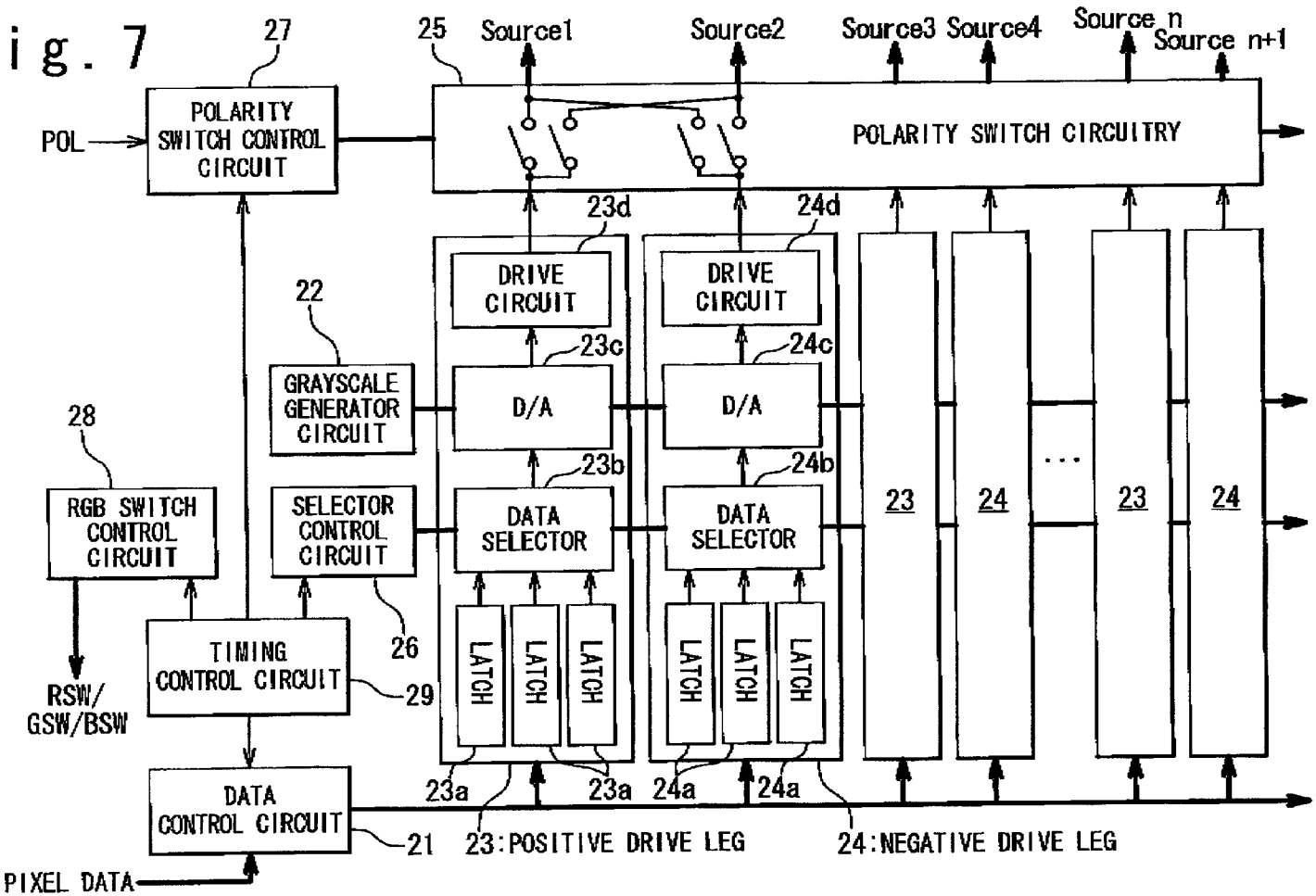
FIG. 7 is a block diagram illustrating an exemplary structure of an LCD driver in the first embodiment.

FIG. 7 is a block diagram illustrating the structure of the LCD driver 2. The LCD driver 2 is provided with a data control circuit 21, a grayscale generator circuit 22, a set of positive drive legs 23, a set of negative drive legs 24, a polarity switch circuitry 25, a selector control circuit 26, a polarity switch control circuit 27, an RGB switch control circuit 28, and a timing control circuit 29.

The data control circuit 21 forwards pixel data of the pixels 13 to the positive drive legs 23 or the negative drive legs 24 in accordance with the polarities of data signals to be fed to the respective pixels 13. Specifically, the data control circuit 21 receives pixel data indicative of grayscale levels of the pixels 13 in the selected line. The data control circuit 21 forwards the pixel data associated with the pixels 13 to be driven with positive data signals to the positive drive legs 23, and forwards the pixel data associated with the pixels 13 to be driven with negative data signals to the negative drive legs 24.

The grayscale generator circuit 22 feeds a set of grayscale voltages associated with allowed grayscale levels of the pixels 13, respectively, to the positive drive legs 23 and the negative drive legs 24. In detail, the grayscale generator circuit 22 feeds grayscale voltages of the positive polarity to the positive drive legs 23, while feeding grayscale voltages of the negative polarity to the negative drive legs 24. The number of the grayscale voltages fed to the positive drive legs 23, and the number of the grayscale voltages fed to the negative drive legs 24 are both identical to the number of allowed grayscale levels of the pixels 13. When the number of the allowed grayscale levels is 64, the grayscale generator circuit 22 feeds a set of 64 different grayscale voltages with the positive polarity to the positive drive legs 23, and feeds a set of 64 different grayscale voltages with the negative polarity to the negative drive legs 24.

The positive drive legs 23 are a set of circuitries that generate positive data signals in response to the pixel data fed thereto, and the negative drive legs 24 are a set of circuitries that generate negative data signals in response to the pixel data fed thereto. One positive drive leg 23 and one negative drive leg 24 are provided for every two output terminals of the LCD driver 2 (that is, for every two input nodes 17 of the LCD panel 1. In accordance with the fact that a set of data lines 12 associated with each input node 17 are sequentially selected in each horizontal period, each of the positive drive legs 23 and the negative drive legs 24 drives three pixels 13 in each horizontal period. The positive drive legs 23 use the positive grayscale voltages received from the grayscale generator circuit 22 to generate positive data signals, and the negative drive legs 24 use the negative grayscale voltages received from the grayscale generator circuit 22 to generate negative data signals.

In detail, the positive drive legs 23 are each provided with a set of latch circuits 23*a*, a data selector circuit 23*b*, a D/A converter 23*c*, and a drive circuit 23*d*. Each latch circuit 23*a* latches pixel data from the data control circuit 21, and forwards the latched pixel data to the data selector circuit 23*b*. In accordance with the fact that each positive drive leg 23 drives three pixels 13 in each horizontal period, the positive drive legs 23 each include three latch circuits 23*a*.

The data selector circuit 23*b* selects one of the three latch circuits 23*a* which is associated with the pixel 13 to be driven next, and forwards the pixel data from the selected latch circuit 23*a* to the D/A converter 23*c*.

The D/A converter 23*c* performs D/A conversion on the pixel data received from the selected latch circuit 23*a* to output a grayscale voltage corresponding to the received pixel data. More specifically, the D/A converter 23*c* selects one of the positive grayscale voltages received from the grayscale generator circuit 22 in response to the pixel data received from the selected latch circuit 23*a*, and feeds the selected grayscale voltage to the drive circuit 23*d*.

The drive circuit 23*d* generates a data signal corresponding to the pixel data. The drive circuit 23*d* functions as a voltage follower, and outputs a data signal having a signal level corresponding to the grayscale voltage received from the D/A converter 23*c*. In one embodiment, an operation amplifier is used as the drive circuit 23*d*.

In one embodiment, a level shifter (not shown) may be inserted between the data selector circuit 23*b* and the D/A converter 23*c*. This is based on the fact that high grayscale voltages may be applied to the D/A converter 23*c* in this embodiment, in which the common constant drive is used. The level shifter is used to provide voltage level matching between the voltage level of the signal outputted from the data selector 23*b*, and the voltage levels of signals generated within or fed to the D/A converter 23.

The structure and operation of the negative drive legs 24 are almost identical to those of the positive drive legs 23, except for that the polarities of grayscale voltages received from the grayscale generator circuit 22 and the polarities of the data signals to be generated are different. The negative drive legs 24 are each provided with a set of latch circuits 24*a*, a data selector circuit 24*b*, a D/A converter 24*c*, and a drive circuit 24*d*. The latch circuits 24*a*, the data selector circuit 24*b*, the D/A converter 24*c*, and the drive circuit 24*d* have the same functions as the latch circuits 23*a*, the data selector circuit 23*b*, the D/A converter 24*c*, and the drive circuit 23*d*, respectively.

The polarity switch circuitry 25 is designed to connect the respective outputs of the positive and negative drive legs 23 and 24 to the output terminals of the LCD driver 2. When positive data signals are fed to the odd output terminals Source1, Source3 . . . and negative data signals are fed to the even output terminals Source2, Source4 . . . , for example, the polarity switch circuitry 25 connects the outputs of the positive drive legs 23 to the odd output terminals Source1, Source3 . . . , respectively, and connects the outputs of the negative drive legs 24 to the even output terminals Source2, Source4.

The selector control circuit 26 controls the data selector circuits 23*b* and 24*b* so that desired ones of the pixel data latched in the latch circuits 23*a* and 24*a* are forwarded to the D/A converters 23*c* and 24*c*.

The polarity switch control circuit 27 is responsive to a polarity signal POL for indicating electrical connections within the polarity switch circuitry 25. When the polarity signal POL is activated (that is, the polarity signal POL is pulled up to the "High" level), the polarity switch control circuit 27 connects the positive drive legs 23 to the odd output terminals Source1, Source3 . . . , and connects the negative drive legs 24 to the even output terminals Source2, Source4 . . . . When the polarity signal POL is deactivated (that is, the polarity signal POL is pulled down to the "Low" level), the polarity switch control circuit 27 connects the positive drive legs 23 to the even output terminals Source2, Source4 . . . , and connects the negative drive legs 24 to the odd output terminals Source1, Source3 . . . .

The RGB switch control circuit 28 generates the control signals RSW, GSW, BSW for controlling the switches 19 integrated within the LCD panel 1.

The timing control circuit 29 controls operation timings of the data control circuit 21, the selector control circuit 26, the polarity switch control circuit 27, and the RGB switch control circuit 28.

(Operation of the Liquid Crystal Display Device)

One feature of the liquid crystal display device in the first embodiment is that the order of the selection of the data lines 12, that is, the sequence of writing data signals into the respective pixels 13 are determined so that data signals with the same polarity are successively outputted from each output terminal of the LCD driver 2. Such operation reduces the number of times of inverting the polarities of the data signal developed on the output terminals of the LCD driver 2, and effectively reduces the power consumption of the LCD driver 2.

Figure 8:
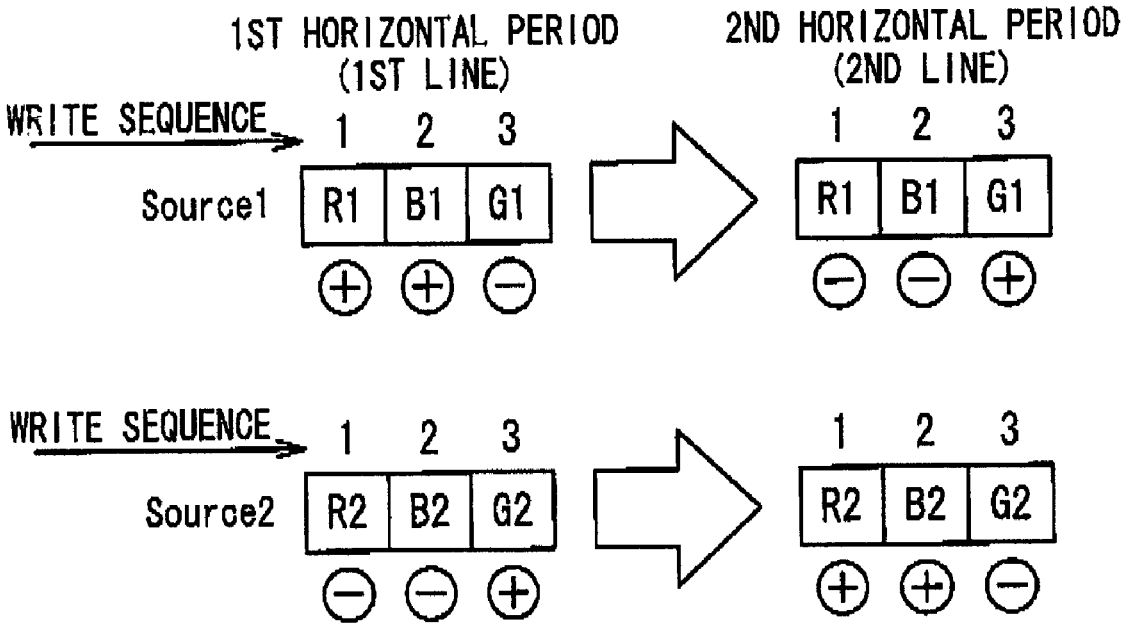
FIG. 8 is a diagram illustrating pixels into which data signals outputted from respective output terminals of the LCD driver are written, and the polarities of the respective data signals.

Specifically, in the first horizontal period, the LCD driver 2 successively outputs positive data signals to be fed to the R pixels $\mathbf{13}_{R1}$ and B pixels $\mathbf{13}_{B1}$ from the odd output terminals Source1, Source3 . . . , and then outputs negative data signals to be fed to the G pixels $\mathbf{13}_{G1}$ from the odd output terminals Source1, Source3 . . . , as shown in FIG. 8. Concurrently, the LCD driver 2 successively outputs negative data signals to be fed to the R pixels $\mathbf{13}_{R2}$ and B pixels $\mathbf{13}_{B2}$ from the even output terminals Source2, Source4 . . . , and then outputs positive data signals to be fed to the G pixels $\mathbf{13}_{G2}$, from the even output terminals Source2, Source4 . . . It should be noted that the voltage levels of the respective output terminals of the LCD driver 2 are inverted only when the data signals are written into the G pixels $\mathbf{13}_{G1}$ and $\mathbf{13}_{G2}$.

In the second horizontal period, data signals are outputted from the LCD driver 2 in the same write sequence, with the polarities of the respective data signals inverted. In the second horizontal period, the LCD driver 2 successively outputs negative data signals to be fed to the R pixels $\mathbf{13}_{R1}$ and B pixels $\mathbf{13}_{B1}$ from the odd output terminals Source1, Source3 . . . , and then outputs positive data signals to be fed to the G pixels $\mathbf{13}_{G1}$ from the odd output terminals Source1, Source3 . . . , as shown in FIG. 8. Concurrently, the LCD driver 2 successively outputs positive data signals to be fed to the R pixels $\mathbf{13}_{R2}$ and B pixels $\mathbf{13}_{B2}$ from the even output terminals Source2, Source4 . . . , and then outputs negative data signals to be fed to the G pixels $\mathbf{13}_{G2}$, from the even output terminals Source2, Source4 . . . . It should be noted that the voltage levels of the respective output terminals of the LCD driver 2 are inverted in the second embodiment only when the data signals are written into the G pixels $\mathbf{13}_{G1}$ and $\mathbf{13}_{G2}$.

The remaining pixels 13 are driven in the same manner in the following horizontal periods. In the odd horizontal periods, the pixels 13 in the odd lines are driven in the same manner as the first horizontal period, while the pixels 13 in the even lines are driven in the same manner as the second horizontal period.

In such operations, the polarities of the data signals generated on the respective output terminals of the LCD driver 2 are inverted only once in each horizontal period. This effectively reduces the power consumption of the LCD driver 2.

Figure 9:
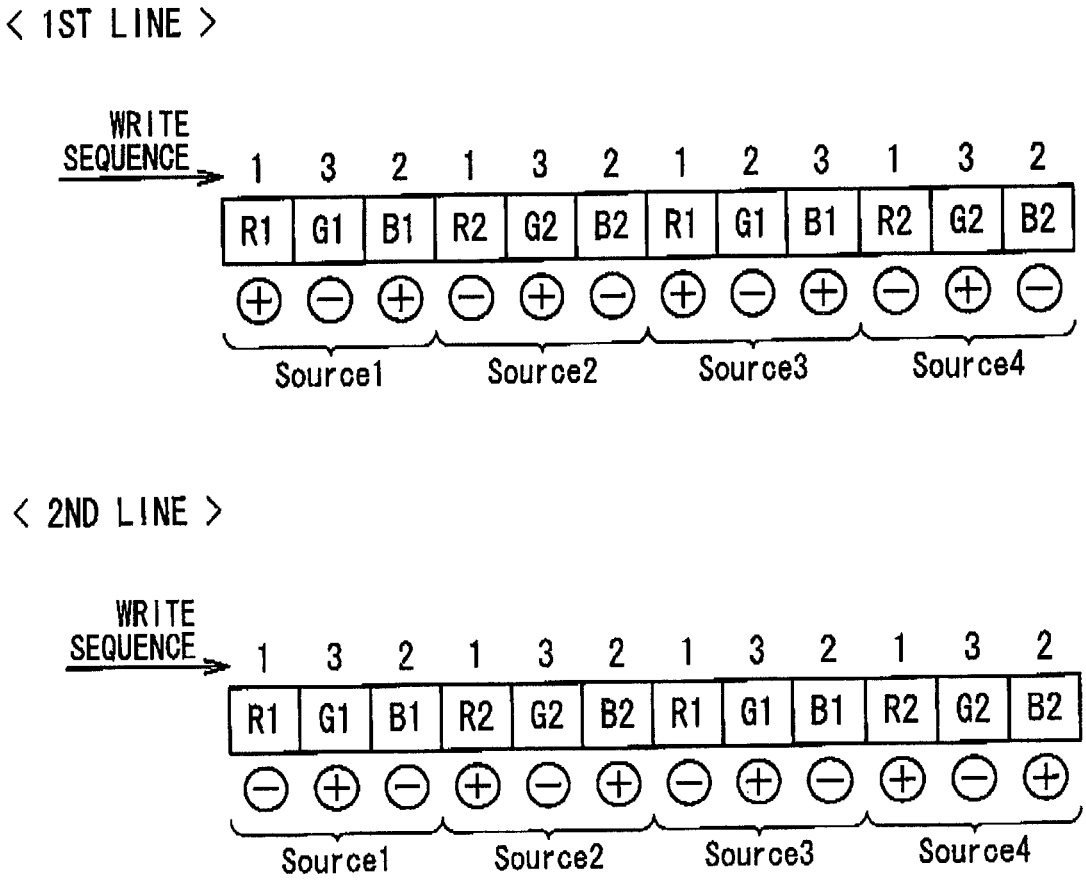
FIG. 9 is a diagram illustrating the write sequence of the pixels, and the polarities of the data signals written into the respective pixels.

It should be noted that the operations above-described achieves the dot inversion drive, in which adjacent pixels 13 are driven with data signals of opposite polarities, FIG. 9 illustrates the write sequence of the pixels 13 and the polarities of the data signals written into the respective pixels 13, when the pixels 13 are driven in accordance with the procedure shown in FIG. 8. With respect to the pixels 13 in the first line, positive data signals are written into the pixels $\mathbf{13}_{R1}$, $\mathbf{13}_{B1}$ and $\mathbf{13}_{G2}$ which are positioned at the odd-numbered positions, while negative data signals are written into the pixels $\mathbf{13}_{G1}$, $\mathbf{13}_{R2}$, and $\mathbf{13}_{B2}$, which are positioned at the even-numbered positions. With respect to the pixels 13 in the second line, on the other hand, negative data signals are written into the pixels $\mathbf{13}_{R1}$, $\mathbf{13}_{B1}$ and $\mathbf{13}_{G2}$, which are positioned at the odd-numbered positions, while positive data signals are written into the pixels $\mathbf{13}_{G1}$, $\mathbf{13}_{R2}$ and $\mathbf{13}_{B2}$, which are positioned at the even-numbered positions. As thus described, the polarities of data signals written into adjacent pixels 13 are opposite with respect to both of the horizontal and vertical directions.

It should be noted that the write sequence of the pixels 13 shown in FIG. 9 is different from the order of the spatial arrangement of the pixels 13. The R pixel $\mathbf{13}_{R1}$, G pixels $\mathbf{13}_{G1}$ and B pixels $\mathbf{13}_{B1}$ are arranged from the left in this order within the LCD panel 1, while data signals are written into the R pixel $\mathbf{13}_{R1}$, B pixels $\mathbf{13}_{B1}$ and G pixels $\mathbf{13}_{G1}$ in this order. One finding of the inventor is that the differently-determined write sequence and spatial arrangement order of the pixels 13 allows reducing the number of times of the inversion of the data signals generated on the output terminals of the LCD driver 2, when the liquid crystal display device adopts the dot inversion drive.

Figure 10:
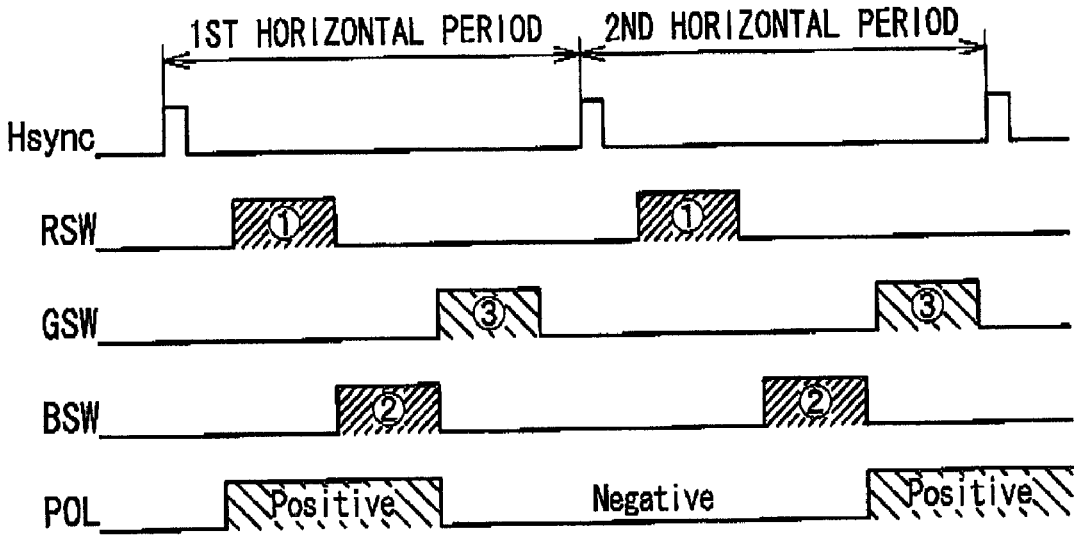
FIG. 10 is a timing chart illustrating an exemplary operation of the liquid crystal display device in the first embodiment.

More specifically, the write operation of the data signals into the pixels 13 is implemented as follows. Referring to FIG. 10, after the first horizontal period is initiated with activation of the horizontal sync signal Hsync, the gate line $\mathbf{11}_1$ is activated to select the pixels 13 in the first line. It should be noted that, when the first horizontal period is initiated, the polarity signal POL is activated, and the odd output terminals Source1, Source3 . . . are connected to the positive drive legs 23 and the even output terminals Source2, Source4 . . . are connected to the negative drive legs 24. In other words, the LCD driver 2 is set to output positive data signals from the odd output terminals Source1, Source3 . . . , and to output negative data signals from the even output terminals Source2, Source4 . . . .

As shown in FIG. 8, the LCD driver 2 then sequentially outputs positive data signals to be fed to the R pixels $\mathbf{13}_{R1}$ and B pixels $\mathbf{13}_{B1}$ from the odd output terminals Source1, Source3 . . . , while sequentially outputting negative data signals to be fed to the R pixels $\mathbf{13}_{R2}$ and B pixels $\mathbf{13}_{B2}$ from the even output terminals Source2, Source4 . . . . Additionally, as shown in FIG. 10, the LCD driver 2 sequentially activates the control signals RSW and BSW in synchronization with the outputs of the data signals associated with the R pixels $\mathbf{13}_{R1}$, $\mathbf{13}_{R2}$ and the B pixels $\mathbf{13}_{B1}$, $\mathbf{13}_{B2}$. This allows sequentially selecting the data lines $\mathbf{12}_{R1}$ and $\mathbf{12}_{B1}$ to write positive data signals into the R pixels $\mathbf{13}_{R1}$ and the B pixels $\mathbf{13}_{B1}$ through the selected data lines $\mathbf{12}_{R1}$ and $\mathbf{12}_{B1}$, and also sequentially selecting the data lines $\mathbf{12}_{R2}$ and $\mathbf{12}_{B2}$ to write negative data signals into the R pixels $\mathbf{13}_{R2}$ and the B pixels $\mathbf{13}_{B2}$ through the selected data lines $\mathbf{12}_{R2}$ and $\mathbf{12}_{B2}$.

After the data signal write operation into the B pixels $\mathbf{13}_{B1}$ and $\mathbf{13}_{B2}$ is completed, the polarity signal POL is inverted to thereby switch the electrical connections within the polarity switch circuitry 25. This results in that the odd output terminals Source1, Source3 . . . are connected to the negative drive legs 24 and the even output terminals Source2, Source4 . . . are connected to the positive drive legs 23.

The LCD driver 2 then outputs negative data signals to be fed to the G pixels $\mathbf{13}_{G1}$ from the odd output terminals Source1, Source3 . . . , and outputs positive data signals to be fed to the G pixels $\mathbf{13}_{G2}$ from the even output terminals Source2, Source4 . . . , as shown in FIG. 8. Additionally, as shown in FIG. 10, the LCD driver 2 activates the control signal GSW in synchronization with the outputs of the data signals associated with the G pixels $\mathbf{13}_{G1}$ and $\mathbf{13}_{G2}$, to thereby select the data lines $\mathbf{12}_{G1}$ and $\mathbf{12}_{G2}$. This results in that negative data signals are written into the G pixels $\mathbf{13}_{G1}$ through the selected data lines $\mathbf{12}_{G1}$, and positive data signals are written into the G pixels $\mathbf{13}_{G2}$ through the selected data lines $\mathbf{12}_{G2}$. This completes the write operation of the data signals in the first horizontal period. It should be noted that the voltage levels on the respective output terminals of the LCD driver 2 are inverted in the first horizontal period, only when the data signals are written into the G pixels $\mathbf{13}_{G1}$ and $\mathbf{13}_{G2}$.

A similar procedure is implemented in the second horizontal period with the polarities of the data signals inverted. Referring to FIG. 10, after the second horizontal period is initiated with the horizontal sync signal Hsync activated, the gate line $\mathbf{11}_2$ is activated to select the pixels 13 in the second line.

As shown in FIG. 8, the LCD driver 2 then sequentially outputs negative data signals to be fed to the R pixels $\mathbf{13}_{R1}$ and B pixels $\mathbf{13}_{B1}$ from the odd output terminals Source1, Source3 . . . , while sequentially outputting positive data signals to be fed to the R pixels $\mathbf{13}_{R2}$ and B pixels $\mathbf{13}_{B2}$ from the even output terminals Source2, Source4 . . . . Additionally, as shown in FIG. 10, the LCD driver 2 sequentially activates the control signals RSW and BSW in synchronization with the outputs of the data signals associated with the R pixels $\mathbf{13}_{R1}$, $\mathbf{13}_{R2}$ and the B pixels $\mathbf{13}_{B1}$, $\mathbf{13}_{B2}$. This allows sequentially selecting the data lines $\mathbf{12}_{R1}$ and $\mathbf{12}_{B1}$ to write negative data signals into the R pixels $\mathbf{13}_{R1}$ and the B pixels $\mathbf{13}_{B1}$ through the selected data lines $12_{R1}$ and $12_{B1}$, and also sequentially selecting the data lines $12_{R2}$ and $12_{B2}$ to write positive data signals into the R pixels $13_{R2}$ and the B pixels $13_{B2}$ through the selected data lines $12_{R2}$ and $12_{B2}$.

After the data signal write operation into the B pixels $13_{B1}$ and $13_{B2}$ is completed, as shown in FIG. 10, the polarity signal POL is inverted to thereby switch the electrical connections within the polarity switch circuitry 25. This results in that the odd output terminals Source1, Source3 . . . are connected to the positive drive legs 23 and the even output terminals Source2, Source4 . . . are connected to the negative drive legs 23.

As shown in FIG. 8, the LCD driver 2 then outputs positive data signals to be fed to the G pixels $13_{G1}$ from the odd output terminals Source1, Source3 . . . , while outputting negative data signals to be fed to the G pixels $13_{G2}$ from the even output terminals Source2, Source4 . . . . Additionally, as shown in FIG. 10, the LCD driver 2 activates the control signals GSW in synchronization with the outputs of the data signals associated with the G pixels $13_{G1}$ and $13_{G2}$. This allows writing the positive data signals into the G pixels $13_{G1}$, and writing the negative data signals into the G pixels $13_{G2}$. This completes the write operation of the data signals in the second horizontal period. It should be noted that the voltage levels on the respective output terminals of the LCD driver 2 are inverted in the second horizontal period, only when the data signals are written in to the G pixels $13_{G1}$ and $13_{G2}$.

As thus described, the liquid crystal display device in this embodiment reduces the number of times of the inversion of the polarities of the data signals developed on the output terminals of the LCD driver 2, and thereby effectively reduces the power consumption of the LCD driver 2.

Figure 11:
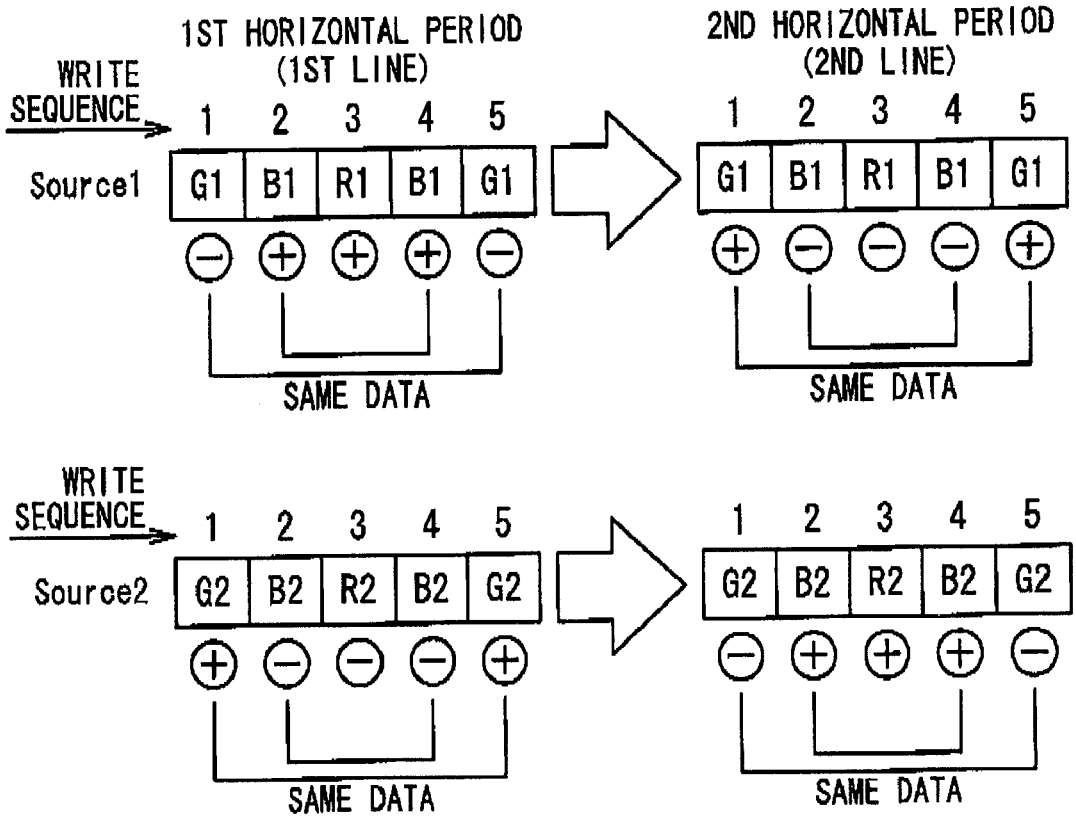
FIG. 11 is a diagram illustrating pixels into which data signals outputted from respective output terminals of the LCD driver are written, and the polarities of the respective data signals, in a preferred modification of the first embodiment.

FIG. 11 is a diagram illustrating a further preferable operation of the liquid crystal display device in this embodiment. The operation shown in FIG. 11 is directed to deal with change in the write voltages held in the pixels 13 due to the capacitive coupling between adjacent data lines 12, which is one of the problems in a liquid crystal display device adopting both of the time-division drive and the dot inversion drive. In the following, a description is firstly given of the change in the write voltages held in the pixels 13 due to the capacitive coupling.

Using the time-division drive requires disconnecting the respective data lines 12 from the associated input nodes 17 after the write operation of the data signals into the pixels 13. Therefore, the voltage levels of the data lines 12 are desirably kept unchanged after the write operations of the data signals into the associated pixels 13 until the write operations complete with respect to all the pixels 13; otherwise, desired voltages are not held across the liquid crystal capacitors within the respective pixels 13.

The dot inversion drive, on the other hand, requires feeding data signals with opposite polarities to adjacent data lines 12. This implies that the capacitive coupling between adjacent data lines 12 may cause a change in the voltage levels on the data lines 12. The change in the voltage levels on the data lines 12 causes an undesirable change in the write voltages held in the pixels 13.

Figure 12:
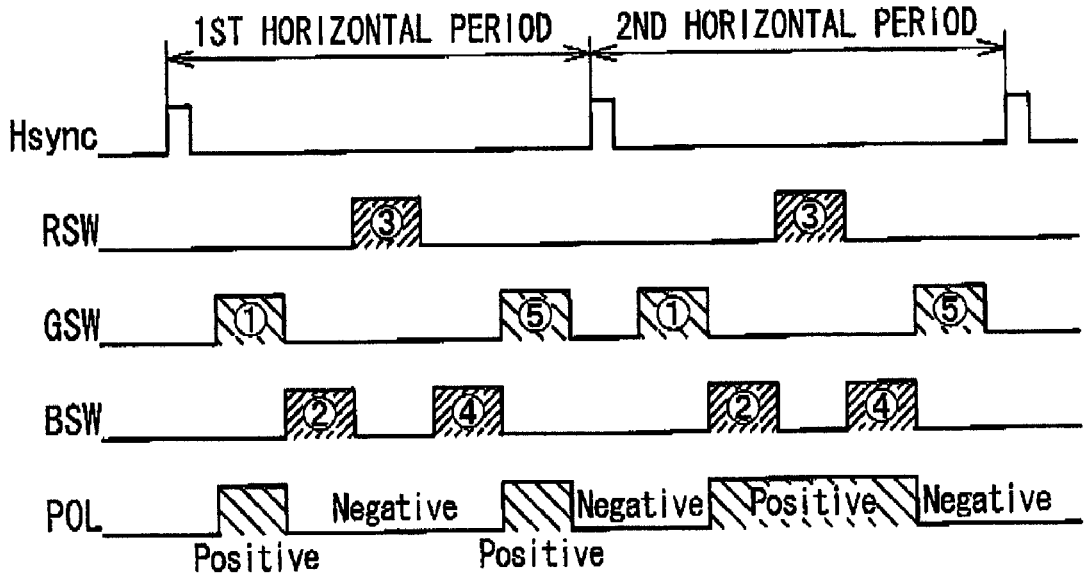
FIG. 12 is a timing chart illustrating the operation of the liquid crystal display device in the preferred modification of the first embodiment.

The operation shown in FIG. 11 is directed to effectively deal with such problem. Specifically, in the operation shown in FIG. 11, data signals are sequentially written into the G pixels and B pixels, and then written into the R pixels, G pixels and B pixels. The write operation into the pixels 13 with such write sequence can be achieved by activating the control signals GSW and BSW in this order, and then activating the control signals RSW, BSW and GSW in this order, as shown in FIG. 12. It should be noted that the data signals with the same signal level are written into the respective G pixels and B pixels in each horizontal period, while the data signals are written into the R pixels only once.

The operation shown in FIG. 11 effectively suppresses undesirable affection of the capacitive coupling between adjacent data lines 12 through the principle described in the following. Referring to FIG. 6, the voltage levels of the data lines 12 connected to the G pixels are slightly changed due to the capacitive coupling, when data signals are written into the B pixels after data signals are firstly written into the G pixels. Correspondingly, the voltage levels of the data lines 12 connected to the B pixels are slightly changed due to the capacitive coupling, when data signals are written into the R pixels after data signals are written into the B pixels.

However, the data signals are rewritten into the B pixels after the data signals are written into the R pixels, and thereby the data lines 12 connected to the B pixels 12 are driven to desired voltage levels without changing the voltage levels of the data lines 12 connected to the R pixels. This owes to the fact that voltage levels almost same as the desired voltage levels are already developed on the data lines 12 connected to the B pixels by the previously performed write operation into the B pixels. The rewriting of the data signals into the B pixels causes only a small change in the voltage levels on the data lines 12 connected to the B pixels, and therefore causes only a small change in the voltage levels on the data lines 12 connected to the R pixels, which are adjacent to the data lines 12 connected to the B pixels.

Correspondingly, the data signals are rewritten into the G pixels after the data signals are rewritten into the B pixels, and thereby the data lines 12 connected to the G pixels 12 are driven to desired voltage levels without changing the voltage levels of the data lines 12 connected to the B pixels.

It should be noted that the R pixels does not require repeated write operations. This is because the write operations performed after the write operation into the R pixels does not cause any large change in the voltage levels on the data lines 12.

It should be also noted that the write sequence of the pixels 13 is determined in the operation shown in FIG. 11, so that the number of times of inversion of the polarities of the data signals developed on the output terminals of the LCD driver 2. In the first horizontal period, for example, the negative data signals to be written into the G pixels $13_{G1}$ are firstly generated on the odd output terminals Source1, Source3. This is followed by generation of the positive data signals to be written into the B pixels $13_{G1}$, and the R pixels $13_{R1}$. Next, the positive data signals to be rewritten into the B pixels $13_{B1}$ are generated on the odd output terminals Source1, Source3, and then the negative data signals to be rewritten into the G pixels $13_{G1}$ are finally generated. In the second horizontal period, the positive data signals to be written into the G pixels $13_{G1}$ are first generated on the odd output terminals Source1, Source3. This is followed by generation of the negative data signals to be written into the B pixels $13_{B1}$, and the R pixels $13_{R1}$. Next, the negative data signals to be rewritten into the B pixels $13_{B1}$ are generated on the odd output terminals Source1, Source3, and then the positive data signals to be rewritten into the G pixels $13_{G1}$ are finally generated. Such operation effectively reduces the number of times of the inversion of the polarities of the data signals developed on the output terminals Source1, Source3 . . . , down to three, although the write operations of the data signals are performed five times in each horizontal period.

The same applies to the even output terminals Source2, Source4 . . . . When the first horizontal period is initiated, the positive data signals to be written into the G pixels $13_{G2}$ are firstly generated on the even output terminals Source2, Source4. This is followed by generation of the negative data signals to be written into the B pixels $\mathbf{13}_{B2}$, and the R pixels $\mathbf{13}_{R2}$. Next, the negative data signals to be rewritten into the B pixels $\mathbf{13}_{B2}$ are generated on the even output terminals Source2, Source4, and then the positive data signals to be rewritten into the G pixels $\mathbf{13}_{G2}$ are finally generated. In the second horizontal period, the negative data signals to be written into the G pixels $\mathbf{13}_{G2}$ are first generated on the even output terminals Source2, Source4. This is followed by generation of the positive data signals to be written into the B pixels $\mathbf{13}_{B2}$, and the R pixels $\mathbf{13}_{R2}$. Next, the positive data signals to be rewritten into the B pixels $\mathbf{13}_{B2}$ are generated on the even output terminals Source2, Source4, and then the negative data signals to be rewritten into the G pixels $\mathbf{13}_{G2}$ are finally generated. Such operation effectively reduces the number of times of the inversion of the polarities of the data signals developed on the output terminals Source2, Source4 . . . down to three, in each horizontal period.

In the following horizontal periods, the pixels 13 are driven in the same manner. In the odd-numbered horizontal periods, the pixels 13 in the odd-numbered line are driven in the same manner as the first horizontal period, while the pixels 13 in the even-numbered line are driven in the same manner as the second horizontal period in the even-numbered horizontal periods.

As thus described, the operation shown in FIG. 11 effectively suppresses the change in the voltage levels of the data lines 12 due to the capacitive coupling between adjacent data lines 12, while reducing the number of times of the inversion of the polarities of the data signals developed on the output terminals of the LCD driver 2.

Second Embodiment

Figure 13:
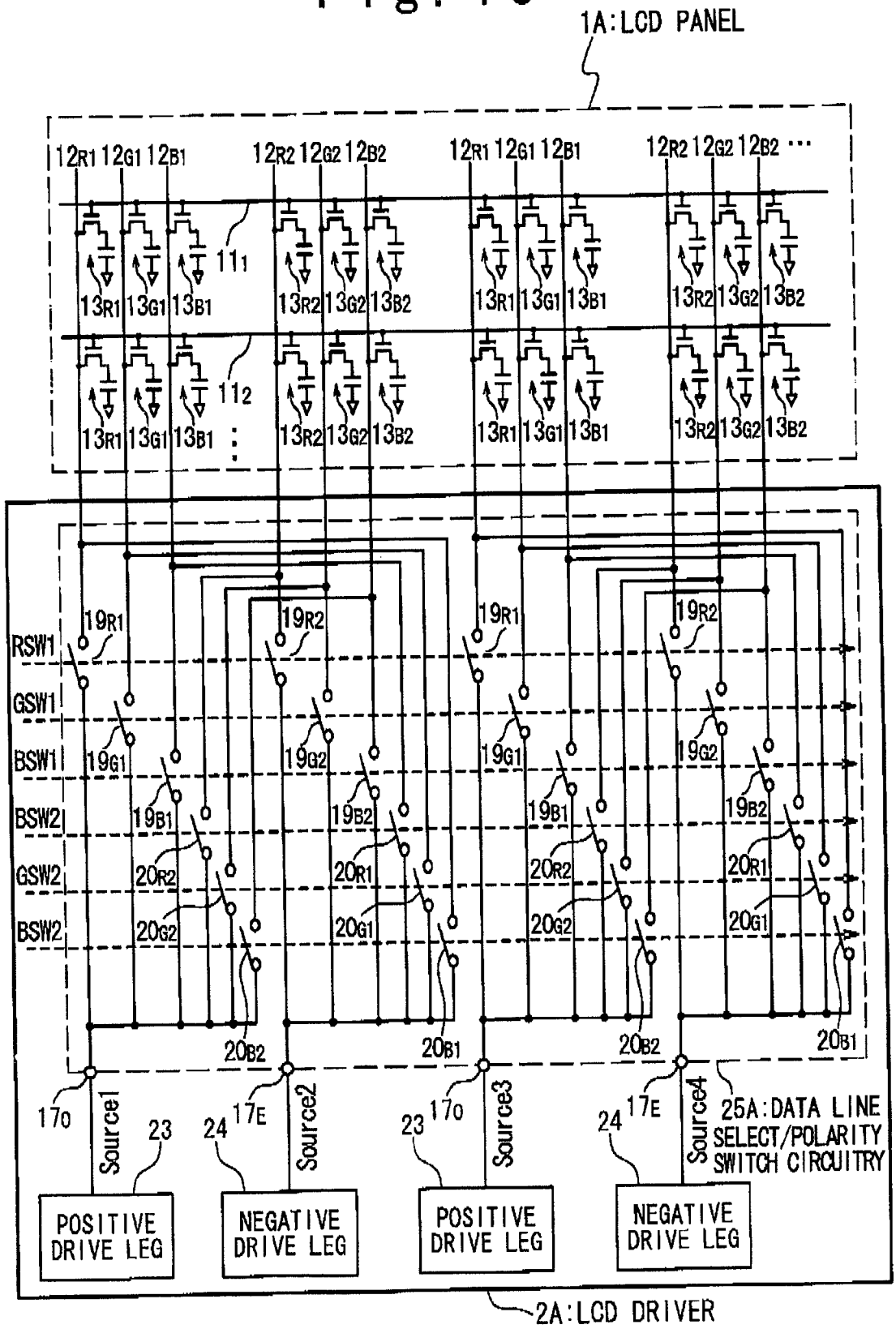
FIG. 13 is a diagram illustrating an exemplary structure of a liquid crystal display device in a second embodiment of the present invention.

FIG. 13 is a circuit diagram illustrating the structure of the liquid crystal display device in a second embodiment of the present invention. In the liquid crystal display device in the second embodiment, the functions of the switches 19 within the LCD panel 1 and the polarity switch circuitry 25 within the LCD driver 2 are achieved by a data line select/polarity switch circuitry 25A integrated in the LCD driver 2A. The data line select/polarity switch circuitry 25A has functions of sequentially selecting the data lines 12, and connecting the selected data lines 12 to desired ones of the positive drive legs 23 and the negative drive legs 24.

In detail, the data line select/polarity switch circuitry 25A is provided with straight switches 19 and cross switches 20. The straight switches 10 are used to connect the positive drive legs 23 to the data lines $\mathbf{12}_{R1}$, $\mathbf{12}_{G1}$ and $\mathbf{12}_{B1}$ through odd input nodes $\mathbf{17}_O$, and to connect the negative drive legs 24 to the data lines $\mathbf{12}_{R2}$, $\mathbf{12}_{G2}$ and $\mathbf{12}_{B2}$ through even input nodes $\mathbf{17}_E$. The straight switches $\mathbf{19}_{R1}$, $\mathbf{19}_{G1}$ and $\mathbf{19}_{B1}$ are connected between the odd input nodes $\mathbf{17}_O$ and the data lines $\mathbf{12}_{R1}$, $\mathbf{12}_{G1}$ and $\mathbf{12}_{B1}$, and the straight switches $\mathbf{19}_{R2}$, $\mathbf{19}_{G2}$ and $\mathbf{19}_{B2}$ are connected between the even input nodes $\mathbf{17}_E$ and the data lines $\mathbf{12}_{R2}$, $\mathbf{12}_{G2}$ and $\mathbf{12}_{B2}$. The straight switches $\mathbf{19}_{R1}$ and $\mathbf{19}_{R2}$ are turned on and of in response to the control signals RSW1. Correspondingly, the straight switches $\mathbf{19}_{G1}$ and $\mathbf{19}_{G2}$ are turned on and of in response to the control signals GSW1, while the straight switches $\mathbf{19}_{B1}$ and $\mathbf{19}_{B2}$ are turned on and of in response to the control signals BSW1.

The cross switches 20, on the other hand, are used to connect the positive drive legs 23 to the data lines data lines $\mathbf{12}_{R2}$, $\mathbf{12}_{G2}$ and $\mathbf{12}_{B2}$, which are associated with the even input nodes $\mathbf{17}_E$, and to connect the negative drive legs 24 to the data lines data lines $\mathbf{12}_{R1}$, $\mathbf{12}_{G1}$ and $\mathbf{12}_{B1}$, which are associated with the odd input nodes $\mathbf{17}_O$. The cross switches $\mathbf{20}_{R2}$, $\mathbf{20}_{G2}$ and $\mathbf{20}_{B2}$ are connected between the odd input nodes $\mathbf{17}_O$ and the data lines $\mathbf{12}_{R2}$, $\mathbf{12}_{G2}$ and $\mathbf{12}_{B2}$, and the cross switches $\mathbf{20}_{R1}$, $\mathbf{20}_{R1}$ and $\mathbf{20}_{B1}$ are connected between the even input nodes $\mathbf{17}_E$ and the data lines $\mathbf{12}_{R2}$, $\mathbf{12}_{G2}$ and $\mathbf{12}_{B2}$. The cross switches $\mathbf{20}_{R1}$ and $\mathbf{20}_{R2}$ are turned on and of in response to the control signals RSW2. Correspondingly, the cross switches $\mathbf{20}_{G1}$ and $\mathbf{20}_{G2}$ are turned on and of in response to the control signals GSW2, while the straight switches $\mathbf{20}_{B1}$ and $\mathbf{20}_{B2}$ are turned on and of in response to the control signals BSW2.

The input nodes 17 of the data line select/polarity switch circuitry 25A are connected to the output terminals of the positive drive legs 23 and the negative drive legs 24, respectively. It should be noted that the output terminals of the positive drive legs 23 and the negative drive legs 24 are denoted by the symbols Source1, Source2 . . . in the second embodiment, differently from the first embodiment.

Figure 14:
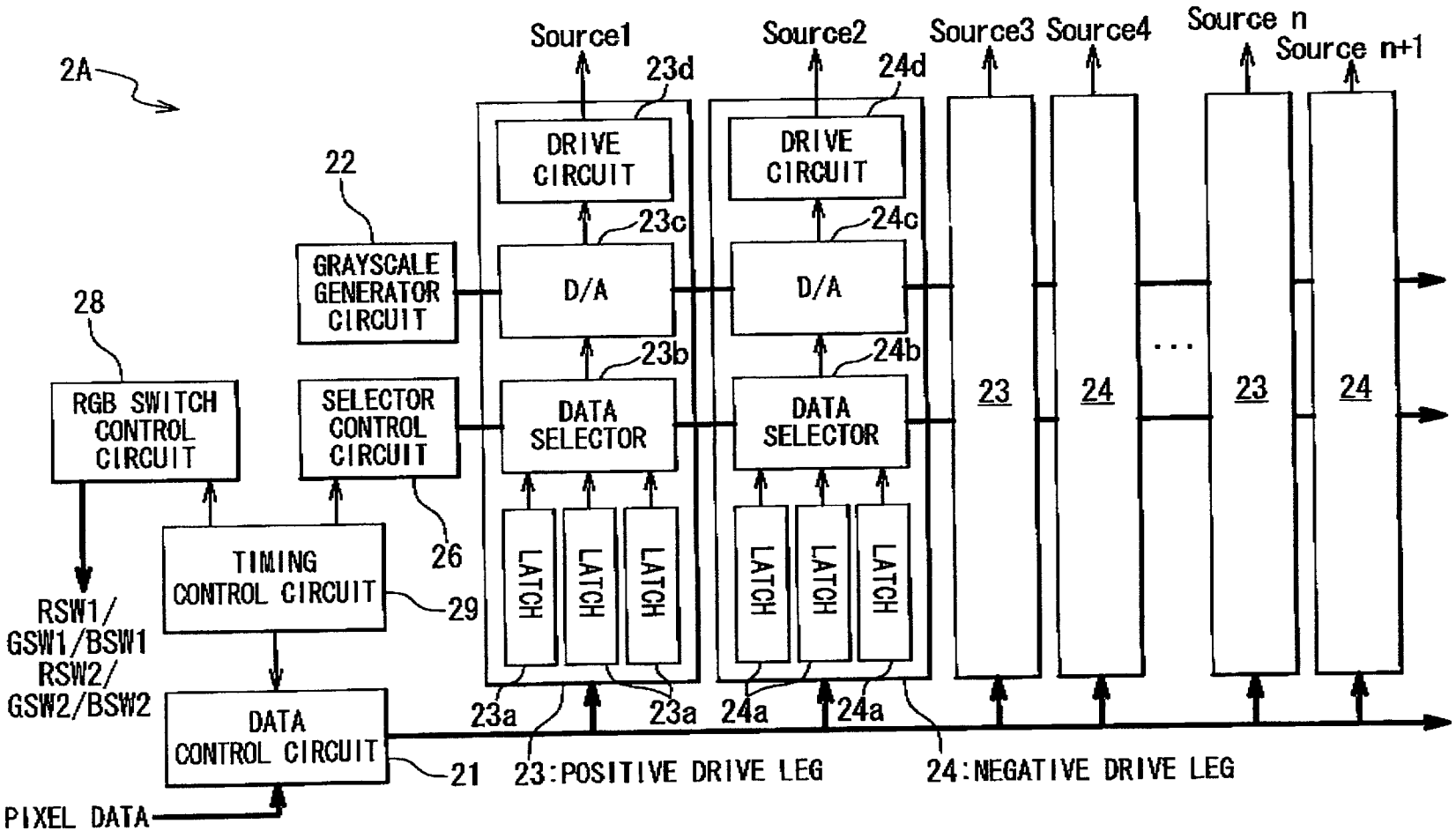
FIG. 14 is a block diagram illustrating an exemplary structure of the LCD driver in the second embodiment.

FIG. 14 is a diagram illustrating the structure of a portion of the LCD driver 2A other than the data line select/polarity switch circuitry 25A, in this embodiment. The structure of the LCD driver 2A is almost identical to that of the LCD driver 2 shown in FIG. 7, except for the following three points: Firstly, the RGB switch control circuit 28 generates the set of the six control signals RSW1, GSW1, BSW1, RSW2, GSW2 and BSW2 in the LCD driver 2A in this embodiment. Secondly, the data line select/polarity switch circuitry 25A is incorporated within the LCD driver 2 instead of the polarity switch circuitry 25. Finally, the LCD driver 2A does not include the polarity switch control circuit 27 shown in FIG. 7.

One feature of the liquid crystal display device in the second embodiment is that the functions of the data line select/polarity switch circuitry 25A eliminate the need for inverting voltage levels on the nodes along the paths distributing the data signals. The circuit configuration of the data line select/polarity switch circuitry 25A, which has a function of connecting both of the odd input nodes $\mathbf{17}_O$ and even input nodes $\mathbf{17}_E$ to any ones of the data lines $\mathbf{12}_{R1}$, $\mathbf{12}_{G1}$, $\mathbf{12}_{B1}$, $\mathbf{12}_{R2}$, $\mathbf{12}_{G2}$ and $\mathbf{12}_{B2}$, allows directly connecting the odd input nodes $\mathbf{17}_O$ and the even input nodes $\mathbf{17}_E$ to the positive drive legs 23 and the negative drive legs 24, respectively. This eliminates the need for switching connections between the odd and input nodes $\mathbf{17}_O$ and $\mathbf{17}_E$ and the positive and negative drive legs 23 and 24, differently from the case of FIG. 7. Therefore, the LCD device in this embodiment eliminates the need for inverting the voltage levels of the odd input nodes $\mathbf{17}_O$ and the even input nodes $\mathbf{17}_E$. In the following, a detailed description is given of the operation of the liquid crystal display device thus constructed in the second embodiment.

Figure 15:
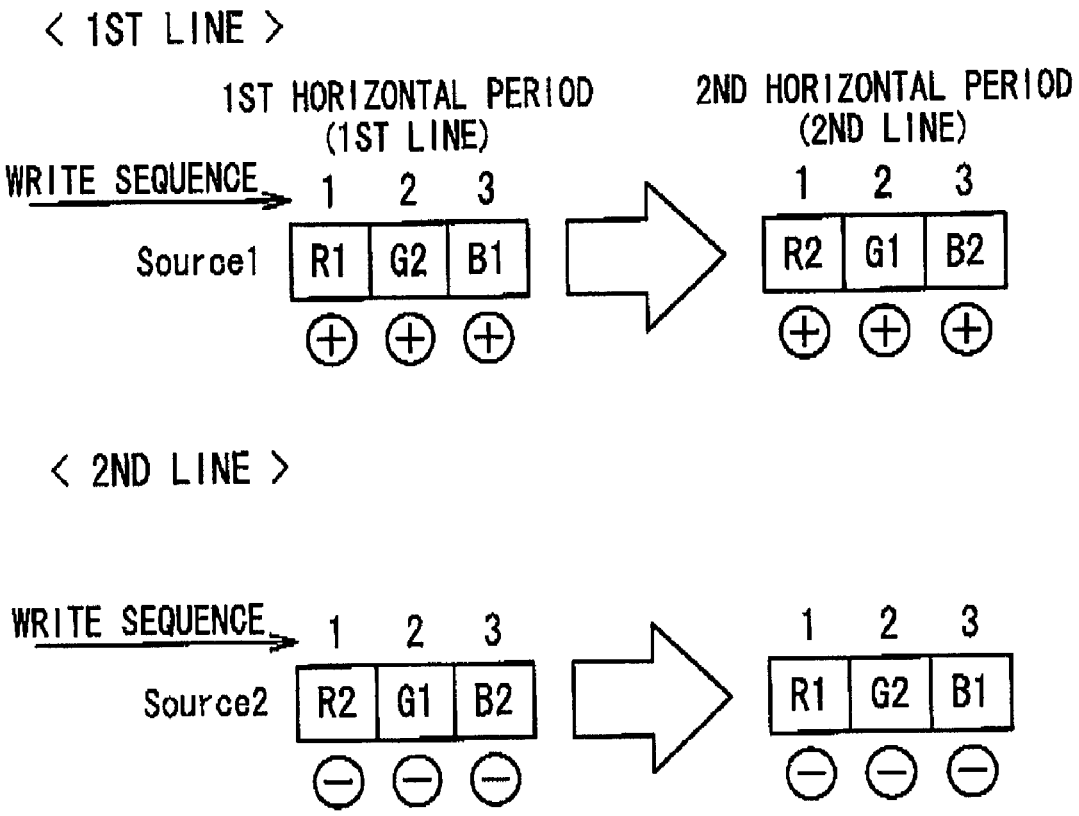
FIG. 15 is a diagram illustrating pixels into which data signals outputted from respective output terminals of the LCD driver are written, and the polarities of the respective data signals, in the second, embodiment.

Specifically, referring to FIG. 15, the gate line 111 is activated to select the pixels 13 in the first line in the first horizontal period. The positive drive legs 23 within the LCD driver 2 then sequentially output positive data signals to be fed to the R pixels $\mathbf{13}_{R1}$, G pixels $\mathbf{13}_{G1}$ and B pixels $\mathbf{13}_{B1}$ from the odd output terminals Source1, Source3 . . . , while the negative drive legs 24 within the LCD driver 2 sequentially output negative data signals to be fed to the R pixels $\mathbf{13}_{R2}$, G pixels $\mathbf{13}_{G2}$ and B pixels $\mathbf{13}_{B2}$ from the even output terminals Source2, Source4 . . . .

Figure 16:
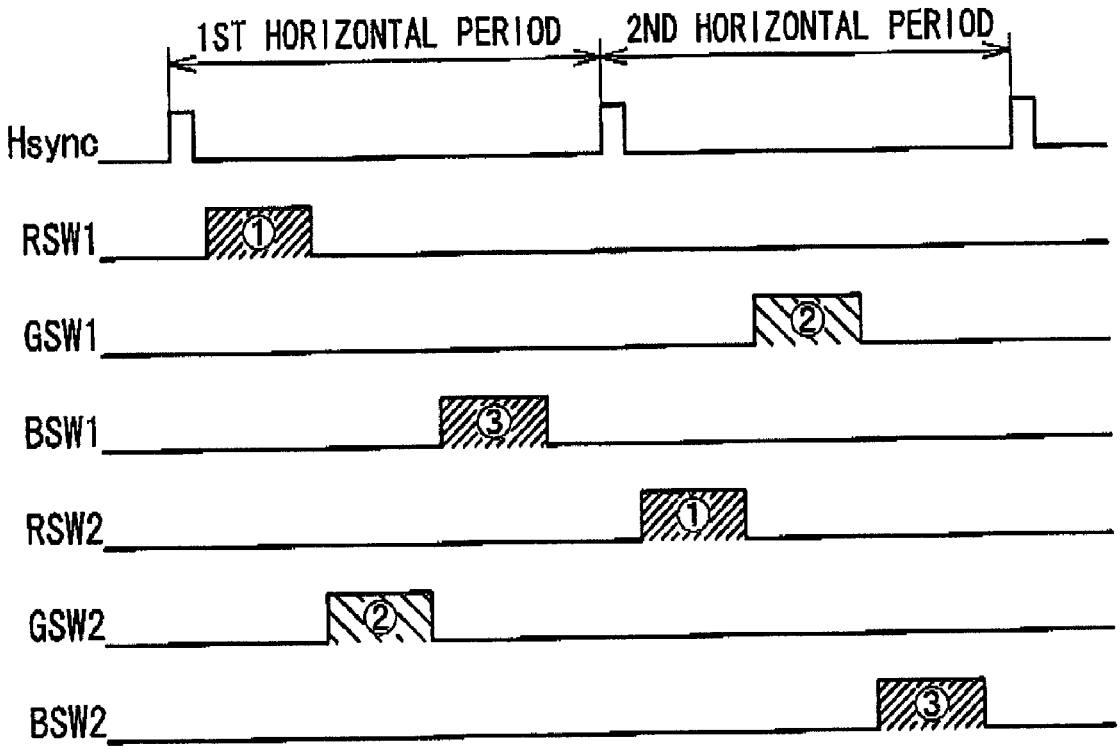
FIG. 16 is a timing chart illustrating an exemplary operation of the liquid crystal display device in the second embodiment.
Figure 17:
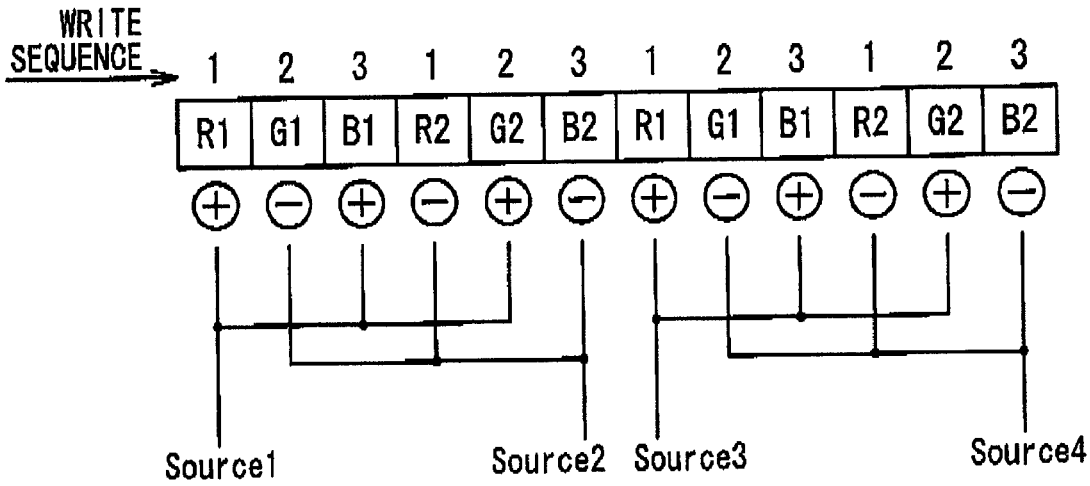
FIG. 17 is a diagram illustrating the write sequence of the pixels and the polarities of the data signals written into the respective pixels in the second embodiment.
Figure 17:
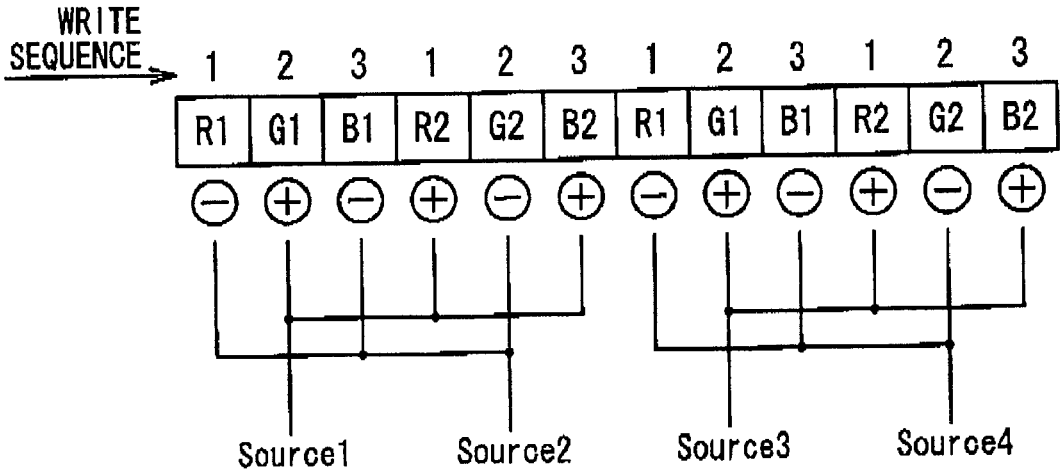

In synchronization of the outputs of these data signals, as shown in FIG. 16, the control signals RSW1, GSW2 and BSW1 are sequentially activated. In response to the activation of the control signal RSW1, the straight switches $\mathbf{19}_{R1}$ and $\mathbf{19}_{R2}$ are turned on, and thereby the data lines $\mathbf{12}_{R1}$ are connected to the odd input nodes $\mathbf{17}_O$ while the data lines $\mathbf{12}_{R2}$ are connected to the even input nodes $\mathbf{17}_E$. This results in that the positive data signals generated by the positive drive legs 23 are written into the R pixels $\mathbf{13}_{R1}$ through the data lines $\mathbf{12}_{R1}$, and the negative data signals generated by the negative drive legs 24 are written into the R pixels $\mathbf{13}_{R2}$ through the data lines $\mathbf{12}_{R2}$.

When the control signal GSW2 is then activated, the cross switches $\mathbf{20}_{G1}$ and $\mathbf{20}_{G2}$ are turned on, and thereby the data lines $\mathbf{20}_{G2}$ are connected to the odd input nodes $\mathbf{17}_{O}$, while the data lines $\mathbf{12}_{G1}$ are connected to the even input nodes $\mathbf{17}_{E}$. This results in that the positive data signals generated by the positive drive legs 23 are written into the G pixels $\mathbf{13}_{G2}$ through the data lines $\mathbf{12}_{G2}$, and the negative data signals generated by the negative drive legs 24 are written into the G pixels $\mathbf{13}_{G1}$ through the data lines $\mathbf{12}_{G1}$.

When the control signal BSW1 is then activated, the straight switches $\mathbf{19}_{B1}$ and $\mathbf{19}_{B2}$ are turned on, and thereby the data lines $\mathbf{12}_{B1}$ are connected to the odd input nodes $\mathbf{17}_{O}$, while the data lines $\mathbf{12}_{B2}$ are connected to the even input nodes $\mathbf{17}_{E}$. This results in that the positive data signals generated by the positive drive legs 23 are written into the B pixels $\mathbf{13}_{B1}$ through the data lines $\mathbf{12}_{B1}$, and the negative data signals generated by the negative drive legs 24 are written into the B pixels $\mathbf{13}_{B2}$ through the data lines $\mathbf{12}_{B2}$.

Referring back to FIG. 15, the gate line $\mathbf{11}_2$ is then activated to select the pixels 13 in the second line in the second horizontal period. The positive drive legs 23 within the LCD driver 2 then sequentially output positive data signals to be fed to the R pixels $\mathbf{13}_{R2}$, G pixels $\mathbf{13}_{G1}$ and B pixels $\mathbf{13}_{B2}$ from the odd output terminals Source1, Source3 . . . , while the negative drive legs 24 within the LCD driver 2 sequentially output negative data signals to be fed to the R pixels $\mathbf{13}_{R1}$, G pixels $\mathbf{13}_{G2}$ and B pixels $\mathbf{13}_{B1}$ from the even output terminals Source2, Source4 . . . .

In synchronization of the outputs of these data signals, as shown in FIG. 16, the control signals RSW2, GSW1 and BSW2 are sequentially activated. In response to the activation of the control signal RSW2, the cross switches $\mathbf{20}_{R1}$ and $\mathbf{20}_{R2}$ are turned on, and thereby the data lines $\mathbf{12}_{R2}$ are connected to the odd input nodes $\mathbf{17}_{O}$ while the data lines $\mathbf{12}_{R1}$ are connected to the even input nodes $\mathbf{17}_{E}$. This results in that the positive data signals generated by the positive drive legs 23 are written into the R pixels $\mathbf{13}_{R2}$ through the data lines $\mathbf{12}_{R2}$, and the negative data signals generated by the negative drive legs 24 are written into the R pixels $\mathbf{13}_{R1}$ through the data lines $\mathbf{12}_{R1}$.

When the control signal GSW1 is then activated, the straight switches $\mathbf{19}_{G1}$ and $\mathbf{19}_{G2}$ are turned on, and thereby the data lines $\mathbf{12}_{G1}$ are connected to the odd input nodes $\mathbf{17}_{O}$, while the data lines $\mathbf{12}_{G2}$ are connected to the even input nodes $\mathbf{17}_{E}$. This results in that the positive data signals generated by the positive drive legs 23 are written into the G pixels $\mathbf{13}_{G1}$ through the data lines $\mathbf{12}_{G1}$, and the negative data signals generated by the negative drive legs 24 are written into the G pixels $\mathbf{13}_{G2}$ through the data lines $\mathbf{12}_{G2}$.

When the control signal BSW2 is then activated, the cross switches $\mathbf{20}_{B1}$ and $\mathbf{20}_{B2}$ are turned on, and thereby the data lines $\mathbf{12}_{B2}$ are connected to the odd input nodes $\mathbf{17}_{O}$, while the data lines $\mathbf{12}_{B1}$ are connected to the even input nodes $\mathbf{17}_{E}$. This results in that the positive data signals generated by the positive drive legs 23 are written into the B pixels $\mathbf{13}_{B2}$ through the data lines $\mathbf{12}_{B2}$, and the negative data signals generated by the negative drive legs 24 are written into the B pixels $\mathbf{13}_{B1}$ through the data lines $\mathbf{12}_{B1}$.

Such operation eliminates the need for inverting the voltage levels on the odd input nodes $\mathbf{17}_{O}$ and the even input nodes 17E, which are positioned along the paths used to distribute the data signals, and thereby further reduces the power consumption of the LCD driver 2.

Third Embodiment

Figure 18:
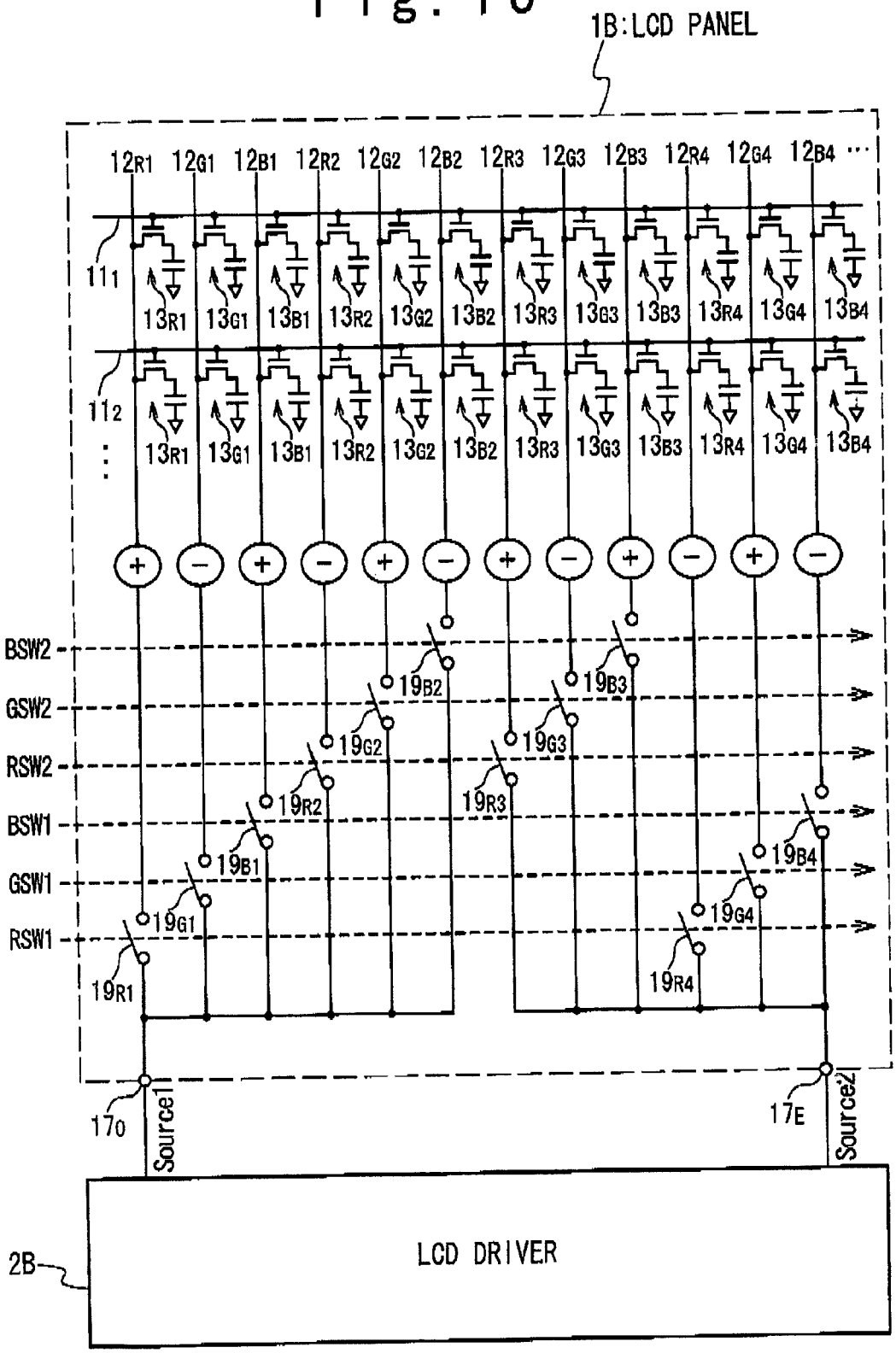
FIG. 18 is a diagram illustrating an exemplary structure of a liquid crystal display device in a third embodiment of the present invention.

FIG. 18 is a block diagram illustrating the structure of a liquid crystal display device in a third embodiment of the present invention. In the liquid crystal display device in the third embodiment, six data lines are provided for each input node; that is, a set of six data lines are time-divisionally driven in each horizontal period.

It should be noted that the prior art suggests that the dot inversion drive that writes data signals with opposite polarities into adjacent pixels is not compatible with a time-division drive in which an even number of data lines are time-divisionally driven in each horizontal period. This fact is supported by Japanese Laid-Open Patent Application No. JP-A Heisei 11-327518. Referring to FIG. 18, sequentially driving the data lines 17 connected to the same input node 17 from left to right as is implemented in the prior art undesirably results in feeding data signals with the same polarity to the odd input nodes $\mathbf{17}_{O}$ and the even input nodes $\mathbf{17}_{E}$. This causes the change in the common voltage level $V_{COM}$ and eliminates the advantage of the dot inversion drive. Japanese Laid-Open Patent Application No. JP-A Heisei 11-327518 discloses a technique in which 3″ data lines are time-divisionally driven in each horizontal period.

The inventor, however, has discovered that an optimization of the sequence of driving the pixels 13 allows achieving both of the dot inversion drive and the time-division drive in which an even number of data lines are time-divisionally driven in each horizontal period, while effectively reduces the number of times of inversion of the polarities of the data signals generated on the LCD driver. The liquid crystal display device in the third embodiment is based on this discovery.

Specifically, the liquid crystal display device in the third embodiment is provided with an LCD panel 1B and an LCD driver 2B. The LCD panel 1B is provided with gate lines $\mathbf{11}_1$, $\mathbf{11}_2$ . . . , data lines $\mathbf{12}_{R1}$ to $\mathbf{12}_{R4}$, $\mathbf{12}_{G1}$ to $\mathbf{12}_{G4}$, $\mathbf{12}_{B1}$ to $\mathbf{12}_{B4}$, R pixels $\mathbf{13}_{R1}$ to $\mathbf{13}_{R4}$, G pixels $\mathbf{13}_{G1}$ to $\mathbf{13}_{G4}$ and B pixels $\mathbf{13}_{B1}$ to $\mathbf{13}_{B4}$. The R pixels $\mathbf{13}_{R1}$ to $\mathbf{13}_{R4}$ are connected to the data lines $\mathbf{12}_{R1}$ to $\mathbf{12}_{R4}$, respectively. Correspondingly, the G pixels $\mathbf{13}_{G1}$ to $\mathbf{13}_{G4}$ are connected to the data lines $\mathbf{12}_{G1}$ to $\mathbf{12}_{G4}$, respectively, and the B pixels $\mathbf{13}_{B1}$ to $\mathbf{13}_{B4}$ are connected to the data lines $\mathbf{12}_{B1}$ to $\mathbf{12}_{B4}$, respectively.

The data lines $\mathbf{12}_{R1}$, $\mathbf{12}_{G1}$, $\mathbf{12}_{B1}$, $\mathbf{12}_{R2}$, $\mathbf{12}_{G2}$ and $\mathbf{12}_{B2}$ are spatially arranged within the LCD panel 1B in this order, and connected to the odd input nodes $\mathbf{17}_{O}$ through the switches $\mathbf{19}_{R1}$, $\mathbf{19}_{G1}$ $\mathbf{19}_{B1}$, $\mathbf{19}_{R2}$, $\mathbf{19}_{G2}$ and $\mathbf{19}_{B2}$, respectively. The switches $\mathbf{19}_{R1}$, $\mathbf{19}_{G1}$ $\mathbf{19}_{B1}$, $\mathbf{19}_{R2}$, $\mathbf{19}_{G2}$ and $\mathbf{19}_{B2}$ are turned on and off, in response to the control signals RSW1, GSW1, BSW1, RSW2, GSW2 and BSW2, respectively.

Correspondingly, the data lines $\mathbf{12}_{R3}$, $\mathbf{12}_{G3}$, $\mathbf{12}_{B3}$, $\mathbf{12}_{R4}$, $\mathbf{12}_{G4}$ and $\mathbf{12}_{B4}$ are spatially arranged within the LCD panel 1B in this order, and connected to the even input nodes $\mathbf{17}_{E}$ through the switches $\mathbf{19}_{R3}$, $\mathbf{19}_{G3}$ $\mathbf{19}_{B3}$, $\mathbf{19}_{R4}$, $\mathbf{19}_{G4}$ and $\mathbf{19}_{B4}$, respectively. The switches $\mathbf{19}_{R3}$, $\mathbf{19}_{G3}$ and $\mathbf{19}_{B3}$, which are connected to the data lines $\mathbf{12}_{R3}$, $\mathbf{12}_{G3}$ and $\mathbf{12}_{B3}$ positioned at the relatively left positions, are turned on and off in response to the control signals RSW2, GSW2 and BSW2, while the switches $\mathbf{19}_{R4}$, $\mathbf{19}_{G4}$ and $\mathbf{19}_{B4}$, which are connected to the data lines $\mathbf{12}_{R4}$, $\mathbf{12}_{G4}$ and $\mathbf{12}_{B4}$ positioned at the relatively right positions, are turned on and off in response to the control signals RSW1, GSW1 and BSW1.

It should be noted that the association of the switches $\mathbf{19}_{R1}$, $\mathbf{19}_{G1}$ $\mathbf{19}_{B1}$, $\mathbf{19}_{R2}$, $\mathbf{19}_{G2}$ and $\mathbf{19}_{B2}$ with the control signals RSW1, GSW1, BSW1, RSW2, GSW2 and BSW2 is completely different from the association of the switches $\mathbf{19}_{R3}$, $\mathbf{19}_{G3}$ $\mathbf{19}_{B3}$, $\mathbf{19}_{R4}$, $\mathbf{19}_{G4}$ and $\mathbf{19}_{B4}$ with the control signals RSW1, GSW1, BSW1, RSW2, GSW2 and BSW2. For example, when the control signals RSW1, GSW1, BSW1, RSW2, GSW2 and BSW2 are activated in this order, the data lines $12_{R1}$, $12_{G1}$, $12_{B1}$, $12_{R2}$, $12_{G2}$ and $12_{B2}$ are selected from the left, while this does not apply to the data lines $12_{R3}$, $12_{G3}$, $12_{B3}$, $12_{R4}$, $12_{G4}$ and $12_{B4}$; the data lines $12_{R3}$, $12_{G3}$, $12_{B3}$, $12_{R4}$, $12_{G4}$ and $12_{B4}$ are selected in this order of data lines $12_{R4}$, $12_{G4}$, $12_{B4}$, $12_{R3}$, $12_{G3}$, and $12_{B3}$.

Figure 19A:
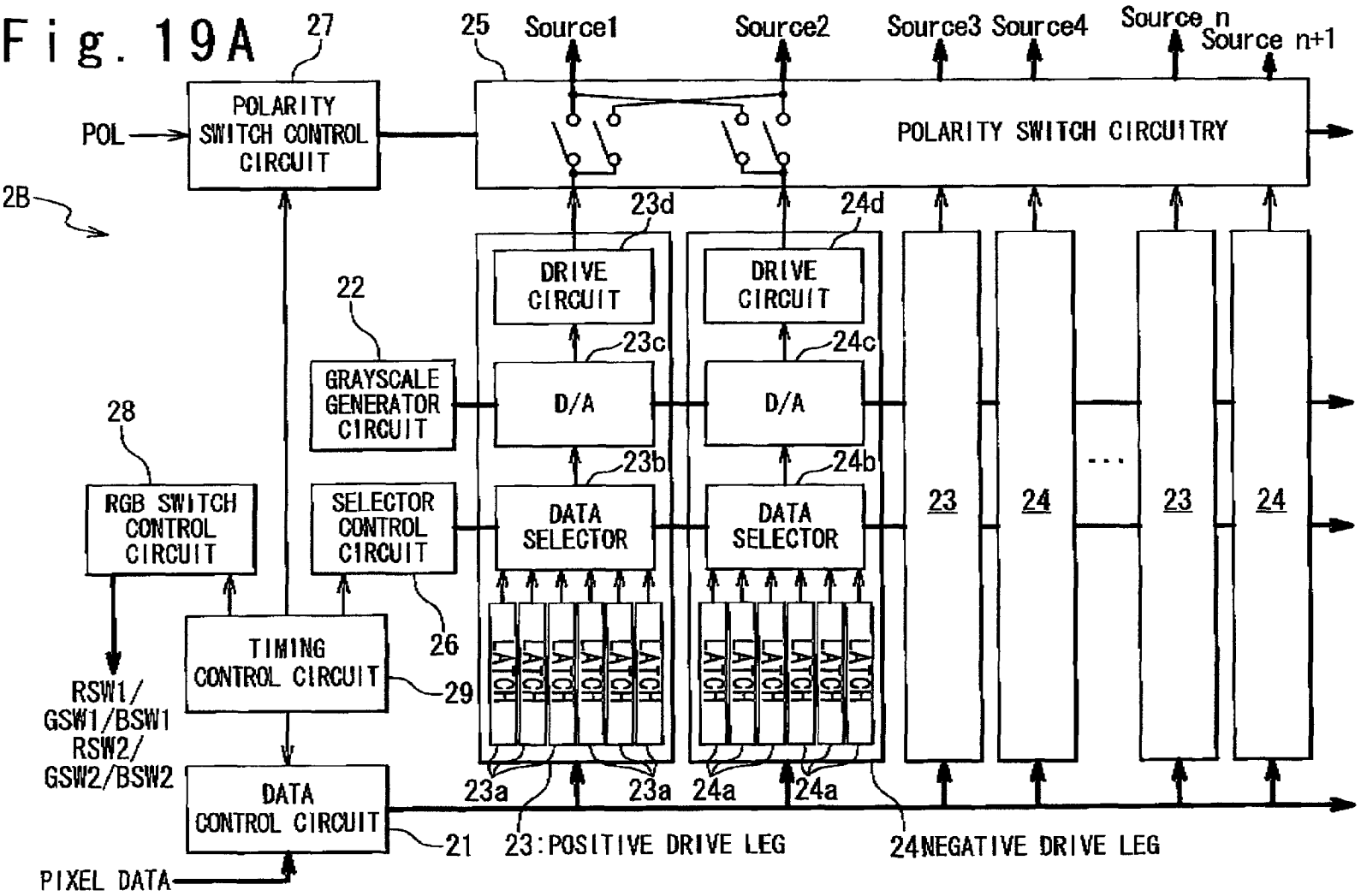
FIG. 19A is a block diagram illustrating an exemplary structure of an LCD driver in the third embodiment.

FIG. 19A is a block diagram illustrating the structure of the LCD driver 2B. The structure of the LCD driver 2B is almost identical to that of the LCD driver 2 shown in FIG. 7, except for the fact that, in the LCD driver 2B, the RGB switch control circuit 28 generates the six control signals RSW1, GSW1, BSW1, RSW2, GSW2 and BSW2, and each of the positive and negative drive legs 23 and 24 includes six latch circuits 23*a* and 24*a*.

Figure 20:
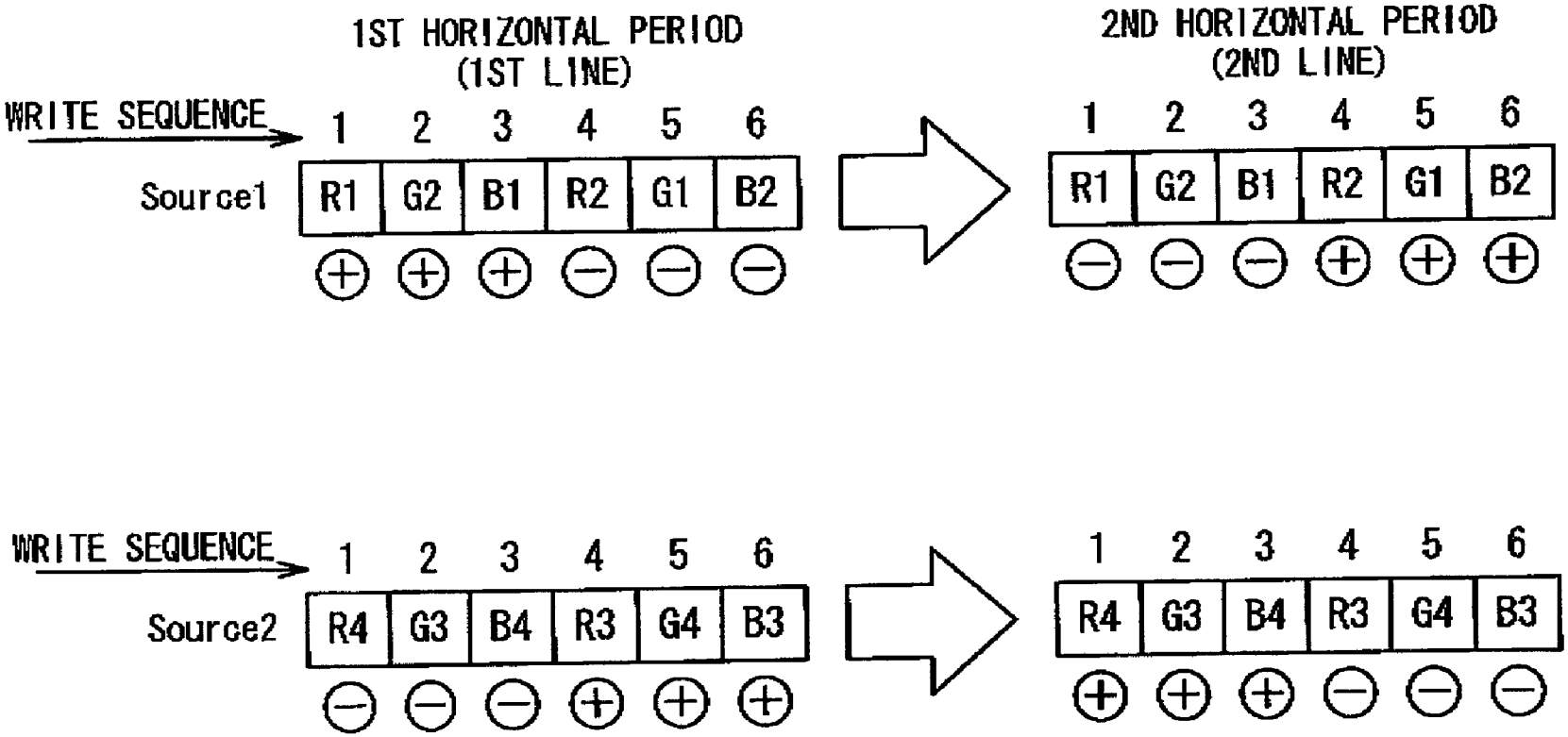
FIG. 20 is a block diagram illustrating pixels into which data signals outputted from respective output terminals of the LCD driver are written, and the polarities of the respective data signals, in the third embodiment.

FIGS. 20, 21A, 21B, 22A and 22B are diagrams illustrating the operation of the liquid crystal display device in the third embodiment. In the first horizontal period, as shown in FIG. 20, the LCD driver 2B sequentially outputs positive data signals to be fed to the R pixels $13_{R1}$, the G pixels $13_{G2}$ and the B pixels $13_{B1}$ in the first line from the odd output terminals Source1, Source3 . . . , and then sequentially outputs negative data signals to be fed to the R pixels $13_{R2}$, the G pixels $13_{G1}$ and the B pixels $13_{B2}$ in the first line from the odd output terminals Source1, Source3 . . . . Concurrently, the LCD driver 2B sequentially outputs negative data signals to be fed to the R pixels $13_{R4}$, the G pixels $13_{G3}$ and the B pixels $13_{B4}$ in the first line from the even output terminals Source2, Source4 . . . , and then sequentially outputs positive data signals to be fed to the R pixels $13_{R3}$, the G pixels $13_{G4}$ and the B pixels $13_{B3}$ in the first line from the even output terminals Source2, Source4 . . . . It should be noted that the polarities of the data signals developed on the odd output terminals Source1, Source3 . . . are always opposite to those of the data signals developed on the even output terminals Source2, Source4 . . . .

Figure 21A:
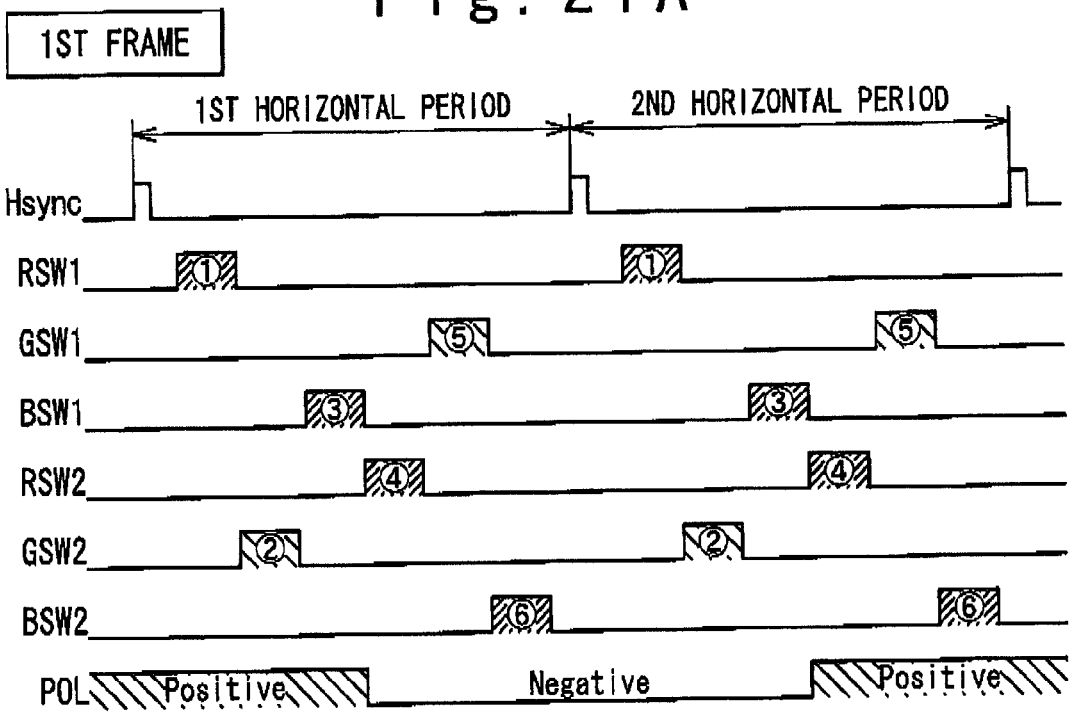
FIG. 21A is a timing chart illustrating the operation of the liquid crystal display device in the first frame period in the third embodiment.
Figure 21B:
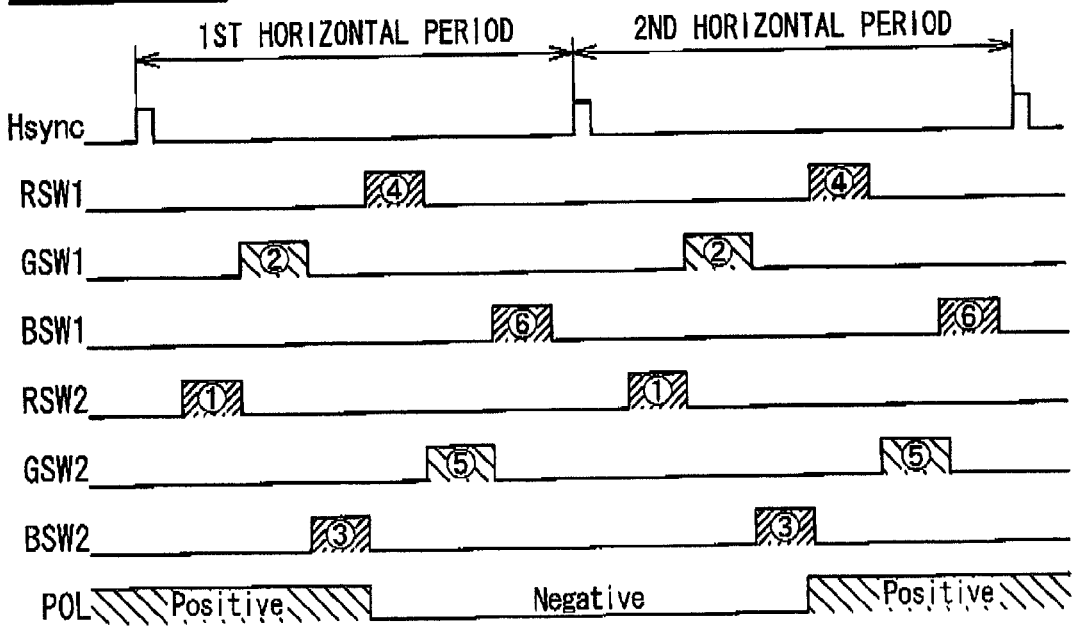
FIG. 21B is a timing chart illustrating the exemplary operation of the liquid crystal display device in the third frame period in the third embodiment.

The write operation into the pixels 13 with such write sequence can be achieved by activating the control signals RSW1, GSW2, BSW1, RSW2, GSW1 and BSW2 in this order after the first horizontal period is initiated, as shown in FIG. 21A. The polarity signal POL is inverted when the control signal RSW2 is activated. It should be noted that the voltage levels of the respective output terminals of the LCD driver 2B are inverted in the first horizontal period, only when the data signals are written into the R pixels $13_{R2}$ and $13_{R3}$.

In the second horizontal period, data signals are outputted in the same sequence with the polarities of the data signals inverted. Specifically, in the second horizontal period, the LCD driver 2B sequentially outputs negative data signals to be fed to the R pixels $13_{R1}$, the G pixels $13_{G2}$ and the B pixels $13_{B1}$ in the second line from the odd output terminals Source1, Source3 . . . , and then sequentially outputs positive data signals to be fed to the R pixels $13_{R2}$, the G pixels $13_{G1}$ and the B pixels $13_{B2}$ from the odd output terminals Source1, Source3 . . . , as shown in FIG. 20. Concurrently, the LCD driver 2B sequentially outputs positive data signals to be fed to the R pixels $13_{R4}$, the G pixels $13_{G3}$ and the B pixels $13_{B4}$ in the second line from the even output terminals Source2, Source4 . . . , and then sequentially outputs negative data signals to be fed to the R pixels $13_{R3}$, the G pixels $13_{G4}$ and the B pixels $13_{B3}$ from the even output terminals Source2, Source4 . . . .

The write operation into the pixels 13 with such write sequence can be achieved by activating the control signals RSW1, GSW2, BSW1, RSW2, GSW1 and BSW2 in this order after the first horizontal period is initiated, as shown in FIG. 21A. The polarity signal POL is inverted when the control signal RSW2 is activated. It should be noted that the voltage levels of the respective output terminals of the LCD driver 2B are also inverted in the second horizontal period, only when the data signals are written into the R pixels $13_{R2}$ and $13_{R3}$.

The pixels 13 are driven in the similar procedure in the following horizontal periods. The pixels 13 in the odd-numbered lines are driven in the odd-numbered horizontal periods, in the same manner as the first horizontal period, and the pixels 13 in the even-numbered lines are driven in the even-numbered horizontal periods, in the same manner as the second horizontal period.

The operation above-described requires inverting the polarities of the data signals developed on the respective output terminals of the LCD driver 2 only once in each horizontal period. This effectively reduces the power consumption of the LCD driver 2.

Figure 22A:
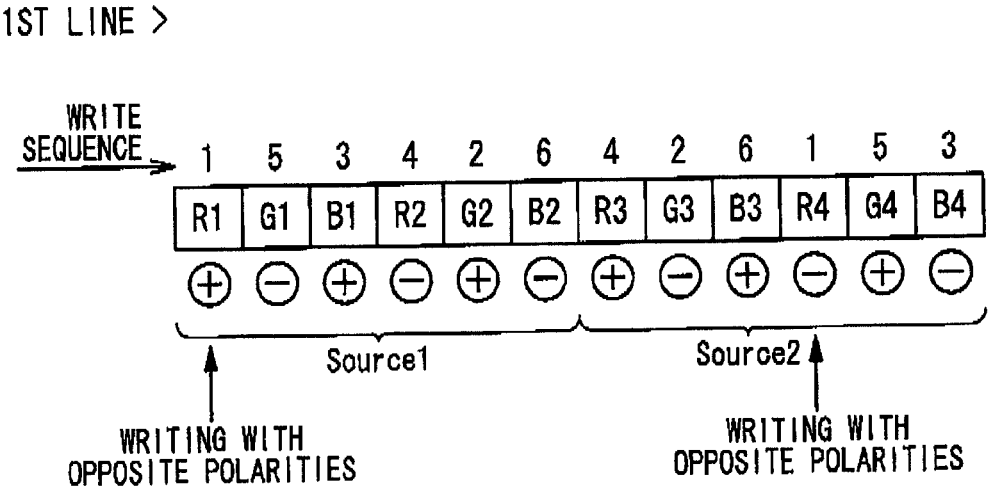
FIG. 22A is a diagram illustrating the write sequence of the pixels in the first line and the polarities of the data signals written into the respective pixels in the third embodiment.
Figure 22B:
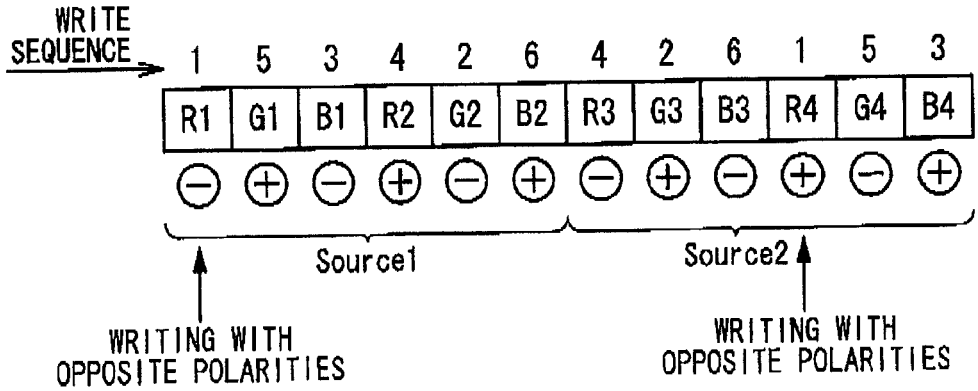
FIG. 22B is a diagram illustrating the write sequence of the pixels in the second line and the polarities of the data signals written into the respective pixels in the third embodiment.

Additionally, as is understood from FIGS. 22A and 22B, the operation above-described achieves the dot inversion drive, in which data signals with opposite polarities are written into adjacent pixels 13. FIG. 22A illustrates the write sequence of the pixels 13 and the polarities of the data signals written into the respective pixels 13, when the pixels 13 are driven in the procedure shown in FIG. 20. With respect to the pixels 13 in the first line, positive data signals are written into the pixels $13_{R1}$, $13_{B1}$, $13_{G2}$, $13_{R3}$, $13_{B3}$, and $13_{G4}$, which are positioned at the odd-numbered positions, while negative data signals are written into the pixels $13_{G1}$, $13_{R2}$, $13_{B2}$, $13_{G3}$, $13_{R4}$ and $13_{B4}$, which are positioned at the even-numbered positions. With respect to the pixels 13 in the second line, on the other hand, negative data signals are written into the pixels $13_{R1}$, $13_{B1}$, $13_{G2}$, $13_{R3}$, $13_{B3}$, and $13_{G4}$, which are positioned at the odd-numbered positions, while positive data signals are written into the pixels $13_{G1}$, $13_{R2}$, $13_{B2}$, $13_{G3}$, $13_{R4}$ and $13_{B4}$, which are positioned at the even-numbered positions. As thus described, the polarities of data signals written into adjacent pixels 13 are opposite with respect to both of the horizontal and vertical directions.

Figure 23:
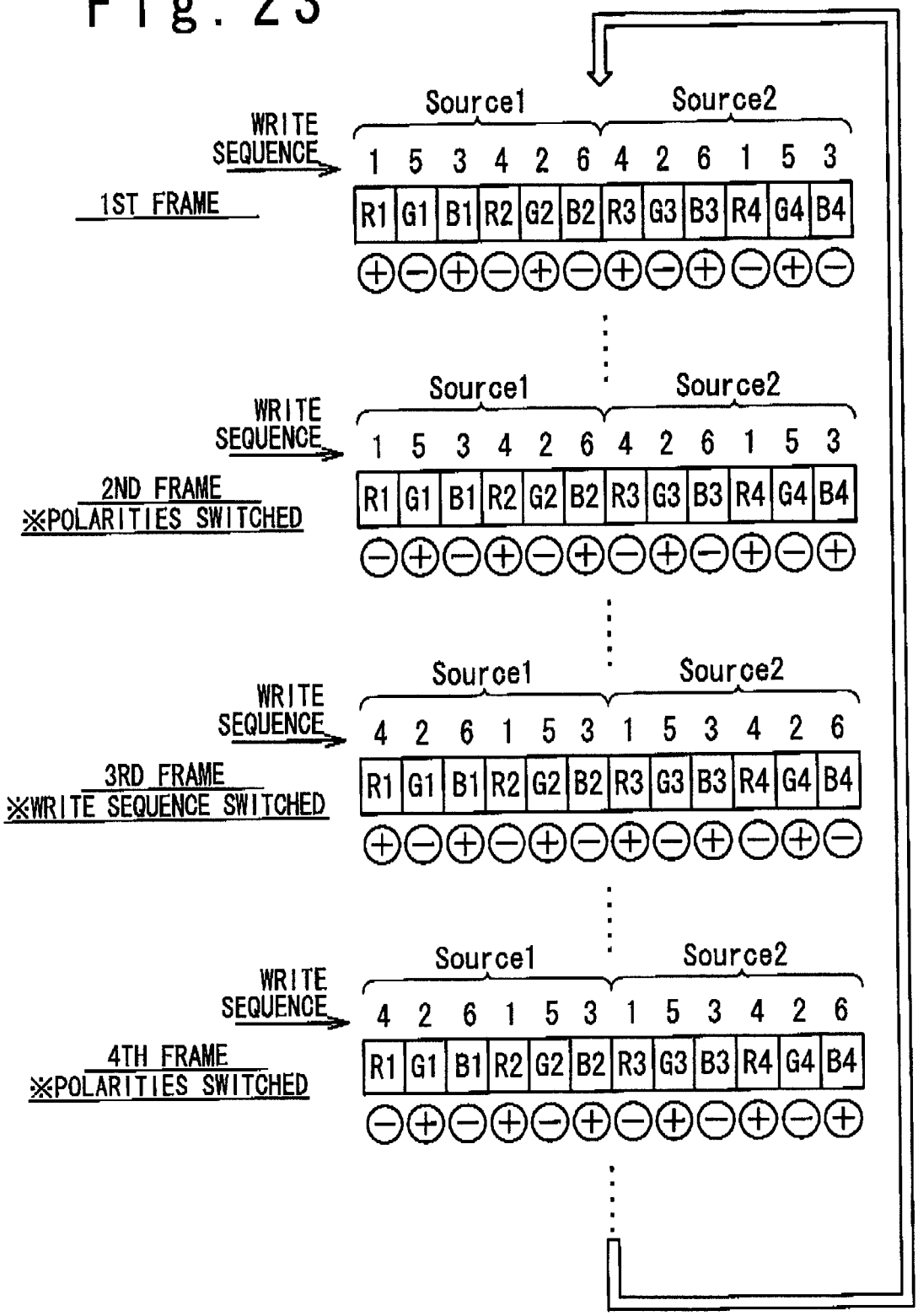
FIG. 23 is a diagram illustrating the write sequence of the pixels and the polarities of the data signals written into the respective pixels in the first to fourth frame periods in the third embodiment.

In order to further improve the image quality, it is desirable that the polarities of the data signals and the write sequence are switched at a predetermined time cycle, as shown in FIG. 23. In the embodiment shown in FIG. 23 the polarities of the data signals and the write sequences are switched at a time cycle of four frame periods. In detail, the polarities of data signals written into the respective pixels 13 are switched every frame period, and the write sequence of the pixels 13 is switched every two frame periods.

Periodically switching the write sequence of the pixels 13 effectively deals with the deterioration of the image quality due to the change in the write voltages held in the respective pixels 13 due to the leakage of the switches 19. Thin film transistors used as the switches 19 are required to have a large drive capacity in order to drive the data lines 12, which have a long length and a large capacity. Therefore, the thin film transistors used as the switches 19 are designed to have a large gate width, a reduced gate length and on-resistance. However, such designed thin film transistors inevitably suffer from large leak current. Therefore, the charges accumulated in the respective pixels 13 are leaked through the switches 19 during the write operation, and thereby the write voltages held in the pixels 13 are undesirably changed. Since pixels 13 driven earlier suffer from a larger change in the write voltages, the changes in the write voltages held in the pixels 13 are visually recognized as vertical segments of unevenness, that is, visually perceivable segments extending in the vertical direction (the direction of the data lines 12). Periodically switching the write sequence of the pixels 13 temporally and spatially disperses the pixels 13 suffering from the undesirable changes in the write voltages, and thereby effectively reduces the vertical segments of unevenness.

Specifically, the pixels 13 are driven in the procedure described above in the first frame period. In the odd-numbered horizontal periods in the first frame period, the LCD driver 2B sequentially outputs positive data signals to be fed to the R pixels $\mathbf{13}_{R1}$, the G pixels $\mathbf{13}_{G2}$ and the B pixels $\mathbf{13}_{B1}$ from the odd output terminals Source1, Source3 . . . , and then sequentially outputs negative data signals to be fed to the R pixels $\mathbf{13}_{R2}$, the G pixels $\mathbf{13}_{G1}$ and the B pixels $\mathbf{13}_{B2}$ from the odd output terminals Source1, Source3 . . . . concurrently, the LCD driver 2B sequentially outputs negative data signals to be fed to the R pixels $\mathbf{13}_{R4}$, the G pixels $\mathbf{13}_{G3}$ and B pixels $\mathbf{13}_{B4}$ from the even output terminals Source2, Source4 . . . , and then sequentially outputs positive data signals to be fed to the R pixels $\mathbf{13}_{R3}$, the G pixels $\mathbf{13}_{G4}$ and B pixels $\mathbf{13}_{B3}$ from the even output terminals Source2, Source4 . . . . In the even-numbered horizontal periods, the pixels 13 are driven in the similar procedure with the polarities of the data signals inverted. It should be noted that only the drive procedure of pixels 13 in the odd-numbered horizontal periods is illustrated in FIG. 23.

In the second frame period, the pixels 13 are driven in the similar manner with the polarities of the data signals fed to the respective pixels 13 inverted. In the odd-horizontal periods in the second frame period, the LCD driver 2B sequentially outputs negative data signals to be fed to the R pixels $\mathbf{13}_{R1}$, the G pixels $\mathbf{13}_{G2}$ and the B pixels $\mathbf{13}_{B1}$ from the odd output terminals Source1, Source3 . . . , and then sequentially outputs positive data signals to be fed to the R pixels $\mathbf{13}_{R2}$, the G pixels $\mathbf{13}_{G1}$ and the B pixels $\mathbf{13}_{B2}$ from the odd output terminals Source1, Source3 . . . . Concurrently, the LCD driver 2B sequentially outputs positive data signals to be fed to the R pixels $\mathbf{13}_{R4}$, the G pixels $\mathbf{13}_{G3}$ and B pixels $\mathbf{13}_{B4}$ from the even output terminals Source2, Source4 . . . , and then sequentially outputs negative data signals to be fed to the R pixels $\mathbf{13}_{R3}$, the G pixels $\mathbf{13}_{G4}$ and B pixels $\mathbf{13}_{B3}$ from the even output terminals Source2, Source4 . . . . In the even-numbered horizontal periods, the pixels 13 are driven in the similar procedure with the polarities of the data signals inverted.

In the third frame period, the polarities of the data signals fed to the respective pixels 13 are inverted (that is, the respective pixels 13 are driven with the data signals with the same polarity as the first frame period), and the write sequence of the pixels 13 is additionally switched. Specifically, in the odd-horizontal periods in the third frame period, the LCD driver 2B sequentially outputs negative data signals to be fed to the R pixels $\mathbf{13}_{R2}$, the G pixels $\mathbf{13}_{G1}$ and the B pixels $\mathbf{13}_{B2}$ from the odd output terminals Source1, Source3 . . . , and then sequentially outputs positive data signals to be fed to the R pixels $\mathbf{13}_{R1}$, the G pixels $\mathbf{13}_{G2}$ and the B pixels $\mathbf{13}_{B1}$ from the odd output terminals Source1, Source3 . . . . Concurrently, the LCD driver 2B sequentially outputs positive data signals to be fed to the R pixels $\mathbf{13}_{R3}$, the G pixels $\mathbf{13}_{G4}$ and B pixels $\mathbf{13}_{B3}$ from the even output terminals Source2, Source4 . . . , and then sequentially outputs negative data signals to be fed to the R pixels $\mathbf{13}_{R4}$, the G pixels $\mathbf{13}_{G3}$ and B pixels $\mathbf{13}_{B4}$ from the even output terminals Source2, Source4 . . . . In the even-numbered horizontal periods, the pixels 13 are driven in the similar procedure with the polarities of the data signals inverted. The write operation of the data signals into the pixels 13 with such write sequence can be achieved by activating the control signals RSW2, GSW1, BSW2, RSW1, GSW2 and BSW1 in this order in each horizontal period. The polarity signal POL is inverted when the control signal RSW1 is activated. It should be noted that only the drive procedure of the pixels 13 in the odd-numbered horizontal periods is illustrated in FIG. 23.

In the fourth frame period, the pixels 13 are driven in the similar manner with the polarities of the data signals fed to the respective pixels 13 inverted. Specifically, in the odd-horizontal periods in the fourth frame period, the LCD driver 2B sequentially outputs positive data signals to be fed to the R pixels $\mathbf{13}_{R2}$, the G pixels $\mathbf{13}_{G1}$ and the B pixels $\mathbf{13}_{B2}$ from the odd output terminals Source1, Source3 . . . , and then sequentially outputs negative data signals to be fed to the R pixels $\mathbf{13}_{R1}$, the G pixels $\mathbf{13}_{G2}$ and the B pixels $\mathbf{13}_{B1}$ from the odd output terminals Source1, Source3 . . . . Concurrently, the LCD driver 28 sequentially outputs negative data signals to be fed to the R pixels $\mathbf{13}_{R3}$, the G pixels $\mathbf{13}_{G4}$ and B pixels $\mathbf{13}_{B3}$ from the even output terminals Source2, Source4 . . . , and then sequentially outputs positive data signals to be fed to the R pixels $\mathbf{13}_{R4}$, the G pixels $\mathbf{13}_{G3}$ and B pixels $\mathbf{13}_{B4}$ from the even output terminals Source2, Source4 . . . . In the even-numbered horizontal periods, the pixels 13 are driven in the similar procedure with the polarities of the data signals inverted. The operations implemented in the first to fourth frame periods are repeated in the following frame periods.

As thus described, the image quality of the liquid crystal display device is effectively improved through periodically switching the polarities of the data signals and the write sequence.

Fourth Embodiment

FIGS. 24, 25A, 25B, 26A and 26B illustrate the operation of the liquid crystal display device in a fourth embodiment of the present invention. It should be noted that the structure of the liquid crystal display device in the fourth embodiment is identical to that of the liquid crystal display device shown in FIGS. 18 and 19.

The liquid crystal display device in the fourth embodiment is directed to the vertical segments of unevenness caused by the change in the write voltages held in the pixels 13 resulting from the leakage of the switches 19. As described above, pixels 13 that are driven with data signals earlier suffer from larger change in the write voltages. When data signals are written into the pixels $\mathbf{13}_{R1}$, $\mathbf{13}_{G1}$, $\mathbf{13}_{B1}$, $\mathbf{13}_{R2}$, $\mathbf{13}_{G2}$ and $\mathbf{13}_{B2}$ in this order, for example, the pixels $\mathbf{13}_{R1}$ suffer from the largest change in the write voltages, while the pixels $\mathbf{13}_{B2}$ suffer from the smallest change in the write voltages.

This implies that the degrees of the changes in the write voltages held in two pixels 13 are largely different, when the timings at which the data signals are written into the two pixels 13 are largely different. With respect to the above-described example, the degrees of the changes in the write voltages held in the pixels $\mathbf{13}_{R1}$ and $\mathbf{13}_{G1}$ are close, while the degrees of the changes in the write voltages held in the pixels $\mathbf{13}_{R1}$ and $\mathbf{13}_{B1}$ are largely different.

The most serious case is where the degrees of the changes in the write voltages are largely different between the pixels displaying the same color. This is because the changes in the write voltages held in the pixels displaying the same color are easily perceived by the human eyes as unevenness on the screen. For example, the difference of the changes in the write voltages between the R pixels and G pixels can be hardly perceived by the human eyes, although it may cause slight deterioration of the color reproducibility. However, the difference of the changes in the write voltages between the R pixels $\mathbf{13}_{R1}$ and $\mathbf{13}_{R2}$ is easily perceived by the human eyes as the vertical segments of unevenness.

The operation of the liquid crystal display device in the fourth embodiment is directed to reduce the vertical segments of unevenness caused by the difference of the changes in the write voltages between the pixels displaying the same color through successively writing the data signals into the pixels 13 displaying the same color, while reducing the number of times of the inversion of the polarities of the data signals developed on the output terminals of the LCD driver 2.

Figure 24:
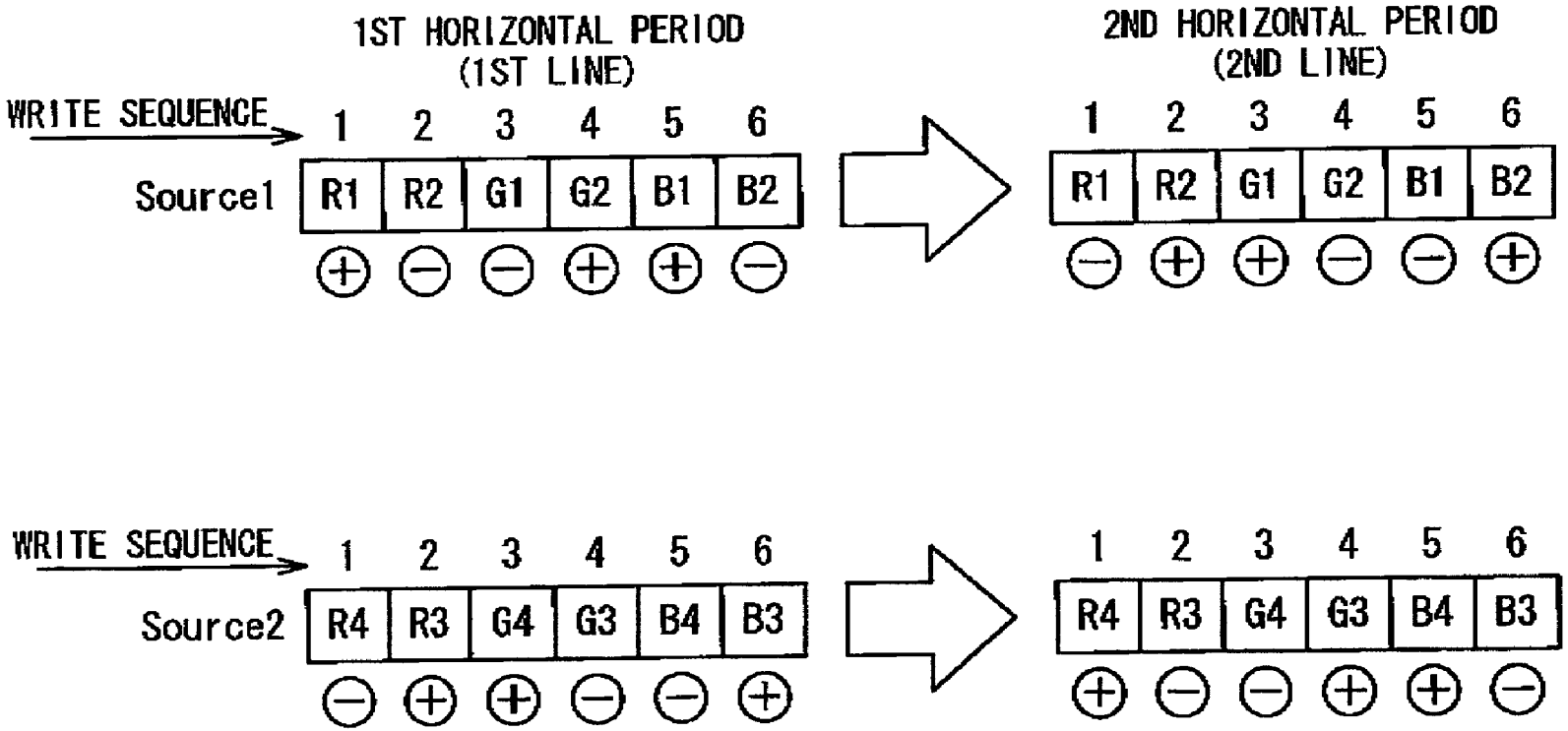
FIG. 24 is a diagram illustrating pixels into which data signals outputted from respective output terminals of the LCD driver are written, and the polarities of the respective data signals, in the fourth embodiment.

Specifically, data signals are driven into the respective pixels 13 in the procedure described in the following: Referring to FIG. 24, in the first horizontal period, the LCD driver 2B outputs positive data signals to be fed to the R pixels $\mathbf{13}_{R1}$ in the first line from the odd output terminals Source1, Source3 . . . , and then sequentially outputs the negative data signals to be fed to the R pixels $\mathbf{13}_{R2}$ and the G pixels $\mathbf{13}_{G1}$ from the odd output terminals Source1, Source3 . . . . It should be noted that the data signals are written into the R pixels $\mathbf{13}_{R1}$ and $\mathbf{13}_{R2}$, successively. Next, the LCD driver 2B successively outputs positive data signals to be fed to the G pixels $\mathbf{13}_{G2}$ and the B pixels $\mathbf{13}_{B1}$ from the odd output terminals Source1, Source3 . . . , and then outputs negative data signals to be fed to the B pixels $\mathbf{13}_{B2}$ from the odd output terminals Source1, Source3 . . . . It should be noted that data signals are written into the G pixels $\mathbf{13}_{G1}$ and $\mathbf{13}_{G2}$, successively, and then data signals are written into the B pixels $\mathbf{13}_{B1}$ and $\mathbf{13}_{B2}$, successively.

Concurrently, the LCD driver 2B outputs negative data signals to be fed to the R pixels $\mathbf{13}_{R4}$ from the even output terminals Source2, Source4, and then sequentially outputs the positive data signals to be fed to the R pixels $\mathbf{13}_{R3}$ and the G pixels $\mathbf{13}_{G4}$ from the even output terminals Source2, Source4. It should be noted that data signals are written into the R pixels $\mathbf{13}_{R4}$ and $\mathbf{13}_{R3}$, successively. Next, the LCD driver 2B successively outputs negative data signals to be fed to the G pixels $\mathbf{13}_{G3}$ and the B pixels $\mathbf{13}_{B4}$ from the even output terminals Source2, Source4 . . . , and then outputs positive data signals to be fed to the B pixels $\mathbf{13}_{B3}$ from the even output terminals Source2, Source4 . . . . It should be noted that data signals are written into the G pixels $\mathbf{13}_{G4}$ and $\mathbf{13}_{G3}$, successively, and then data signals are written into the B pixels $\mathbf{13}_{B4}$ and $\mathbf{13}_{B3}$, successively.

Figure 25A:
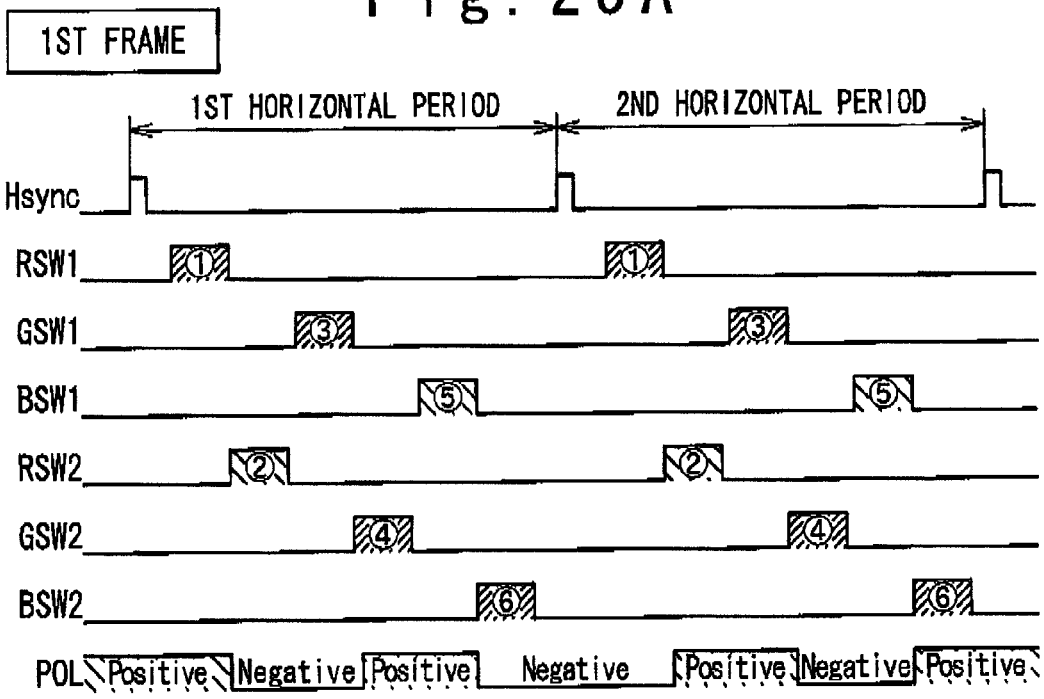
FIG. 25A is a timing chart illustrating the operation of the LCD driver in the first frame period in the fourth embodiment.

The write operation into the pixels 13 with such write sequence can be achieved by activating the control signals RSW1, RSW2, GSW1, GSW2, BSW1 and BSW2 in this order after the first horizontal period is initiated, as shown in FIG. 25A. The polarity signal POL is inverted when the control signal RSW2, GSW2 and BSW2 are activated. It should be noted that the voltage levels of the respective output terminals of the LCD driver 2B are inverted only three times in the first horizontal period, although the data signals are written into the pixels 13 six times.

In the second horizontal period, the pixels 13 are driven in the similar procedure with the polarities of the data signals inverted. In the second horizontal period, as shown in FIG. 24, the LCD driver 2B outputs negative data signals to be fed to the R pixels $\mathbf{13}_{R1}$ from the odd output terminals Source1, Source3 . . . , and then sequentially outputs the positive data signals to be fed to the R pixels $\mathbf{13}_{R2}$ and the G pixels $\mathbf{13}_{G1}$ from the odd output terminals Source1, Source3 . . . . Next, the LCD driver 2B successively outputs negative data signals to be fed to the G pixels $\mathbf{13}_{G2}$ and the B pixels $\mathbf{13}_{B1}$ from the odd output terminals Source1, Source3 . . . , and then outputs positive data signals to be fed to the B pixels $\mathbf{13}_{B2}$ from the odd output terminals Source1, Source3 . . . .

Concurrently, the LCD driver 2B outputs positive data signals to be fed to the R pixels $\mathbf{13}_{R4}$ from the even output terminals Source2, Source4 . . . , and then sequentially outputs the negative data signals to be fed to the R pixels $\mathbf{13}_{R3}$ and the G pixels $\mathbf{13}_{G4}$ from the even output terminals Source2, Source4 . . . . Next, the LCD driver 2B successively outputs positive data signals to be fed to the G pixels $\mathbf{13}_{G3}$ and the B pixels $\mathbf{13}_{B4}$ from the even output terminals Source2, Source4 . . . , and then outputs negative data signals to be fed to the B pixels $\mathbf{13}_{B3}$ from the even output terminals Source2, Source4 . . . .

The write operation into the pixels 13 with such write sequence can be achieved by activating the control signals RSW1, RSW2, GSW1, GSW2, BSW1 and BSW2 in this order after the first horizontal period is initiated, as shown in FIG. 25A. The polarity signal POL is inverted when the control signal RSW2, GSW2 and BSW2 are activated. It should be noted that the voltage levels of the respective output terminals of the LCD driver 2B are inverted only three times also in the second horizontal period.

The pixels 13 are driven in the same manner in the following horizontal periods. In the odd-numbered horizontal periods, the pixels 13 in the odd-numbered lines are driven in the same manner as the first horizontal period, while the pixels 13 in the even-numbered lines are driven in the same manner as the second horizontal period.

Figure 26A:
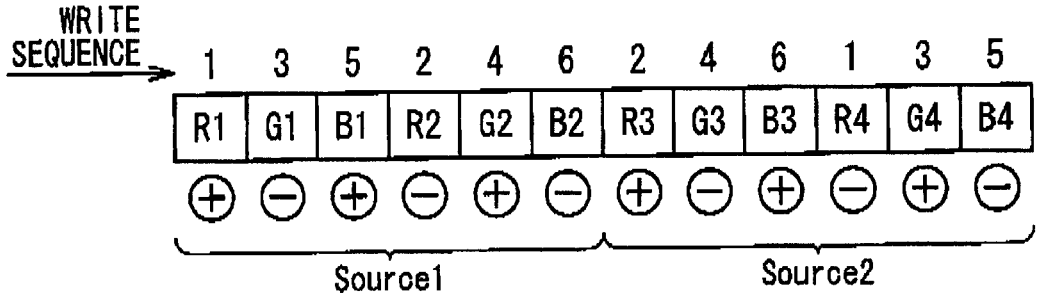
FIG. 26A is a diagram illustrating the write sequence of the pixels in the first line and the polarities of the data signals written into the respective pixels in the fourth embodiment.
Figure 26B:
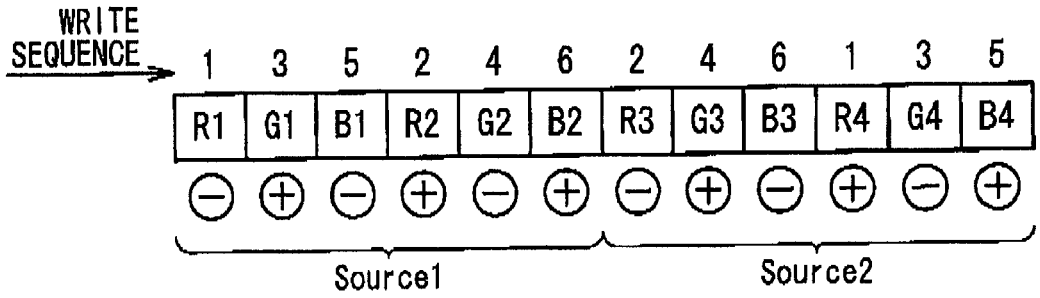
FIG. 26B is a diagram illustrating the write sequence of the pixels in the second line and the polarities of the data signals written into the respective pixels in the fourth embodiment.

It should be noted that such operation achieves the dot inversion drive, in which data signals with opposite polarities are written into adjacent pixels 13, as is understood from FIGS. 26A and 26B. FIG. 26A illustrates the write sequence of the pixels 13 and the polarities of the data signals written into the respective pixels 13, when the pixels 13 in the first line are driven in accordance with the procedure shown in FIG. 24. With respect to the pixels 13 in the first line, positive data signals are written into the pixels $\mathbf{13}_{R1}$, $\mathbf{13}_{B1}$, $\mathbf{13}_{G2}$, $\mathbf{13}_{R3}$, $\mathbf{13}_{B3}$ and $\mathbf{13}_{G4}$, which are positioned at the odd-numbered positions, while negative data signals are written into the pixels $\mathbf{13}_{G1}$, $\mathbf{13}_{R2}$, $\mathbf{13}_{B2}$, $\mathbf{13}_{G3}$, $\mathbf{13}_{R4}$ and $\mathbf{13}_{B4}$, which are positioned at the even-numbered positions. With respect to the pixels in the second line on the other hand, negative data signals are written into the pixels $\mathbf{13}_{R1}$, $\mathbf{13}_{B1}$, $\mathbf{13}_{G2}$, $\mathbf{13}_{R3}$, $\mathbf{13}_{B3}$ and $\mathbf{13}_{G4}$, which are positioned at the odd-numbered positions, while positive data signals are written into the pixels $\mathbf{13}_{G1}$, $\mathbf{13}_{R2}$, $\mathbf{13}_{B2}$, $\mathbf{13}_{G3}$, $\mathbf{13}_{R4}$ and $\mathbf{13}_{B4}$, which are positioned at the even-numbered positions, as shown in FIG. 265. As thus described, the polarities of the data signals written into adjacent pixels 13 are opposite with respect to both of the horizontal and vertical directions.

The operation thus described requires inverting the polarities of the data signals developed on the respective output terminals of the LCD driver 2B only three times. This effectively reduces the power consumption of the LCD driver 2B.

Additionally, the operation of the liquid crystal display device in this embodiment is determined to successively write data signals into pixels 13 displaying the same color, and thereby effectively reduces vertical segments of unevenness caused by the changes in the write voltages held in the pixels 13.

Figure 27:
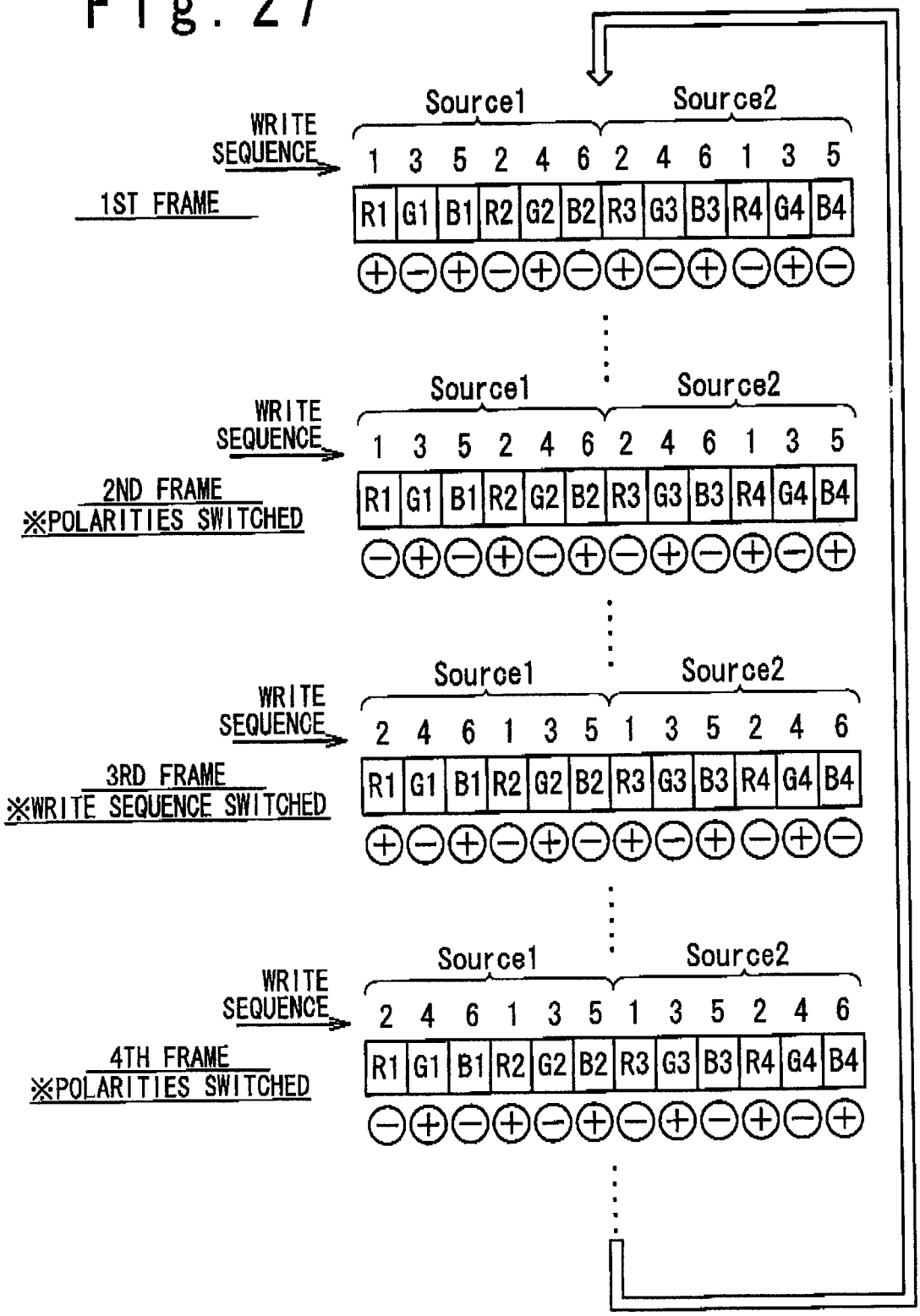
FIG. 27 is a diagram illustrating the write sequence of the pixels in the first line and the polarities of the data signals written into the respective pixels in the first to fourth frame periods in a preferred modification of the fourth embodiment.

As is the case of the third embodiment, it is preferable that the polarities of the data signals and the write sequence of the pixels 13 are preferably switched at a predetermined time cycle in this embodiment. In a preferred embodiment, as shown in FIG. 27, the polarities of the data signals written into the respective pixels 13 are inverted every frame period, and the write sequence of the pixels 13 is switched every two frame periods.

More specifically, the pixels 13 are driven in the above-described procedure in the first frame period, and the polarities of the data signals written into the pixels 13 are inverted in the second frame period.

In the third frame period, the polarities of the data signals written into the pixels 13 are inverted again (that is, the polarities of the data signals written into the respective pixels 13 are same as those in the first embodiment), and the write sequence of the pixels 13 is switched. Specifically, the precedences of the respective pixels 13 in the write operation are exchanged between the pixels 13 displaying the same color.

In detail, in the odd-numbered horizontal periods of the third frame period, the LCD driver 2B outputs negative data signals to be fed to the R pixels $\mathbf{13}_{R2}$ from the odd output terminals Source1, Source3 . . . , and then sequentially outputs positive data signals to be fed to the R pixels $\mathbf{13}_{R1}$ and the G pixels $\mathbf{13}_{G2}$ from the odd output terminals Source1, Source3 . . . . It should be noted that data signals are successively written into the R pixels $\mathbf{13}_{R2}$ and $\mathbf{13}_{R1}$. Next, the LCD driver 2B outputs negative data signals to be fed to the G pixels $\mathbf{13}_{G1}$ and the B pixels $\mathbf{13}_{B2}$ from the odd output terminals Source1, Source3 . . . , and finally outputs positive data signals to be fed to the B pixels $\mathbf{13}_{B1}$ from the odd output terminals Source1, Source3 . . . . It should be noted that data signals are successively written into the G pixels $\mathbf{13}_{G2}$ and $\mathbf{13}_{G1}$, and then successively written into the B pixels $\mathbf{13}_{B2}$ and $\mathbf{13}_{B1}$.

Concurrently, the LCD driver 2B outputs positive data signals to be fed to the R pixels $\mathbf{13}_{R3}$ from the even output terminals Source2, Source4 . . . , and then sequentially outputs positive data signals to be fed to the R pixels $\mathbf{13}_{R4}$ and the G pixels $\mathbf{13}_{G3}$ from the even output terminals Source2, Source4 . . . . It should be noted that data signals are successively written into the R pixels $\mathbf{13}_{R3}$ and $\mathbf{13}_{R4}$. Next, the LCD driver 2B outputs positive data signals to be fed to the G pixels $\mathbf{13}_{G4}$ and the B pixels $\mathbf{13}_{B3}$ from the even output terminals Source2, Source4 . . . , and finally outputs negative data signals to be fed to the B pixels $\mathbf{13}_{B4}$ from the even output terminals Source2, Source4 . . . . It should be noted that data signals are successively written into the G pixels $\mathbf{13}_{G3}$ and $\mathbf{13}_{G4}$, and then successively written into the B pixels $\mathbf{13}_{B3}$ and $\mathbf{13}_{B4}$.

In the even-numbered horizontal periods, the write operations similar to those in the odd-numbered horizontal periods are implemented with the polarities of the data signals written into the pixels 13 inverted.

Figure 25B:
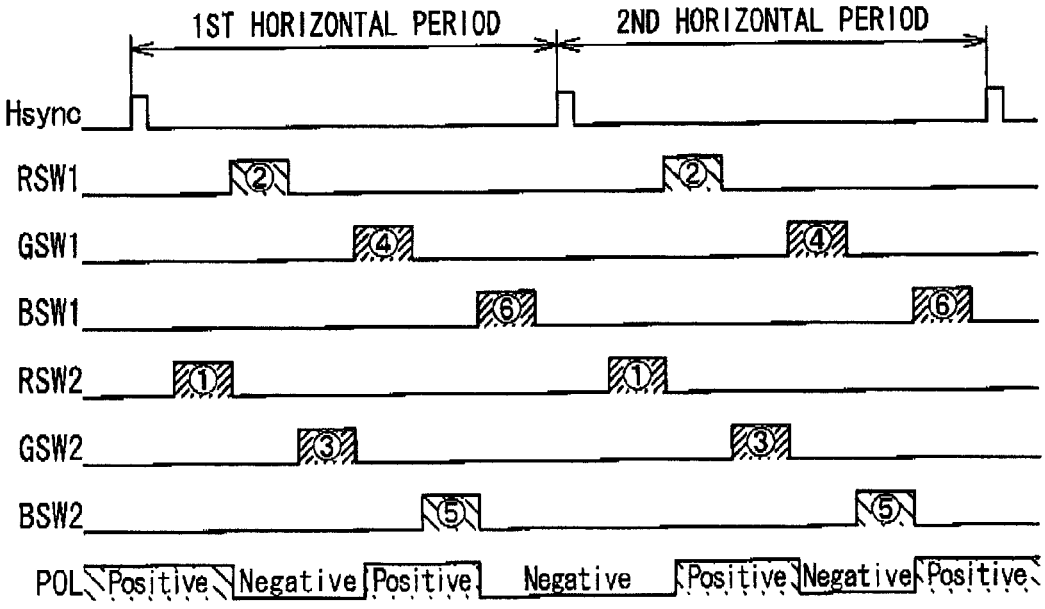
FIG. 25B is a timing chart illustrating the operation of the LCD driver in the third frame period in the fourth embodiment.

The write operation into the pixels 13 with such write sequence can be achieved by activating the control signals RSW2, RSW1, GSW2, GSW1, BSW2 and BSW1 in this order, as shown in FIG. 25B. The polarity signal POL is inverted when the control signal RSW1, GSW1 and BSW1 are activated. It should be noted that the voltage levels of the respective output terminals of the LCD driver 2B are inverted only three times in each horizontal period, although the write operations into the pixels 13 are implemented six times.

In the fourth frame period, data signals are written into the respective pixels 13 in the same write sequence as the third frame period with the polarities of the data signals written into the respective pixels 13 inverted. In the following frame periods, the write operations of the first to fourth frame periods are repeated.

As thus described, the image quality is preferably improved also in this embodiment through periodically switching the polarities of the data signals and the write sequence of the pixels 13 at a time cycle of four frame periods.

Fifth Embodiment

Figure 28:
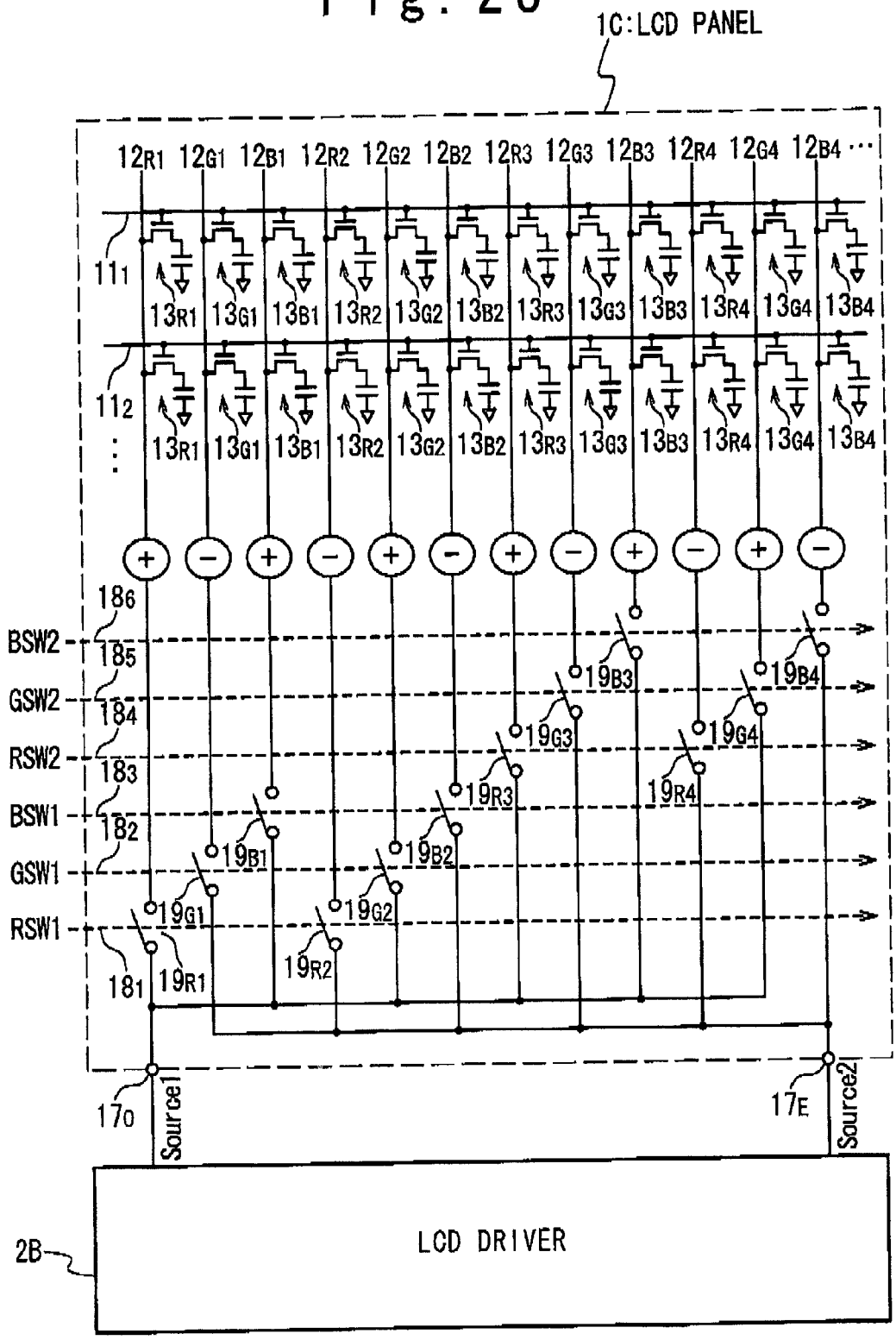
FIG. 28 is a diagram illustrating an exemplary structure of a liquid crystal display device in a fifth embodiment of the present invention.

FIG. 28 is a diagram illustrating the structure of a liquid crystal display device in a fifth embodiment of the present invention. In the liquid crystal display device in the fifth embodiment, interconnections within the LCD panel 2C are modified to reduce the number of times of inversion of the polarities of the data signals on the respective output terminals of the LCD driver 2B. The operation of the LCD driver 2B is also modified accordingly.

Specifically, each input node 17 is connected to data lines 12 associated with the pixels 13 into which data signals with the same polarity are written. In detail, the data lines $\mathbf{12}_{R1}$, $\mathbf{12}_{B1}$, $\mathbf{12}_{G2}$, $\mathbf{12}_{R3}$, $\mathbf{12}_{B3}$ and $\mathbf{12}_{G4}$, which are positioned at the odd-numbered positions, are connected to an odd input node $\mathbf{17}_{O}$ through the switches $\mathbf{19}_{R1}$, $\mathbf{19}_{B1}$, $\mathbf{19}_{G2}$, $\mathbf{19}_{R3}$, $\mathbf{19}_{B3}$ and $\mathbf{19}_{G4}$, while the data lines $\mathbf{12}_{G1}$, $\mathbf{12}_{R2}$, $\mathbf{12}_{B2}$, $\mathbf{12}_{G3}$, $\mathbf{12}_{R4}$ and $\mathbf{12}_{B4}$, which are positioned at the even-numbered positions, are connected to an even input node $\mathbf{17}_{E}$ through the switches $\mathbf{19}_{G1}$, $\mathbf{19}_{R2}$, $\mathbf{19}_{B2}$, $\mathbf{19}_{G3}$, $\mathbf{19}_{R4}$ and $\mathbf{19}_{B4}$.

The switches $\mathbf{19}_{R1}$, $\mathbf{19}_{G1}$ and $\mathbf{19}_{B1}$ are connected to interconnections $\mathbf{18}_1$, $\mathbf{18}_2$ and $\mathbf{18}_3$ to receive the control signals RSW1, GSW1 and BSW1, respectively. Additionally, the switches $\mathbf{19}_{R2}$ $\mathbf{19}_{G2}$ and $\mathbf{19}_{B2}$ are also connected to interconnections $\mathbf{18}_1$, $\mathbf{18}_2$ and $\mathbf{18}_3$ to receive the control signals RSW1, GSW1 and BSW1. The switches $\mathbf{19}_{R3}$, $\mathbf{19}_{G3}$ and $\mathbf{19}_{B3}$, on the other hand, are connected to interconnections $\mathbf{18}_4$, $\mathbf{18}_5$ and $\mathbf{18}_6$ to receive the control signals RSW2, GSW2 and BSW2, respectively. Additionally, the switches $\mathbf{19}_{R4}$, $\mathbf{19}_{G4}$ and $\mathbf{19}_{B4}$ are also connected to interconnections $\mathbf{18}_4$, $\mathbf{18}_5$ and $\mathbf{18}_6$ to receive the control signals RSW2, GSW2 and BSW2, respectively.

The liquid crystal display device in the fifth embodiment eliminates the need for inverting the polarities of the data signals on the respective output terminals of the LCD driver 2B in the middle of each horizontal period, through adopting the structure in which the data lines 12 positioned at the odd-numbered positions are connected to the odd input nodes $\mathbf{17}_{O}$, and the data lines 12 positioned at the even-numbered positions are connected to the even input nodes $\mathbf{17}_{E}$.

Figure 29:
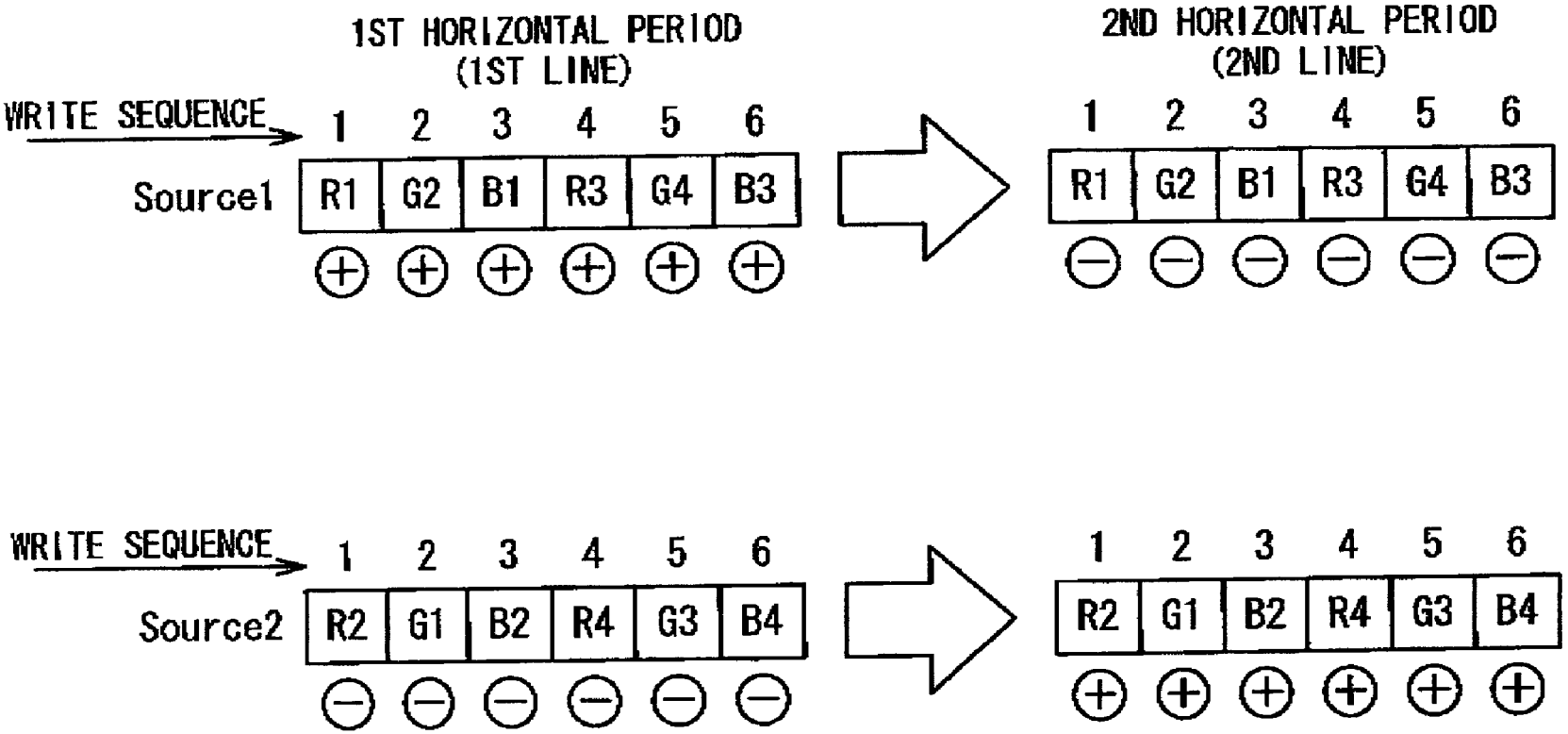
FIG. 29 is a diagram illustrating pixels into which data signals outputted from respective output terminals of the LCD driver are written, and the polarities of the respective data signals, in the fifth embodiment.

Specifically, in the first horizontal period, the LCD driver 2B sequentially outputs positive data signals to be fed to the R pixels $\mathbf{13}_{R1}$, the G pixels $\mathbf{13}_{G2}$, the B pixels $\mathbf{13}_{B1}$, the R pixels $\mathbf{13}_{R3}$, the G pixels $\mathbf{13}_{G4}$ and the B pixels $\mathbf{13}_{B3}$ (which are positioned in the first line) in this order from the odd output terminals Source1, Source3 . . . , as shown in FIG. 29. Concurrently, the LCD driver 2B sequentially outputs negative data signals to be fed to the R pixels $\mathbf{13}_{R2}$, the G pixels $\mathbf{13}_{G1}$, the B pixels $\mathbf{13}_{B2}$, the R pixels $\mathbf{13}_{R4}$, the G pixels $\mathbf{13}_{G3}$ and the B pixels $\mathbf{13}_{B4}$ in this order from the even output terminals Source2, Source4 . . . .

In the second horizontal period, the LCD driver 2B sequentially outputs negative data signals to be fed to the R pixels $\mathbf{13}_{R1}$, the G pixels $\mathbf{13}_{G2}$, the B pixels $\mathbf{13}_{B1}$, the R pixels $\mathbf{13}_{R3}$, the G pixels $\mathbf{13}_{G4}$ and the B pixels $\mathbf{13}_{B3}$ (which are positioned in the second line) in this order from the odd output terminals Source1, Source3 . . . . Concurrently, the LCD driver 2B sequentially outputs positive data signals to be fed to the R pixels $\mathbf{13}_{R2}$, the G pixels $\mathbf{13}_{G1}$, the B pixels $\mathbf{13}_{B2}$, the R pixels $\mathbf{13}_{R4}$, the G pixels $\mathbf{13}_{G3}$ and the B pixels $\mathbf{13}_{B4}$ in this order from the even output terminals Source2, Source4 . . . .

The write operation into the pixels 13 with such write sequence can be achieved by activating the control signals RSW1, GSW1, BSW1, RSW2, GSW2 and BSW2 in this order in each horizontal period. The polarity signal POL is inverted at the beginning of each horizontal period. This allows inverting the voltage levels of the respective output terminals of the LCD drive 2B only at the beginning of each horizontal period.

Figure 30A:
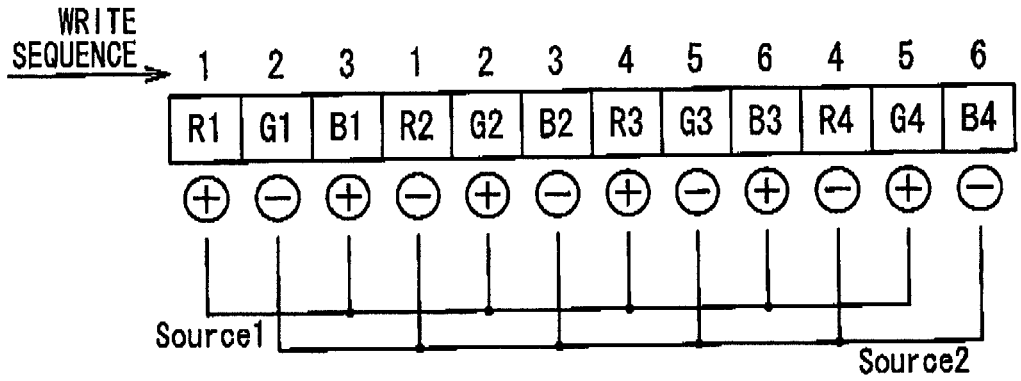
FIG. 30A is a diagram illustrating the write sequence of the pixels in the first line and the polarities of the data signals written into the respective pixels in the fifth embodiment.
Figure 30B:
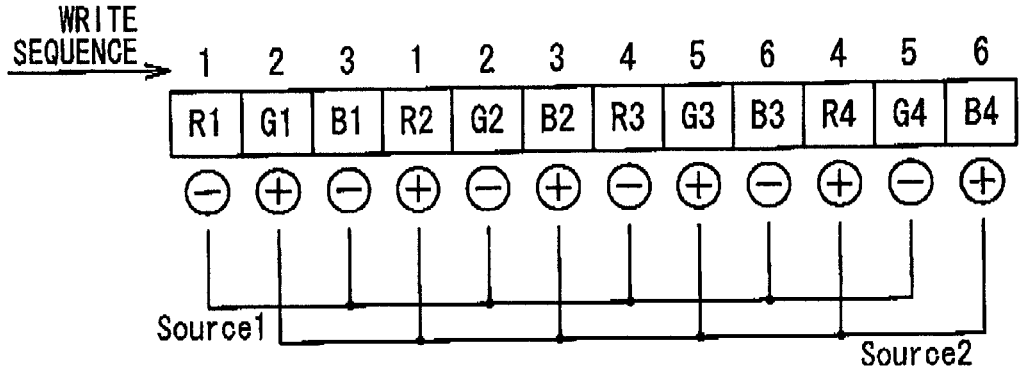
FIG. 30B is a diagram illustrating the write sequence of the pixels in the second line and the polarities of the data signals written into the respective pixels in the fifth embodiment.

It should be noted that such operation achieves the dot inversion drive, in which data signals with opposite polarities are written into adjacent pixels 13, as is understood from FIGS. 30A and 30B. FIG. 30A illustrates the write sequence of the pixels 13 and the polarities of the data signals written into the respective pixels 13, when the pixels 13 in the first line are driven in accordance with the procedure shown in FIG. 29. With respect to the pixels 13 in the first line, positive data signals are written into the pixels $\mathbf{13}_{R1}$, $\mathbf{13}_{B1}$, $\mathbf{13}_{G2}$, $\mathbf{13}_{R3}$, $\mathbf{13}_{B3}$ and $\mathbf{13}_{G4}$, which are positioned at the odd-numbered positions, while negative data signals are written into the pixels $\mathbf{13}_{G1}$, $\mathbf{13}_{R2}$, $\mathbf{13}_{B2}$, $\mathbf{13}_{G3}$, $\mathbf{13}_{R4}$ and $\mathbf{13}_{B4}$, which are positioned at the even-numbered positions. With respect to the pixels in the second line on the other hand, negative data signals are written into the pixels $\mathbf{13}_{R1}$, $\mathbf{13}_{B1}$, $\mathbf{13}_{G2}$, $\mathbf{13}_{R3}$, $\mathbf{13}_{B3}$ and $\mathbf{13}_{G4}$, which are positioned at the odd-numbered positions, while positive data signals are written into the pixels $\mathbf{13}_{G1}$, $\mathbf{13}_{R2}$, $\mathbf{13}_{B2}$, $\mathbf{13}_{G3}$, $\mathbf{13}_{R4}$ and $\mathbf{13}_{B4}$, which are positioned at the even-numbered positions as shown in FIG. 30B. As thus described, the polarities of the data signals written into adjacent pixels 13 are opposite with respect to both of the horizontal and vertical directions.

The pixels 13 are driven in the same manner in the following horizontal periods. In the odd-numbered horizontal periods, the pixels 13 in the odd-numbered lines are driven in the same manner as the first horizontal period, while the pixels 13 in the even-numbered lines are driven in the same manner as the second horizontal period in the even-numbered horizontal periods.

Figure 31:
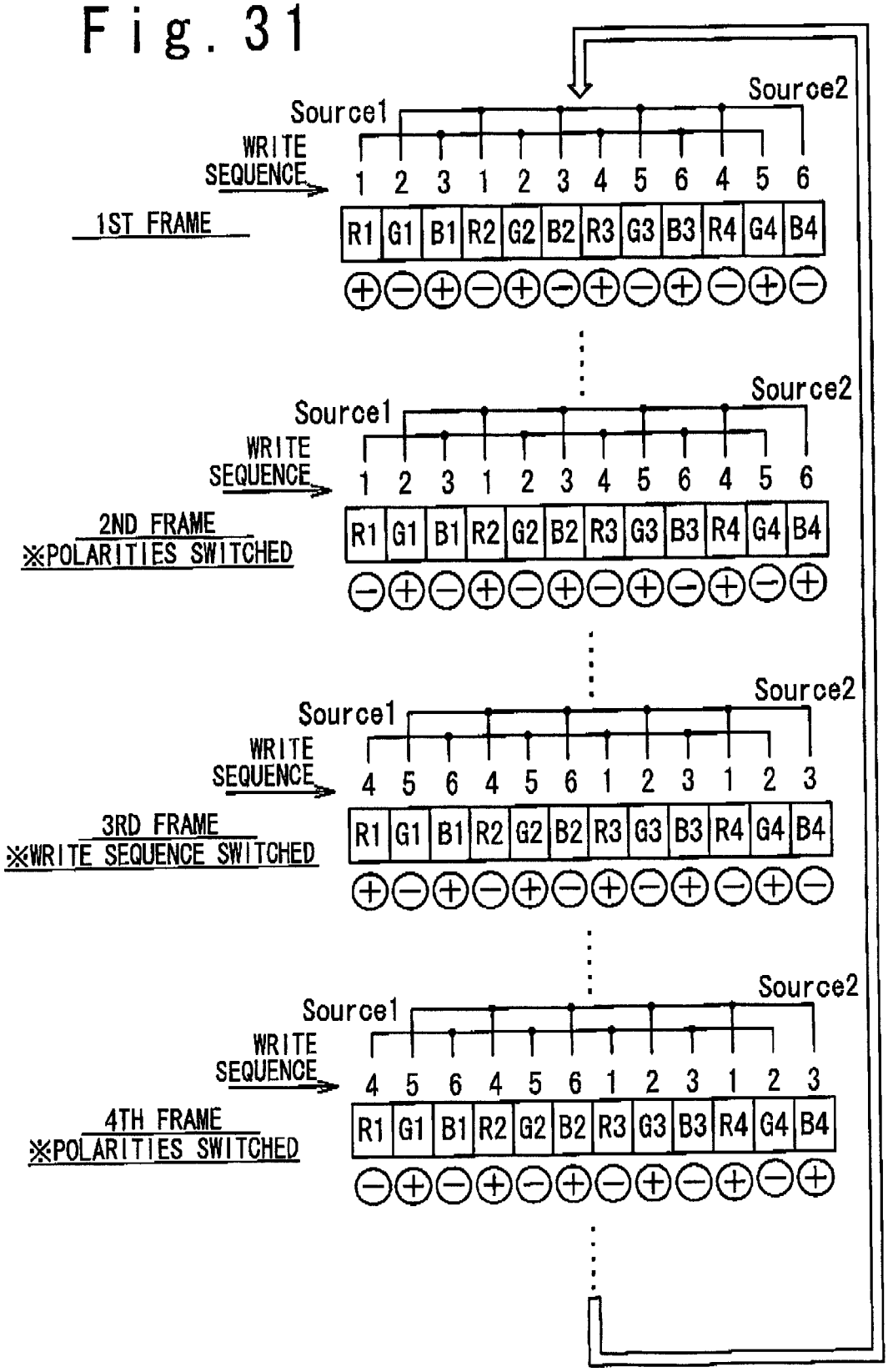
FIG. 31 is a diagram illustrating the write sequence of the pixels in the first line and the polarities of the data signals written into the respective pixels in the first to fourth frame periods in the fifth embodiment.

As is the case of the third and fourth embodiments, it is preferable that the polarities of the data signals and the write sequence of the pixels 13 are preferably switched at a predetermined time cycle in this embodiment. In a preferred embodiment, as shown in FIG. 31, the polarities of the data signals written into the respective pixels 13 are inverted every frame period, and the write sequence of the pixels 13 is switched every two frame periods.

More specifically, the pixels 13 are driven in the above-described procedure in the first frame period, and the polarities of the data signals written into the pixels 13 are inverted in the second frame period.

In the third frame period, the polarities of the data signals written into the pixels 13 are inverted again (that is, the polarities of the data signals written into the respective pixels 13 are same as those in the first embodiment), and the write sequence of the pixels 13 is switched.

Specifically, in the odd-numbered horizontal periods of the third frame period, the LCD driver 2B sequentially outputs positive data signals to be fed to the R pixels $\mathbf{13}_{R3}$, the G pixels $\mathbf{13}_{G4}$, the B pixels $\mathbf{13}_{B3}$, the R pixels $\mathbf{13}_{R1}$, the G pixels $\mathbf{13}_{G2}$ and the B pixels $\mathbf{13}_{B1}$ (which are positioned at the first line) in this order from the odd output terminals Source1, Source3 . . . . Concurrently, the LCD driver 2B outputs negative data signals to be fed to the R pixels $\mathbf{13}_{R4}$, the G pixels $\mathbf{13}_{G3}$, the B pixels $\mathbf{13}_{B4}$, the R pixels $\mathbf{13}_{R2}$, the G pixels $\mathbf{13}_{G1}$ and the B pixels $\mathbf{13}_{B2}$ in this order from the even output terminals Source2, Source4 . . . . In the even-numbered horizontal periods of the third frame period, the write operations similar to those in the odd-numbered horizontal periods are implemented with the polarities of the data signals written into the pixels 13 inverted.

In the fourth frame period, data signals are written into the respective pixels 13 in the same write sequence as the third frame period with the polarities of the data signals written into the respective pixels 13 inverted. In the following frame periods, the write operations of the first to fourth frame periods are repeated.

As thus described, the image quality is preferably improved also in this embodiment through periodically switching the polarities of the data signals and the write sequence of the pixels 13 at a time cycle of four frame periods.

Figure 32:
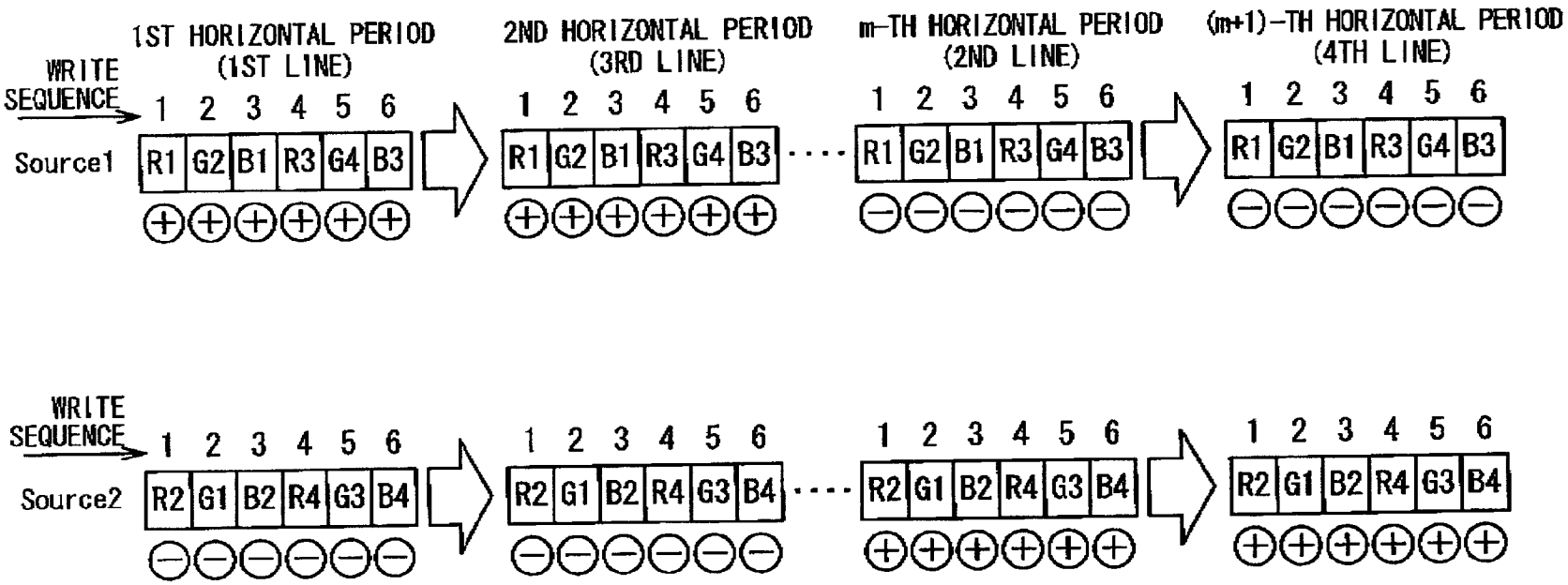
FIG. 32 is a diagram illustrating pixels into which data signals outputted from respective output terminals of the LCD driver are written, and the polarities of the respective data signals, in a preferred modification of the fifth embodiment.

Referring to FIG. 32, it is preferable that the pixels 13 in the odd-numbered lines are firstly driven and then the pixels 13 in the even-numbered lines are then driven, for further reducing the number of times of the inversion on the polarities of the data signals on the respective output terminals of the LCD driver 2. As described above, the write operation of the fifth embodiment involves successively outputting positive data signals from the odd output terminals Source1, Source3 . . . in the write operation into the pixels 13 positioned in the odd-numbered lines, while successively outputting negative data signals from the even output terminals Source2, Source4 . . . in the write operation into the pixels 13 positioned in the even-numbered lines. Therefore, the number of times of the inversion of the polarities of the data signals on the respective output terminals of the LCD driver 2B is further reduced by firstly driving the pixels 13 in the odd-numbered lines and then driving the pixels 13 in the even-numbered lines (or by firstly driving the pixels 13 in the even-numbered lines and then driving the pixels 13 in the odd-numbered lines).

Figure 33A:
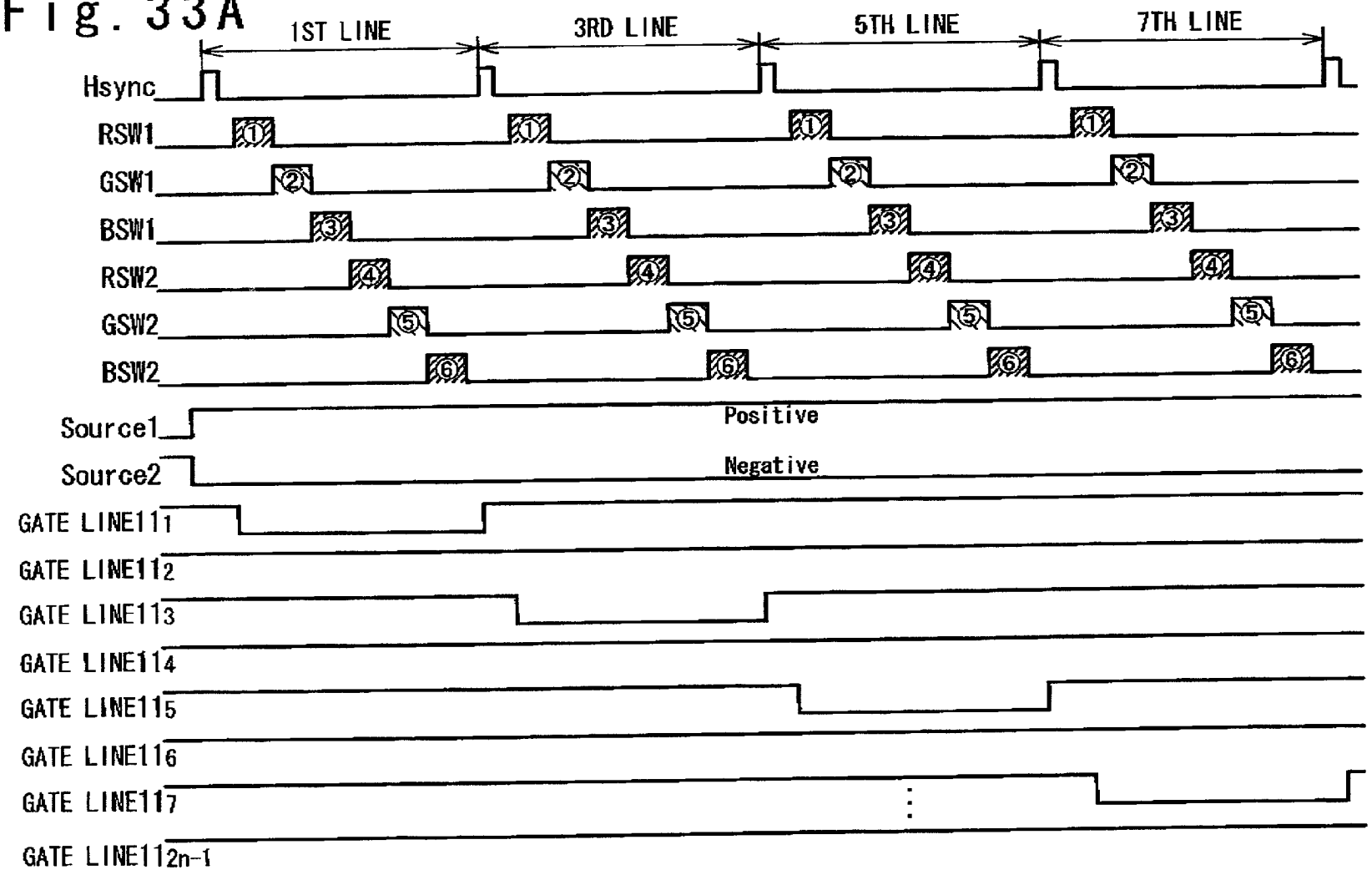
FIGS. 33A and 33B are timing charts illustrating the operation of the liquid crystal display device in the first frame period in the preferred modification of the fifth embodiment.

FIGS. 33A to 33D are timing chart illustrating operation timings for achieving the above-described operation. In the respective horizontal periods within the former half of the first frame period, as shown in FIG. 33A, the odd-numbered gate lines $\mathbf{11}_1$, $\mathbf{11}_3$ . . . are sequentially activated to thereby sequentially select the pixels 13 in the odd-numbered lines. In the respective horizontal periods, the control signals RSW1, GSW1, BSW1, RSW2, GSW2 and BSW2 are activated in this order. The LCD driver 2B successively outputs positive data signals from the odd output terminals Source1, Source3 . . . , and successively outputs negative data signals from the even output terminals Source2, Source4 . . . , concurrently. This completes the write operation of the data signals into the pixels 13 in the odd-numbered lines.

Figure 33B:
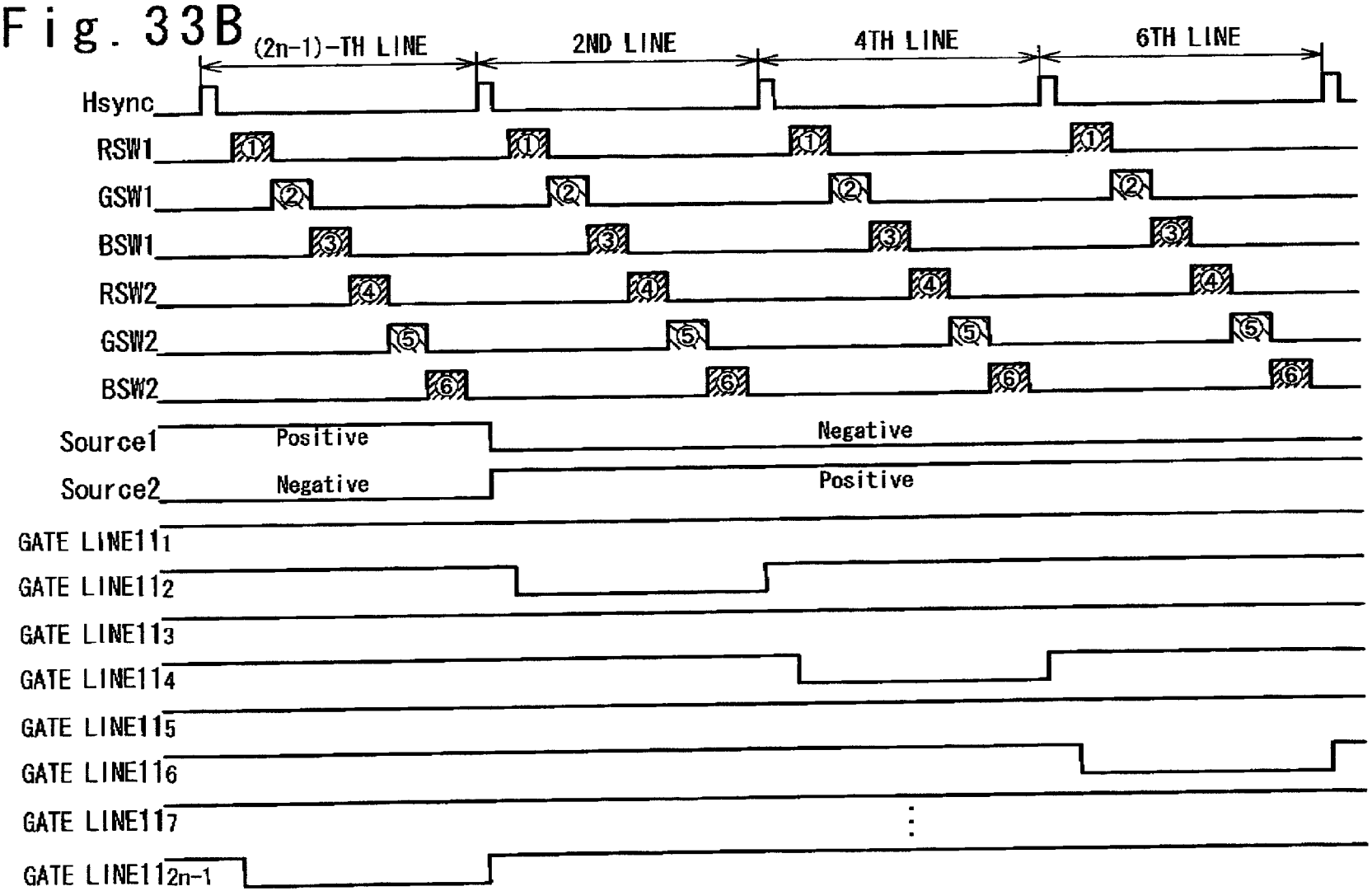
Figure 33C:
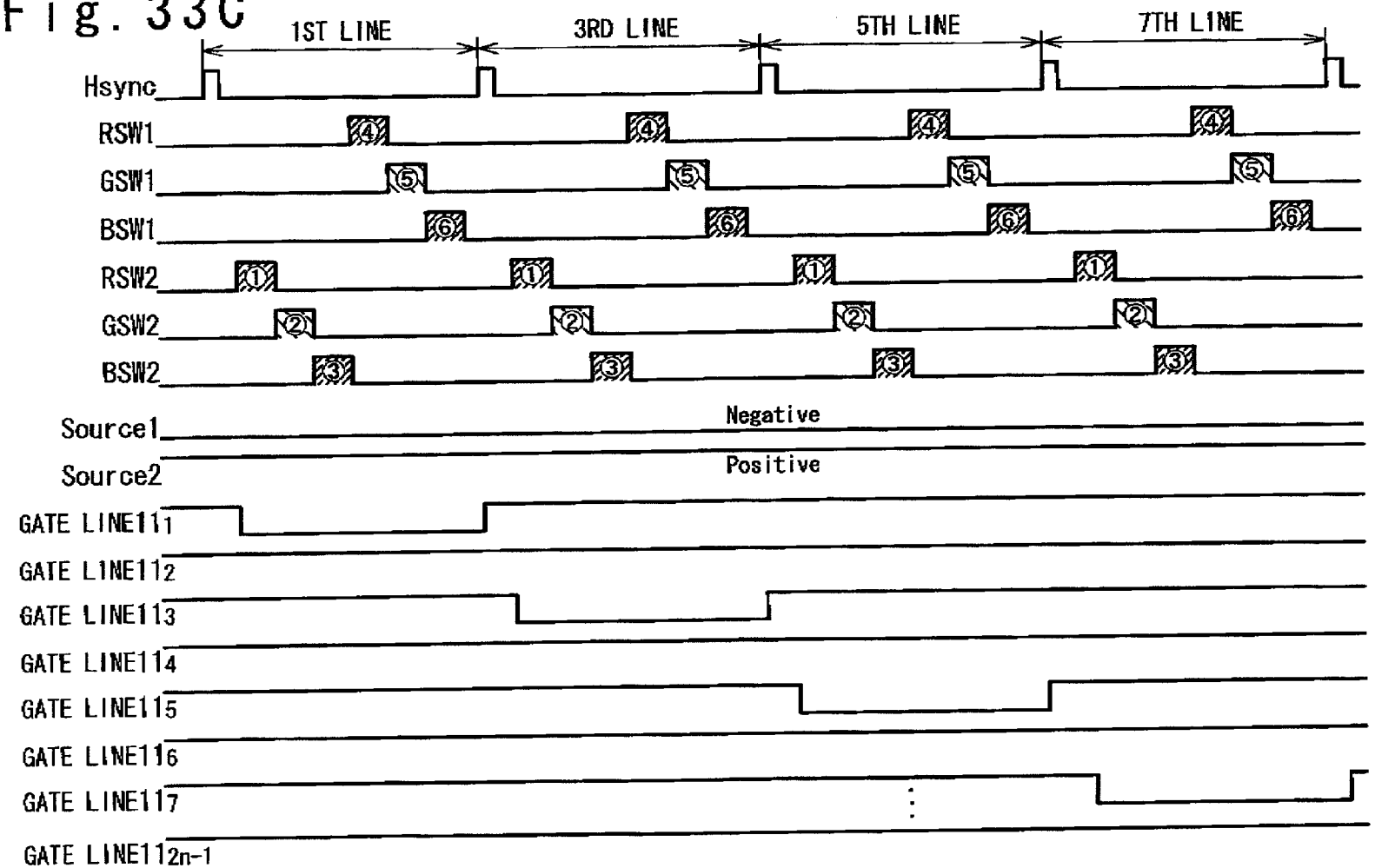
FIGS. 33C and 33D are timing charts illustrating the operation of the liquid crystal display device in the third frame period in the preferred modification of the fifth embodiment.
Figure 33D:
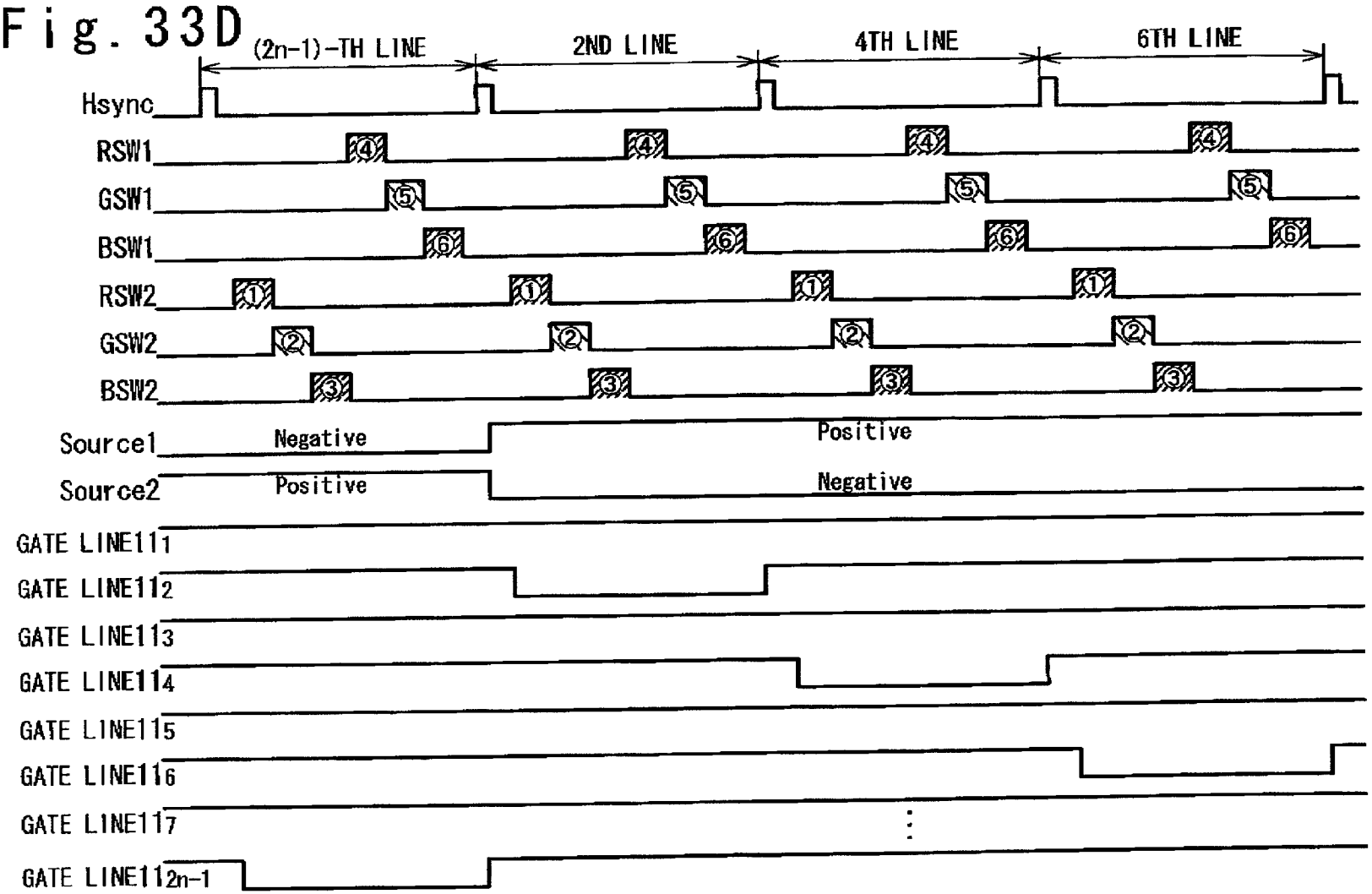

As shown in FIG. 33B, the even-numbered gate lines $\mathbf{11}_2$, $\mathbf{11}_4$ . . . are then sequentially activated to select the pixels 13 in the even-numbered lines after the completion of the write operation into the pixels 13 in all the odd-numbered lines. In the respective horizontal periods, the control signals RSW1, GSW1, BSW1, RSW2, GSW2 and BSW2 are activated in this order. The LCD driver 2B successively outputs negative data signals from the odd output terminals Source1, Source3 . . . , and successively outputs positive data signals from the even output terminals Source2, Source4 . . . , concurrently. This completes the write operation of the data signals into the pixels 13 in the even-numbered lines.

In the second frame period, the pixels 13 are driven in the similar manner to the first frame period, with the polarities of the data signals fed to the respective pixels 13 inverted.

In the third frame period, the write sequences of the respective horizontal periods are switched. Specifically, the control signals RSW2, GSW2, BSW2, RSW1, GSW1 and BSW1 are activated in this order. The polarities of the data signals written into the respective pixels 13 in the third frame period are same as those in the second frame period. Switching the write sequences of the respective horizontal periods effectively reduces vertical segments of unevenness caused by the change in the write voltages held in the respective pixels 13.

In the fourth frame period, the pixels 13 are driven in the similar manner to the third frame period, with the polarities of the data signals fed to the respective pixels 13 inverted. In the following frame periods, the operations in the first to fourth frame periods are repeated.

As thus described, the liquid crystal display device in this embodiment firstly drives the pixels 13 in the odd-numbered lines and then drives the pixels 13 in the even-numbered lines (or firstly drives the pixels 13 in the even-numbered lines and then drives the pixels 13 in the odd-numbered lines). Such operation further reduces the number of times of the inversion of the polarities of the data signals on the respective output terminals of the LCD driver 2B, and thereby further reduces the power consumption of the LCD driver 2B.

Sixth Embodiment

Figure 34:
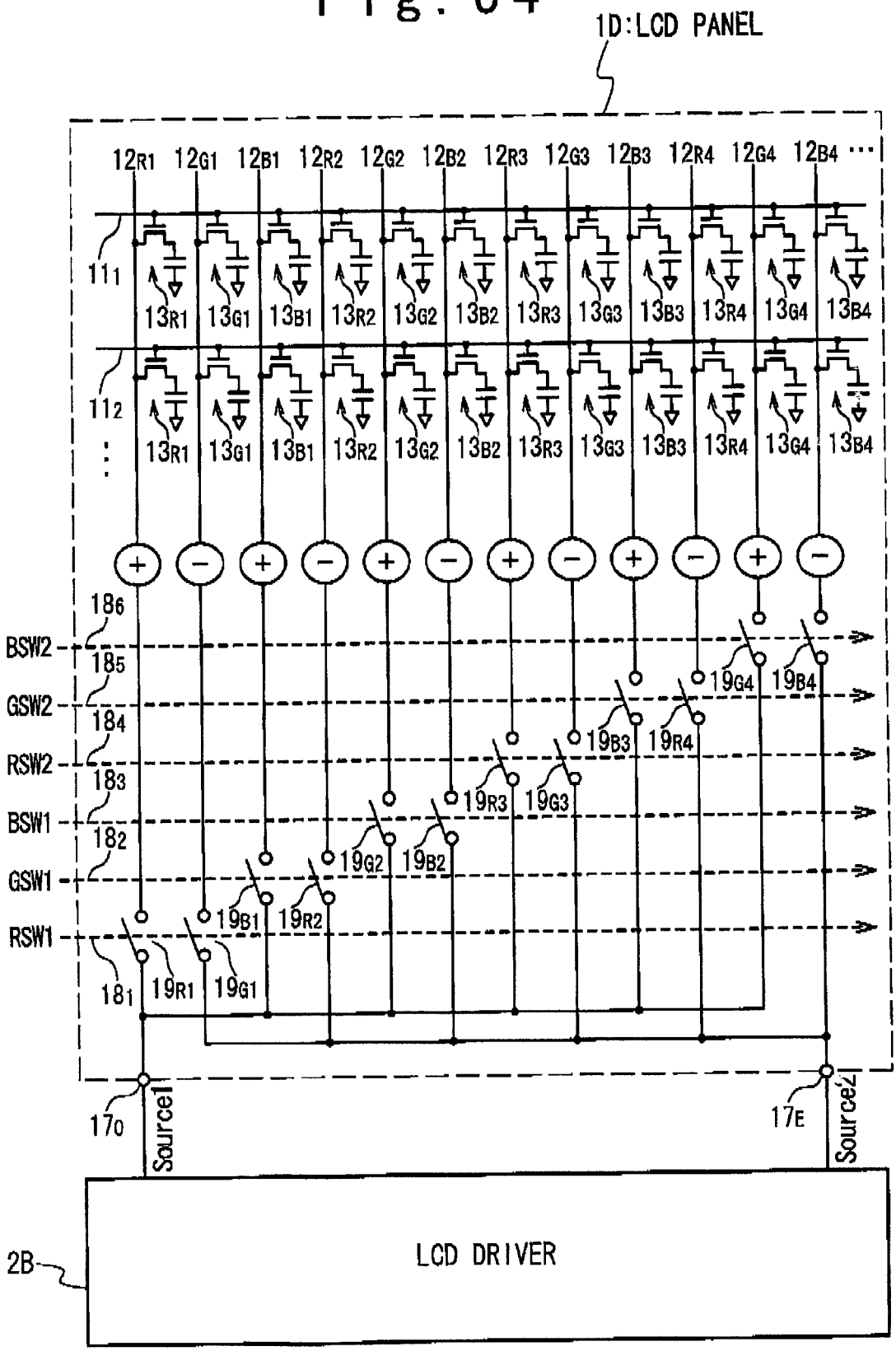
FIG. 34 is a diagram illustrating an exemplary structure of a liquid crystal display device in a sixth embodiment of the present invention.

FIG. 34 is a diagram illustrating the structure of a liquid crystal display device in a six embodiment of the present invention. The structure of the liquid crystal display device in the six embodiment is almost identical to that in the fifth embodiment; the data lines $\mathbf{12}_{R1}$, $\mathbf{12}_{B1}$, $\mathbf{12}_{G2}$, $\mathbf{12}_{R3}$, $\mathbf{12}_{B3}$ and $\mathbf{12}_{G4}$, which are positioned at the odd-numbered positions, are connected to the odd input nodes $\mathbf{17}_{O}$, while the data lines $\mathbf{12}_{G1}$, $\mathbf{12}_{R2}$, $\mathbf{12}_{B2}$, $\mathbf{12}_{G3}$, $\mathbf{12}_{R4}$ and $\mathbf{12}_{B4}$, which are positioned at the even-numbered positions, are connected to the even input nodes $\mathbf{17}_{E}$. Such connections effectively further reduces the power consumption of the LCD driver 2B, as described above.

The difference is that the interconnections within the LCD panel 2D are designed so that adjacent two data lines 12 are driven at the same time. Specifically, the switches $\mathbf{19}_{R1}$ and $\mathbf{19}_{G1}$ are connected to the interconnection $\mathbf{18}_{1}$, which is used for feeding the control signal RSW1, while the switches $\mathbf{19}_{B1}$ and $\mathbf{19}_{R2}$ are connected to the interconnection $\mathbf{18}_{2}$, which is used for feeding the control signal GSW1. Additionally, the switches $\mathbf{19}_{G2}$ and $\mathbf{19}_{B2}$ are connected to the interconnection $\mathbf{18}_{3}$, which is used for feeding the control signal BSW1, while the switches $\mathbf{19}_{R3}$ and $\mathbf{19}_{G3}$ are connected to the interconnection $\mathbf{18}_{4}$, which is used for feeding the control signal RSW2. Finally, the switches $\mathbf{19}_{B3}$ and $\mathbf{19}_{R4}$ are connected to the interconnection $\mathbf{18}_{5}$, which is used for feeding the control signal GSW2, while the switches $\mathbf{19}_{g4}$ and $\mathbf{19}_{B43}$ are connected to the interconnection $\mathbf{18}_{6}$, which is used for feeding the control signal BSW2. Such interconnection arrangement allows driving the data lines $\mathbf{12}_{R1}$ and $\mathbf{12}_{G1}$, which are adjacent to each other, by activating the control signal RSW1, for example.

Figure 35A:
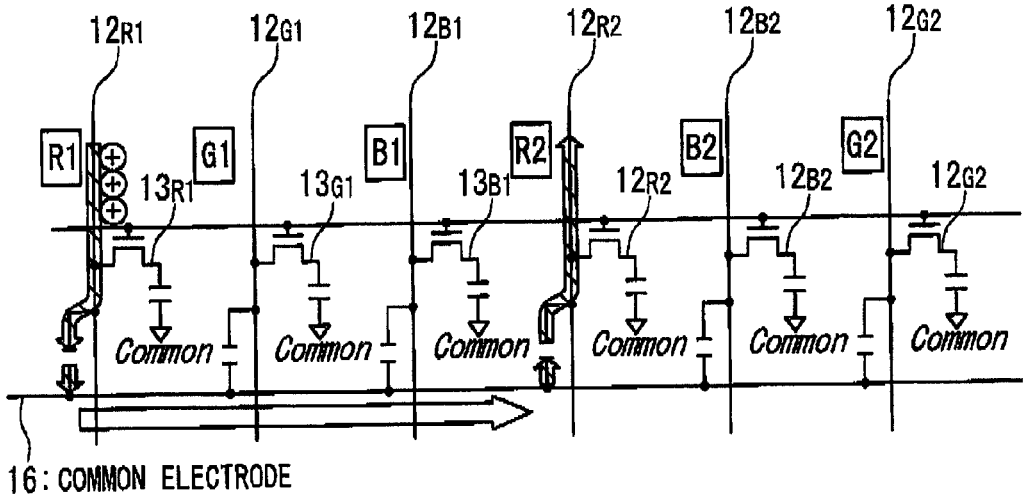
FIG. 35A is a diagram illustrating the path of a current flown through the common electrode when data lines apart from each other are driven at the same time.
Figure 35B:
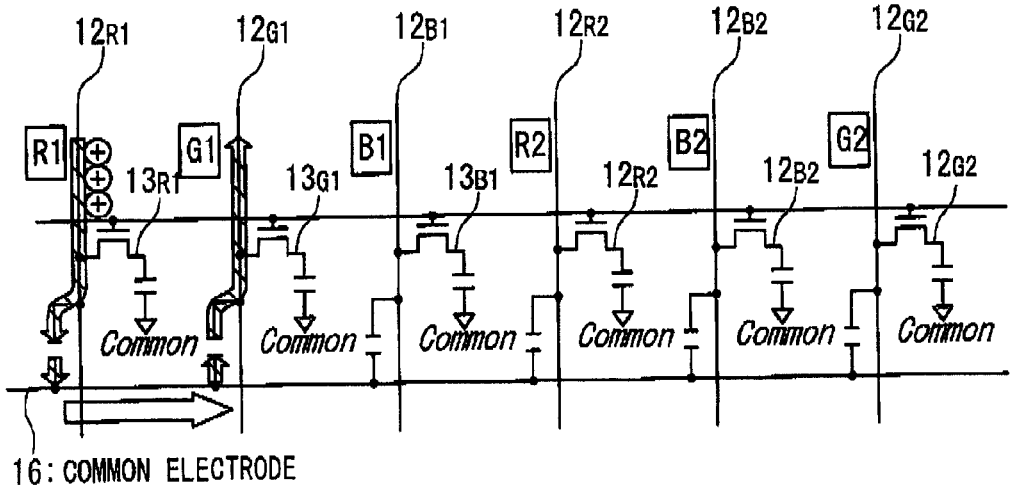
FIG. 35B is a diagram illustrating the path of a current flown through the common electrode when adjacent data lines are driven at the same time.

FIGS. 35A and 35B are diagrams explaining the technical significance of driving adjacent data lines 12 at the same time. When one of two data lines 12 is driven with a positive data signal and the other is driven with a negative data signal, a current flows between the two data lines 12 through the common electrode 16, due to the capacitive coupling between the data lines 12 and the common electrode 16.

In the case that the two data lines 12 located apart from each other (for example, the data lines $\mathbf{12}_{R1}$ and $\mathbf{12}_{R2}$ in FIG. 35A) are driven at the same time, as is the case of the LCD panel 2C shown in FIG. 28, the traveling distance of the current through the common electrode 16 is increased, and this causes a large voltage drop across the common electrode 16. This undesirably causes a local change in the voltage level of the common electrode 16.

On the other hand, the LCD panel 2D in this embodiment, effectively reduces the traveling distance of the current through the common electrode 16 by driving adjacent data lines 12 (for example, the data lines $\mathbf{12}_{R1}$ and $\mathbf{12}_{G1}$, in FIG. 35B) at the same time, and thereby reduces the voltage drop across the common electrode 16. This effectively avoids a local change in the voltage level of the common electrode 16.

Figure 36:
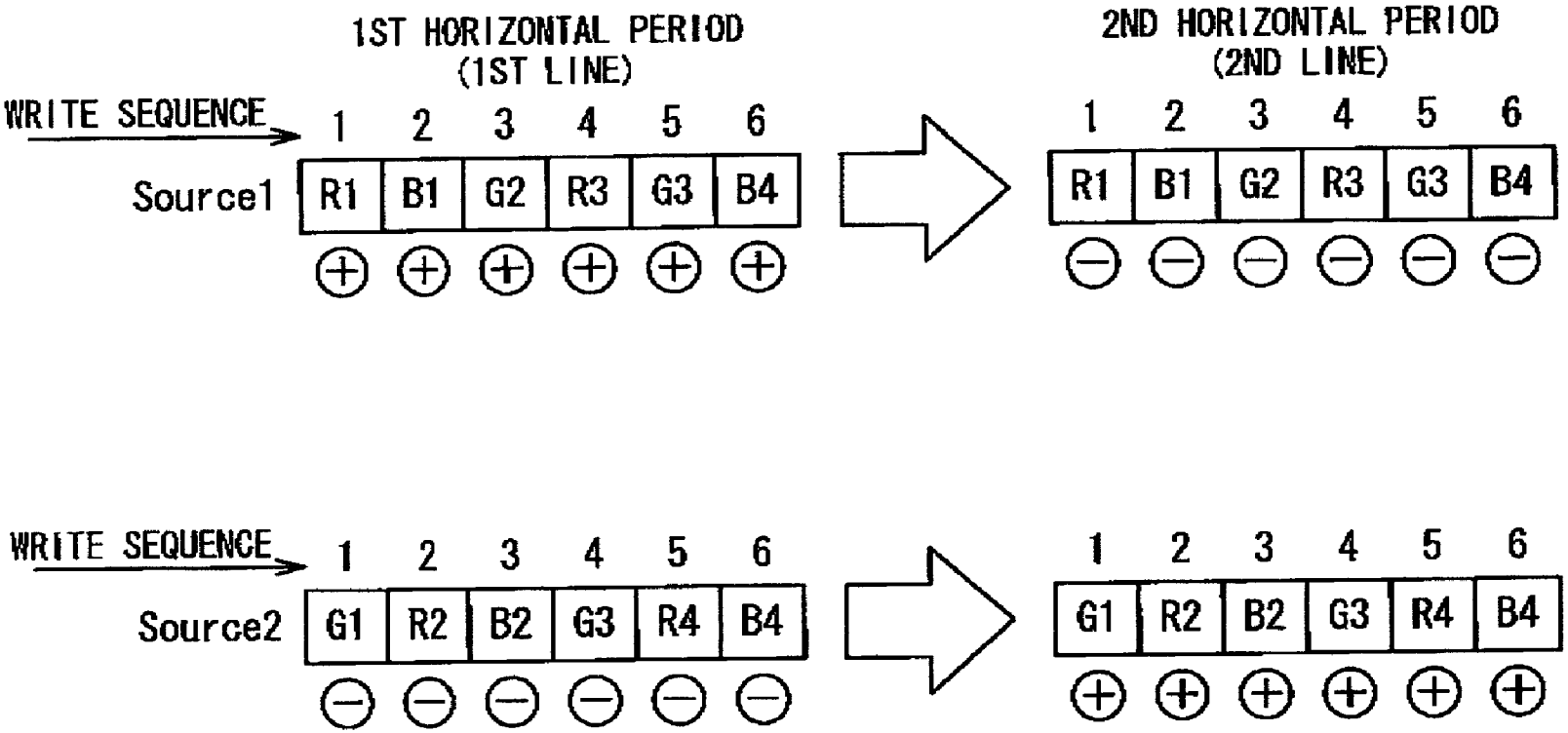
FIG. 36 is a diagram illustrating pixels into which data signals outputted from respective output terminals of the LCD driver are written, and the polarities of the respective data signals, in the sixth embodiment.

A detail description is given of the operation of the liquid crystal display device in this embodiment in the following. As shown in FIG. 36, the LCD driver 2B inverts the polarities of the data signals developed on the respective output terminals thereof only at the beginning of each horizontal period in this embodiment, as is the case of the fifth embodiment. Specifically, in the first horizontal period, the LCD driver 2B sequentially outputs positive data signals to be fed to the R pixels $\mathbf{13}_{R1}$, the B pixels $\mathbf{13}_{B1}$, the G pixels $\mathbf{13}_{G2}$, the R pixels $\mathbf{13}_{R3}$, the G pixels $\mathbf{13}_{G3}$ and the B pixels $\mathbf{13}_{B4}$ (which are positioned in the first line) in this order from the odd output terminals Source1, Source3 . . . , as shown in FIG. 36. Concurrently, the LCD driver 2B sequentially outputs negative data signals to be fed to the G pixels $\mathbf{13}_{G1}$, the R pixels $\mathbf{13}_{R2}$, the B pixels $\mathbf{13}_{B2}$, the G pixels $\mathbf{13}_{G3}$, the R pixels $\mathbf{13}_{R4}$ and the B pixels $\mathbf{13}_{B4}$ in this order from the even output terminals Source2, Source4 . . . .

In the second horizontal period, the LCD drive 2B sequentially outputs negative data signals to be fed to the R pixels $\mathbf{13}_{R1}$, the B pixels $\mathbf{13}_{B1}$, the G pixels $\mathbf{13}_{G2}$, the R pixels $\mathbf{13}_{R3}$, the G pixels $\mathbf{13}_{G3}$ and the B pixels $\mathbf{13}_{B4}$ in this order from the odd output terminals Source1, Source3 . . . . Concurrently, the LCD driver 2B sequentially outputs positive data signals to be fed to the G pixels $\mathbf{13}_{G1}$, the R pixels $\mathbf{13}_{R2}$, the B pixels $\mathbf{13}_{B2}$, the G pixels $\mathbf{13}_{G3}$, the R pixels $\mathbf{13}_{R4}$ and the B pixels $\mathbf{13}_{B4}$ in this order from the even output terminals Source2, Source4 . . .

Figure 37A:
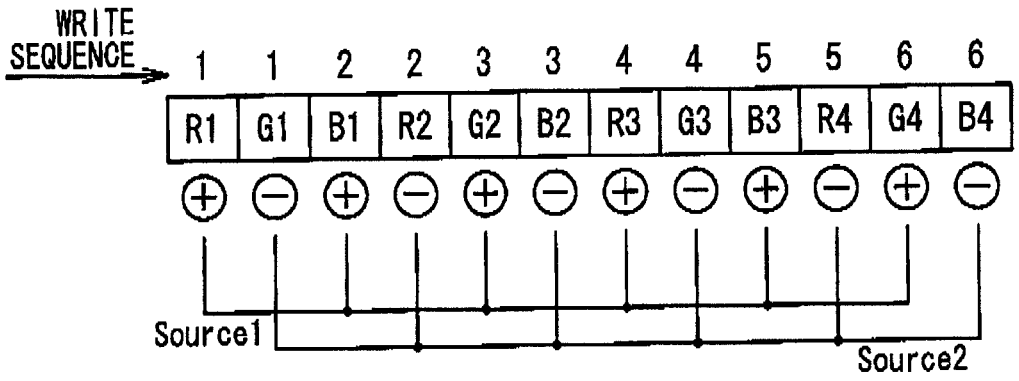
FIG. 37A is a diagram illustrating the write sequence of the pixels in the first line and the polarities of the data signals written into the respective pixels in the sixth embodiment.

It should be noted that the data signals outputted from the odd output terminal Source1 and the even output terminal Source2 are always written into pixels 13 connected to adjacent data lines 12. Referring to FIG. 37A, for example, when the data signal to be fed to the R pixel $\mathbf{13}_{R1}$ is outputted from the odd output terminal Source1, the data signal to be fed to the G pixel $\mathbf{13}_{G1}$, which is adjacent to the R pixels $\mathbf{13}_{R1}$, is outputted from the even output terminal Source2, in the first horizontal period. As described above, such write operation effectively reduces a local change in the voltage level of the common electrode 16.

The write operation into the pixels 13 with such write sequence can be achieved by activating the control signals RSW1, GSW1, BSW1, RSW2, GSW2 and BSW2 in this order. The polarity signal POL is inverted at the beginning of each horizontal period. This results in that the voltage levels of the respective output terminals of the LCD driver 2B are inverted only at the beginning of each horizontal period.

Figure 37B:
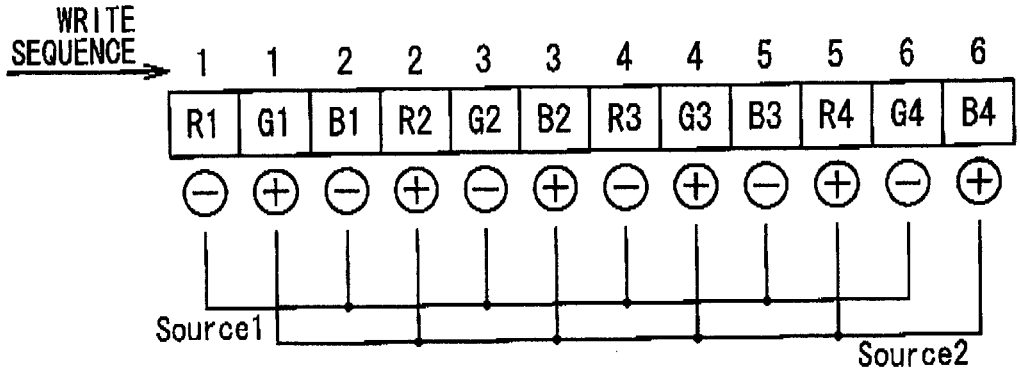
FIG. 37B is a diagram illustrating the write sequence of the pixels in the second line and the polarities of the data signals written into the respective pixels in the sixth embodiment.

It should be noted that such operation achieves the dot inversion drive, in which data signals with opposite polarities are written into adjacent pixels 13, as is understood from FIGS. 37A and 37B. FIG. 37A illustrates the write sequence of the pixels 13 and the polarities of the data signals written into the respective pixels 13, when the pixels 13 in the first line are driven in accordance with the procedure shown in FIG. 36. With respect to the pixels 13 in the first line, positive data signals are written into the pixels $\mathbf{13}_{R1}$, $\mathbf{13}_{B1}$, $\mathbf{13}_{G2}$, $\mathbf{13}_{R3}$, $\mathbf{13}_{B3}$ and $\mathbf{13}_{G4}$, which are positioned at the odd-numbered positions, while negative data signals are written into the pixels $\mathbf{13}_{G1}$, $\mathbf{13}_{R2}$, $\mathbf{13}_{B2}$, $\mathbf{13}_{G3}$, $\mathbf{13}_{R4}$ and $\mathbf{13}_{B4}$, which are positioned at the even-numbered positions. With respect to the pixels in the second line on the other hand, negative data signals are written into the pixels $\mathbf{13}_{R1}$, $\mathbf{13}_{B1}$, $\mathbf{13}_{G2}$, $\mathbf{13}_{R3}$, $\mathbf{13}_{B3}$ and $\mathbf{13}_{G4}$, which are positioned at the odd-numbered positions, while positive data signals are written into the pixels $\mathbf{13}_{G1}$, $\mathbf{13}_{R2}$, $\mathbf{13}_{B2}$, $\mathbf{13}_{G3}$, $\mathbf{13}_{R4}$ and $\mathbf{13}_{B4}$, which are positioned at the even-numbered positions as shown in FIG. 37B. As thus described, the polarities of the data signals written into adjacent pixels 13 are opposite with respect to both of the horizontal and vertical directions.

The pixels 13 are driven in the same manner in the following horizontal periods. In the odd-numbered horizontal periods, the pixels 13 in the odd-numbered lines are driven in the same manner as the first horizontal period, while the pixels 13 in the even-numbered lines are driven in the same manner as the second horizontal period.

As is the case of the three to fifth embodiments, it is preferable that the polarities of the data signals and the write sequence of the pixels 13 are preferably switched at a predetermined time cycle in this embodiment. In a preferred embodiment, as shown in FIG. 38, the polarities of the data signals written into the respective pixels 13 are inverted every frame period, and the write sequence of the pixels 13 is switched every two frame periods.

More specifically, the pixels 13 are driven in the above-described procedure in the first frame period, and the pixels 13 are driven with the polarities of the data signals written into the pixels 13 inverted, in the second frame period.

In the third frame period, the polarities of the data signals written into the pixels 13 are inverted again (that is, the polarities of the data signals written into the respective pixels 13 are same as those in the first embodiment), and the write sequence of the pixels 13 is switched.

Figure 38:
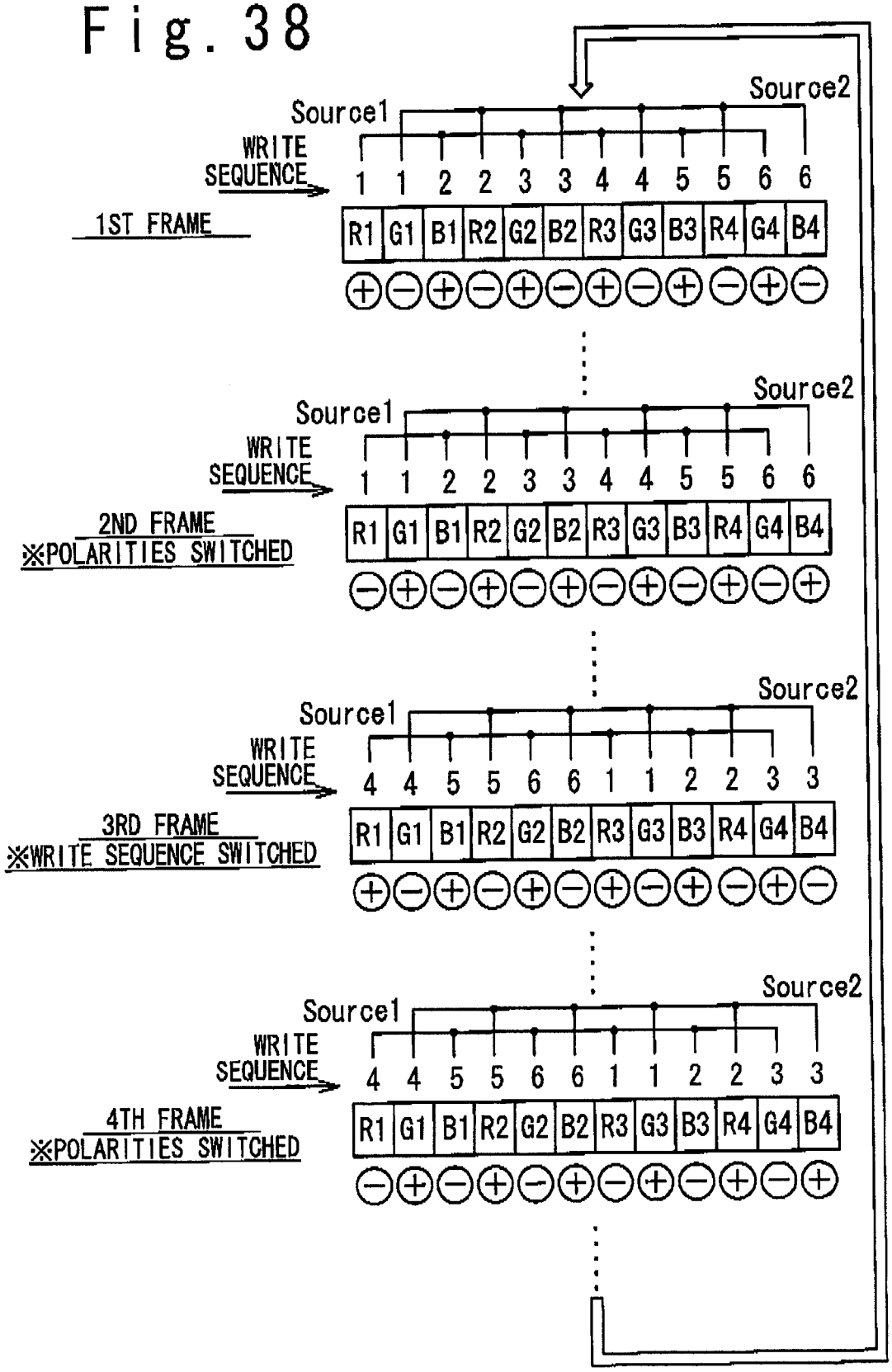
FIG. 38 is a diagram illustrating the write sequence of the pixels in the second line and the polarities of the data signals written into the respective pixels in the first to fourth frame periods in the sixth embodiment.

In detail, as shown in FIG. 38, in the odd-numbered horizontal periods of the third frame period, the LCD driver 2B sequentially outputs positive data signals to be fed to the R pixels $\mathbf{13}_{R3}$, the B pixels $\mathbf{13}_{B3}$, the G pixels $\mathbf{13}_{G4}$, the R pixels $\mathbf{13}_{R1}$, the B pixels $\mathbf{13}_{B1}$ and the G pixels $\mathbf{13}_{G2}$ in this order from the odd output terminals Source1, Source3 . . . . Concurrently, the LCD driver 2B outputs negative data signals to be fed to the G pixels $\mathbf{13}_{G3}$, the R pixels $\mathbf{13}_{R4}$, the B pixels $\mathbf{13}_{B4}$, the G pixels $\mathbf{13}_{G1}$, the R pixels $\mathbf{13}_{R2}$ and the B pixels $\mathbf{13}_{B2}$ in this order from the even output terminals Source2, Source4 . . . . In the even-numbered horizontal periods of the third frame period, the write operations similar to those in the odd-numbered horizontal periods are implemented with the polarities of the data signals written into the pixels 13 inverted.

In the fourth frame period, data signals are written into the respective pixels 13 in the same write sequence as the third frame period with the polarities of the data signals written into the respective pixels 13 inverted. In the following frame periods, the write operations of the first to fourth frame periods are repeated.

As thus described, the image quality is preferably improved also in this embodiment through periodically switching the polarities of the data signals and the write sequence of the pixels 13 at a time cycle of four frame periods.

Seventh Embodiment

Figure 39:
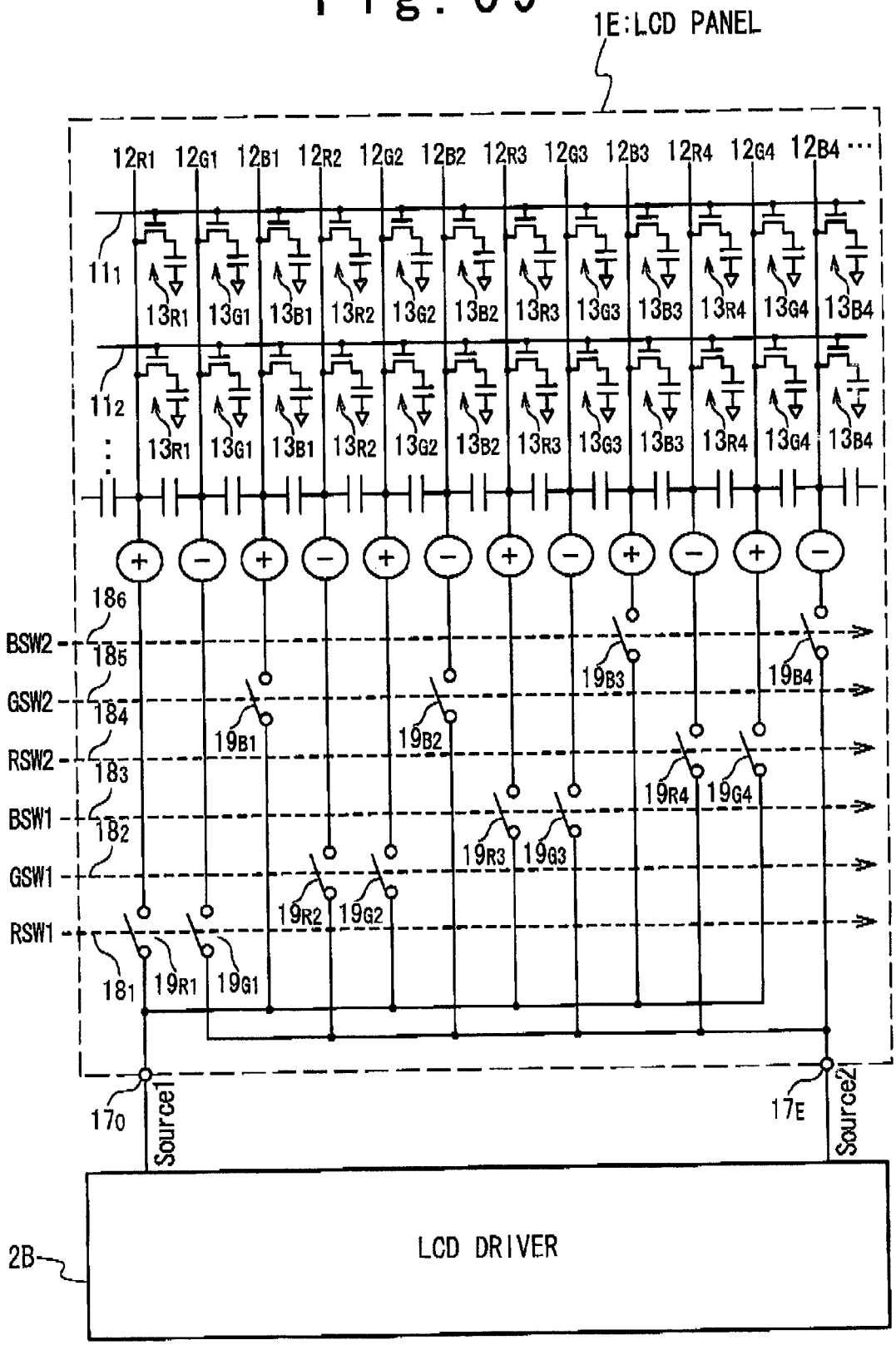
FIG. 39 is a diagram illustrating an exemplary structure of a liquid crystal display device in a seventh embodiment of the present invention.

FIG. 39 is a diagram illustrating the structure of the liquid crystal display device in a seventh embodiment of the present invention. The structure of the liquid crystal display device in the seventh embodiment is almost similar to those in the fifth and sixth embodiment; the data lines $\mathbf{12}_{R1}$, $\mathbf{12}_{B1}$, $\mathbf{12}_{G2}$, $\mathbf{12}_{R3}$, $\mathbf{12}_{B3}$ and $\mathbf{12}_{G4}$, which are positioned at the odd-numbered positions, are connected to the odd input nodes $\mathbf{17}_{O}$, while the data lines $\mathbf{12}_{G1}$, $\mathbf{12}_{R2}$, $\mathbf{12}_{B2}$, $\mathbf{12}_{G3}$, $\mathbf{12}_{R4}$ and $\mathbf{12}_{B4}$, which are positioned at the even-numbered positions, are connected to the even input nodes $\mathbf{17}_{E}$. As described above, such connections further reduces the number of times of the inversion of the polarities of the data signals on the respective output terminals of the LCD driver 2B, and thereby further reduces the power consumption of the LCD driver 2B.

The difference is that the connections between the switches 19 and the interconnections $\mathbf{18}_1$ to $\mathbf{18}_6$, which are used to feed the control signals RSW1, GSW1, BSW1, RSW2, GSW2 and BSW2, that is, the combinations of data lines 12 driven at the same time. In the seventh embodiment, the connections between the switches 19 and the interconnections $\mathbf{18}_1$ to $\mathbf{18}_6$ are determined so as to satisfy requirements described in the following:

(1) Four pairs of adjacent data lines 12 are defined for every 12 data lines, and the two data lines 12 of the same pair are driven at the same time.

(2) One data line 12 is inserted between adjacent pairs of the data lines 12, and the one data line 12 inserted is not driven at the same time as the adjacent pairs of the data lines 12.

In detail, the switches $\mathbf{19}_{R1}$ and $\mathbf{19}_{G1}$ are connected to the interconnection $\mathbf{18}_1$, which is used to feed the control signal RSW1, and the switches $\mathbf{19}_{R2}$ and $\mathbf{19}_{G2}$ are connected to the interconnection $\mathbf{18}_2$, which is used to feed the control signal GSW1. Additionally, the switches $\mathbf{19}_{R3}$ and $\mathbf{19}_{G3}$ are connected to the interconnection $\mathbf{18}_3$, which is used to feed the control signal BSW1, and the switches $\mathbf{19}_{R4}$ and $\mathbf{19}_{G4}$ are connected to the interconnection $\mathbf{18}_4$, which is used to feed the control signal RSW2. Finally, the switches $\mathbf{19}_{B1}$ and $\mathbf{19}_{B2}$ are connected to the interconnection $\mathbf{18}_3$, which is used to feed the control signal GSW2, and the switches $\mathbf{19}_{B3}$ and $\mathbf{19}_{B4}$ are connected to the interconnection $\mathbf{18}_6$, which is used feed the control signal BSW2.

In the following description, the data lines which belong to the four pairs of the data lines 12 may be referred to as the paired data lines. In this embodiment, the data lines $\mathbf{12}_{R1}$ to $\mathbf{12}_{R4}$ and $\mathbf{12}_{G1}$ to $\mathbf{12}_{G4}$ may be referred to as the paired data lines. On the other hand, the data lines which do not belong to the four pairs of the data lines 12 may be referred to as the isolated data lines.

Figure 40:
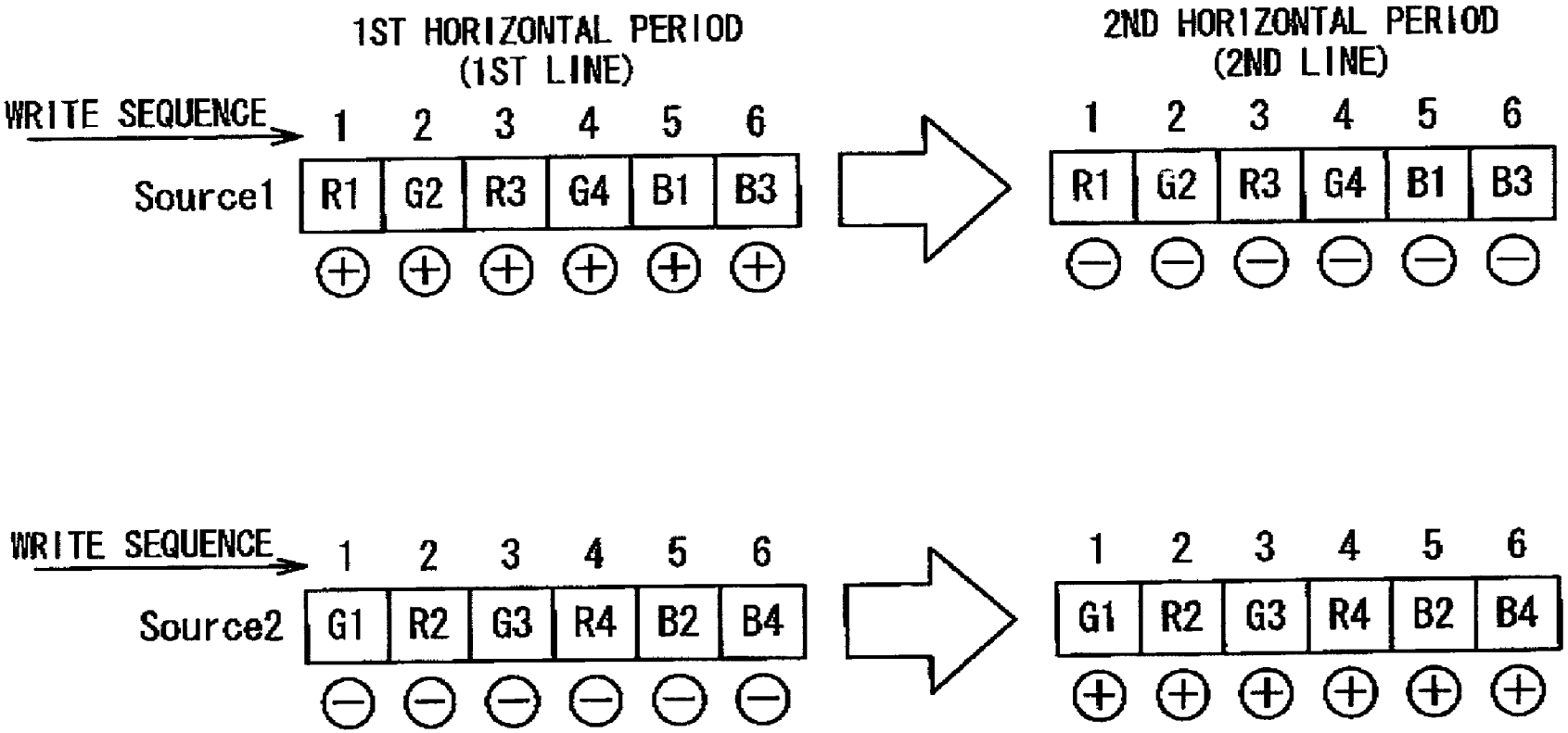
FIG. 40 is a diagram illustrating pixels into which data signals outputted from respective output terminals of the LCD driver are written, and the polarities of the respective data signals, in the seventh embodiment.
Figure 41A:
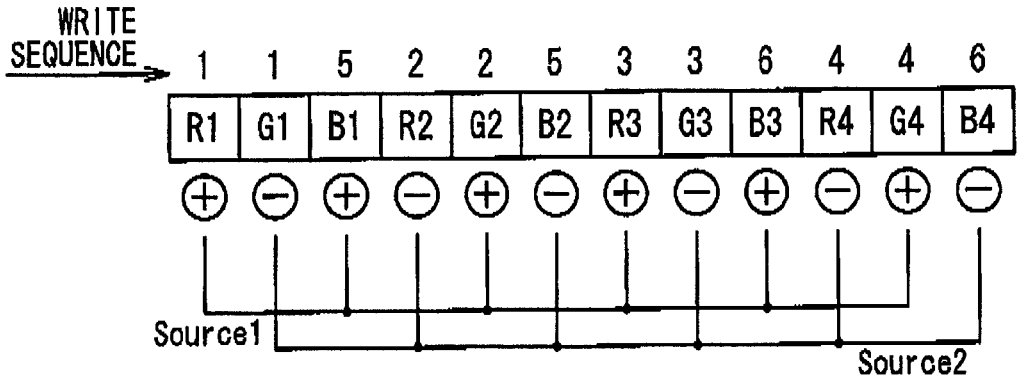
FIG. 41A is a diagram illustrating the write sequence of the pixels in the first line and the polarities of the data signals written into the respective pixels in the seventh embodiment.
Figure 41B:
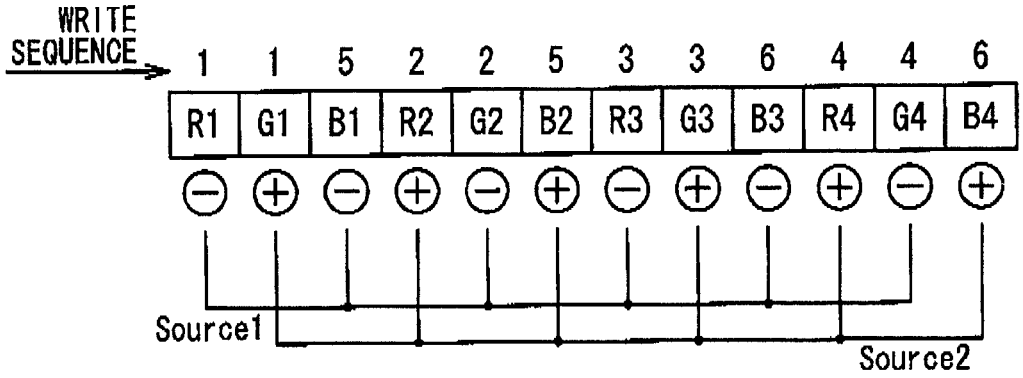
FIG. 41B is a diagram illustrating the write sequence of the pixels in the second line and the polarities of the data signals written into the respective pixels in the seventh embodiment.

FIGS. 40, 41A, and 41B are diagrams illustrating the operation of the liquid crystal display device in this embodiment. As shown in FIG. 40, the LCD driver 2B inverts the polarities of the data signals developed on the respective output terminals thereof, only at the beginning of each horizontal period, as is the case of the fifth and sixth embodiments. Specifically, as shown in FIG. 40, the LCD driver 2B outputs positive data signals to be fed to the R pixels $\mathbf{13}_{R1}$, the G pixels $\mathbf{13}_{G2}$, the R pixels $\mathbf{13}_{R2}$, the G pixels $\mathbf{13}_{G4}$, the B pixels $\mathbf{13}_{B1}$ and the B pixels $\mathbf{13}_{B3}$ (which are positioned in the first line) in this order from the odd output terminals Source1, Source3 . . . , in the first horizontal period. Concurrently, the LCD driver 2B outputs negative data signals to be fed to the G pixels $\mathbf{13}_{G1}$, the R pixels $\mathbf{13}_{R2}$, the G pixels $\mathbf{13}_{G3}$, the R pixels $\mathbf{13}_{R4}$, the B pixels $\mathbf{13}_{B3}$ and the B pixels $\mathbf{13}_{B4}$ in this order from the even output terminals Source2, Source4 . . . , in the first horizontal period.

The write operation into the pixels 13 with such write sequence can be achieved by sequentially activating the controls signals RSW1, GSW1, BSW1, RSW2, GSW2 and BSW2 in this order in each horizontal period. The polarity signal POL is inverted at the beginning of each horizontal period, and therefore, the voltage levels of the respective output terminals of the LCD driver 2B are inverted only at the beginning of each horizontal period.

It should be noted that such operation achieves the dot inversion drive, in which data signals with opposite polarities are written into adjacent pixels 13, as is understood from FIGS. 41A and 41B. FIG. 41A illustrates the write sequence of the pixels 13 and the polarities of the data signals written into the respective pixels 13, when the pixels 13 in the first line are driven in accordance with the procedure shown in FIG. 36. With respect to the pixels 13 in the first line, positive data signals are written into the pixels $\mathbf{13}_{R1}$, $\mathbf{13}_{B1}$, $\mathbf{13}_{G2}$, $\mathbf{13}_{R3}$, $\mathbf{13}_{B3}$ and $\mathbf{13}_{G4}$, which are positioned at the odd-numbered positions, while negative data signals are written into the pixels $\mathbf{13}_{G1}$, $\mathbf{13}_{R2}$, $\mathbf{13}_{B2}$, $\mathbf{13}_{G3}$, $\mathbf{13}_{R4}$ and $\mathbf{13}_{B4}$, which are positioned at the even-numbered positions. With respect to the pixels in the second line on the other hand, negative data signals are written into the pixels $\mathbf{13}_{R1}$, $\mathbf{13}_{B1}$, $\mathbf{13}_{G2}$, $\mathbf{13}_{R3}$, $\mathbf{13}_{B3}$ and $\mathbf{13}_{G4}$, which are positioned at the odd-numbered positions, while positive data signals are written into the pixels $13_{G1}$, $13_{R2}$, $13_{B2}$, $13_{G3}$, $13_{R4}$ and $13_{B4}$, which are positioned at the even-numbered positions as shown in FIG. 41B. As thus described, the polarities of the data signals written into adjacent pixels 13 are opposite with respect to both of the horizontal and vertical directions.

One important feature of the liquid crystal display device in this embodiment is that the pixels 13 connected to the paired data lines are driven before the pixels 13 connected to the isolated data lines, as shown in FIG. 40. Specifically, the data lines $12_{R1}$ to $12_{R4}$ and $12_{G1}$ to $12_{G4}$, which are the paired data lines, are driven before the data lines $12_{B1}$ to $12_{B4}$ are driven, which are the isolated data lines.

The pixels 13 are driven in the same manner in the following horizontal periods. In the odd-numbered horizontal periods, the pixels 13 are driven in the same manner as the first horizontal period. In the even-numbered horizontal periods, the pixels 13 are driven in the same manner as the second horizontal period.

An advantage of the above-described operation is that the above-described operation effectively reduces the change in the voltage levels of the data lines 12 due to the capacitive coupling between adjacent data lines 12. As described above, when a pixel 13 connected to a certain data line 12 is firstly driven, and another pixel 13 connected to the adjacent data line 12 is then driven, the voltage level of the data line 12 connected to the firstly driven pixel 13 may be changed due to the capacitive coupling. This may undesirably cause the change in the write voltage held in the firstly driven pixel 13. However, in the above-described operation in this embodiment, each data line 12 suffer from the effect of the capacitive coupling with only one of the two adjacent data line, or is free from the effect of the capacitive coupling. This reduces the number of times of the change in the voltage level of each data line 12 caused by the capacitive coupling down to one at maximum, and thereby effectively reduces the change in the write voltage held in each pixel 13.

A description is given of the reduction of the change in the write voltage held in each pixel 13 caused by the capacitive coupling in the following, with reference to FIG. 43A. Firstly, each of the paired data lines 12 only suffers from the effect of the capacitive coupling with the adjacent isolated data line 12. In other words, one of two data lines 12 belonging to the same pair, is free from the effect of the capacitive coupling with the other of the two data lines 12 belonging to the same pair, since the two data lines 12 belonging to the same pair are driven at the same time, and therefore the capacitive coupling therebetween does not cause the change in the write voltages of the pixels 13.

Figure 43A:
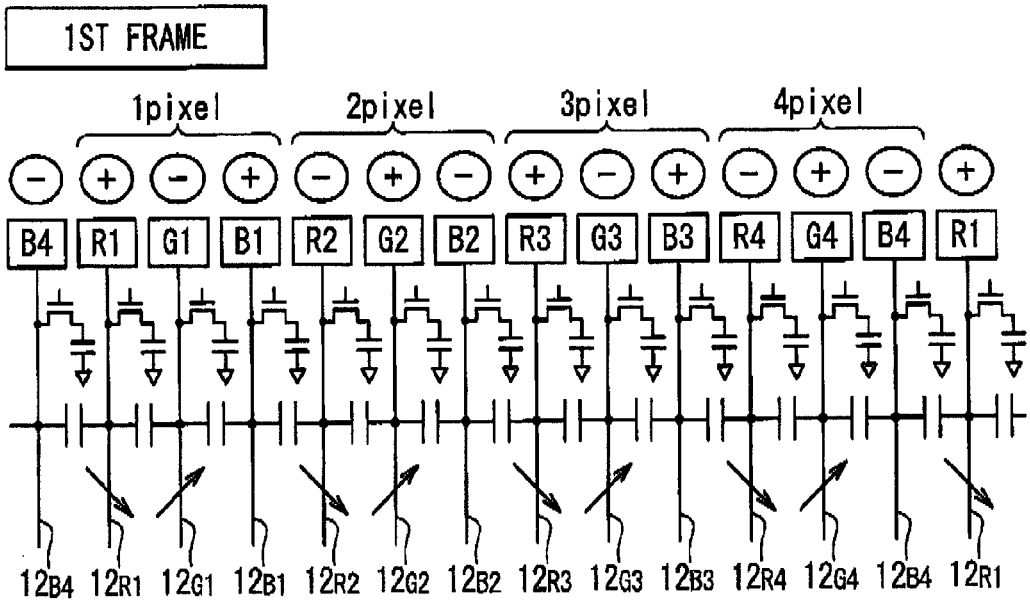
FIGS. 43A to 43D are diagrams illustrating the effect of capacitive coupling between adjacent data lines.
Figure 43B:
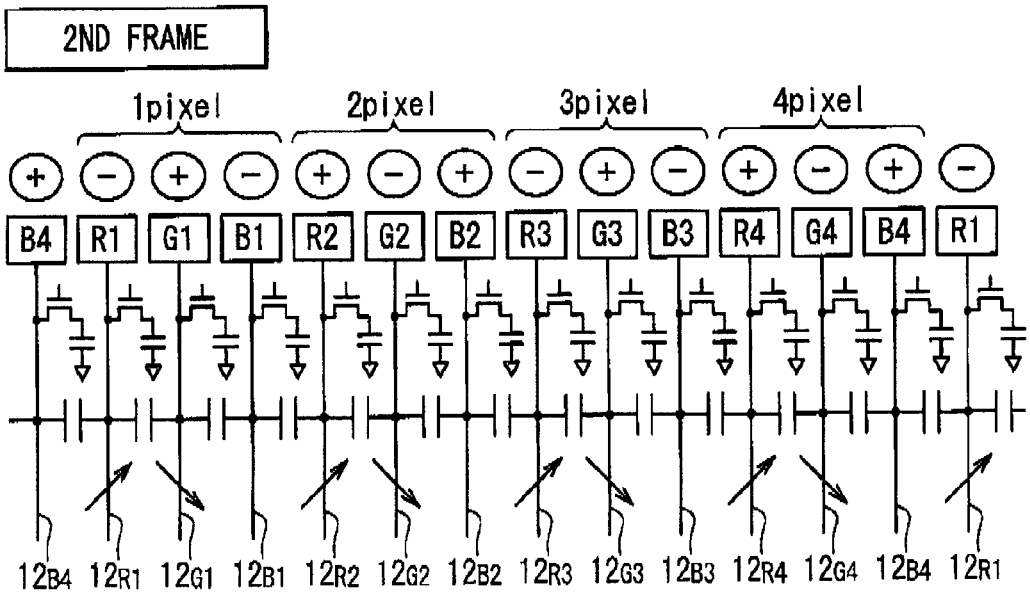
Figure 43C:
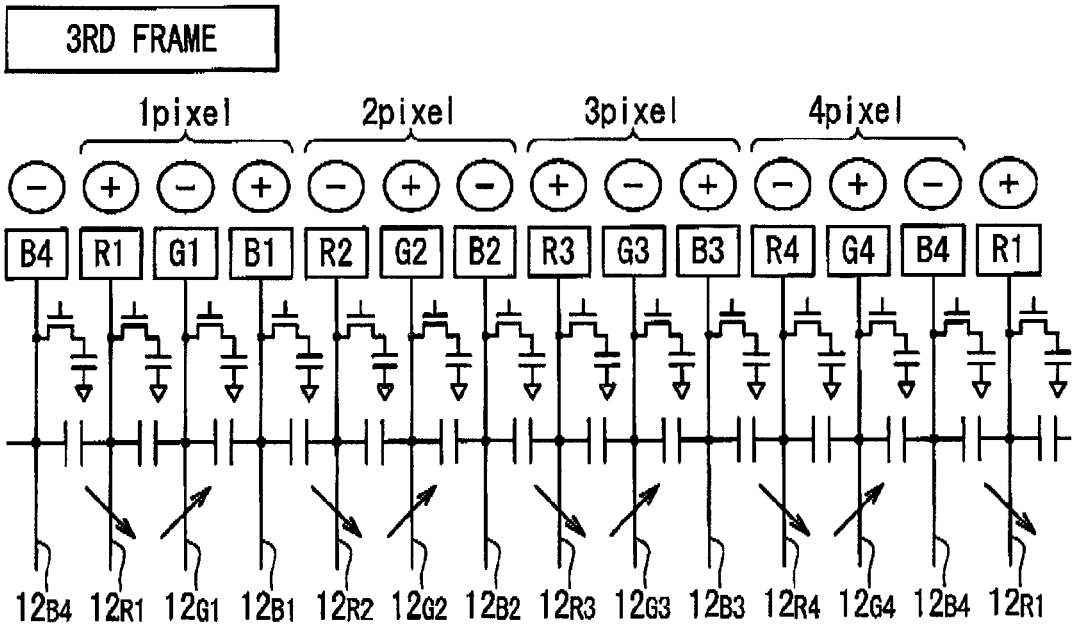
Figure 43D:
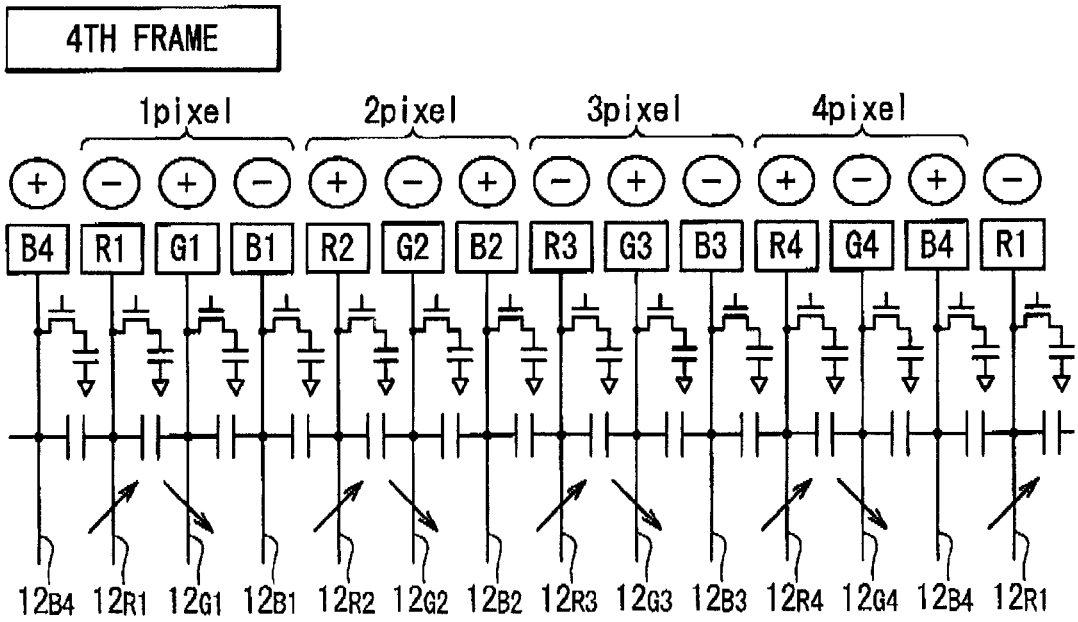

With reference to FIG. 43A, for example, the data lines $12_{R1}$ and $12_{G1}$ are the paired data lines adjacent to each other. Since the data lines $12_{R1}$ and $12_{G1}$ are driven at the same time, the pixels $13_{R1}$ and $13_{G1}$, which are connected to the data lines $12_{R1}$ and $12_{G1}$, respectively are free from the effect of the capacitive coupling between the data lines $12_{R1}$ and $12_{G1}$. It is only the isolated data line $12_{B4}$ that causes the effect of the capacitive coupling to the pixels $13_{R1}$ connected to the data line $12_{R1}$. Correspondingly, it is only the isolated data line $12_{B1}$ that causes the effect of the capacitive coupling to the pixels $13_{G1}$ connected to the data line $12_{G1}$. It would be apparent to those skilled in the art that the same applies to other paired data lines.

Furthermore, the isolated data lines 12 are almost free from the effect of the capacitive coupling with the adjacent data lines 12. This is because the pixels 13 connected to the isolated data lines 12 are driven after driving the pixels 13 connected to the data lines 12 adjacent thereto. The write voltages of the pixels 13 connected to each isolated data line 12 are not changed by feeding data signals to the adjacent data lines 12.

For example, the data line $12_{B1}$ is an isolated data line which is positioned between the pair of the data lines $12_{R1}$ and $12_{G1}$ and the pair of the data lines $12_{R2}$ and $12_{G2}$. The pixels $13_{B1}$ connected to the data line $12_{B1}$ is almost free form the effect of the capacitive coupling with the adjacent data lines 12, since the data lines 12 adjacent to the data line $12_{B1}$ (that is, the data lines $12_{G1}$ and $12_{R2}$) are driven before the data line $12_{B1}$ is driven.

As thus described, the operation described above effectively reduces the change in the write voltages held in the pixels 13 due to the capacitive coupling between adjacent data lines 12.

As is the case of the three to sixth embodiments, it is preferable that the polarities of the data signals and the write sequence of the pixels 13 are preferably switched at a predetermined time cycle in this embodiment. In a preferred embodiment, as shown in FIG. 42, the polarities of the data signals written into the respective pixels 13 are inverted every frame period, and the write sequence of the pixels 13 is switched every two frame periods.

More specifically, the pixels 13 are driven in the above-described procedure in the first frame period, and the pixels 13 are driven with the polarities of the data signals written into the pixels 13 inverted, in the second frame period.

In the third frame period, the polarities of the data signals written into the pixels 13 are inverted again (that is, the polarities of the data signals written into the respective pixels 13 are same as those in the first embodiment), and the write sequence of the pixels 13 is switched.

Figure 42:
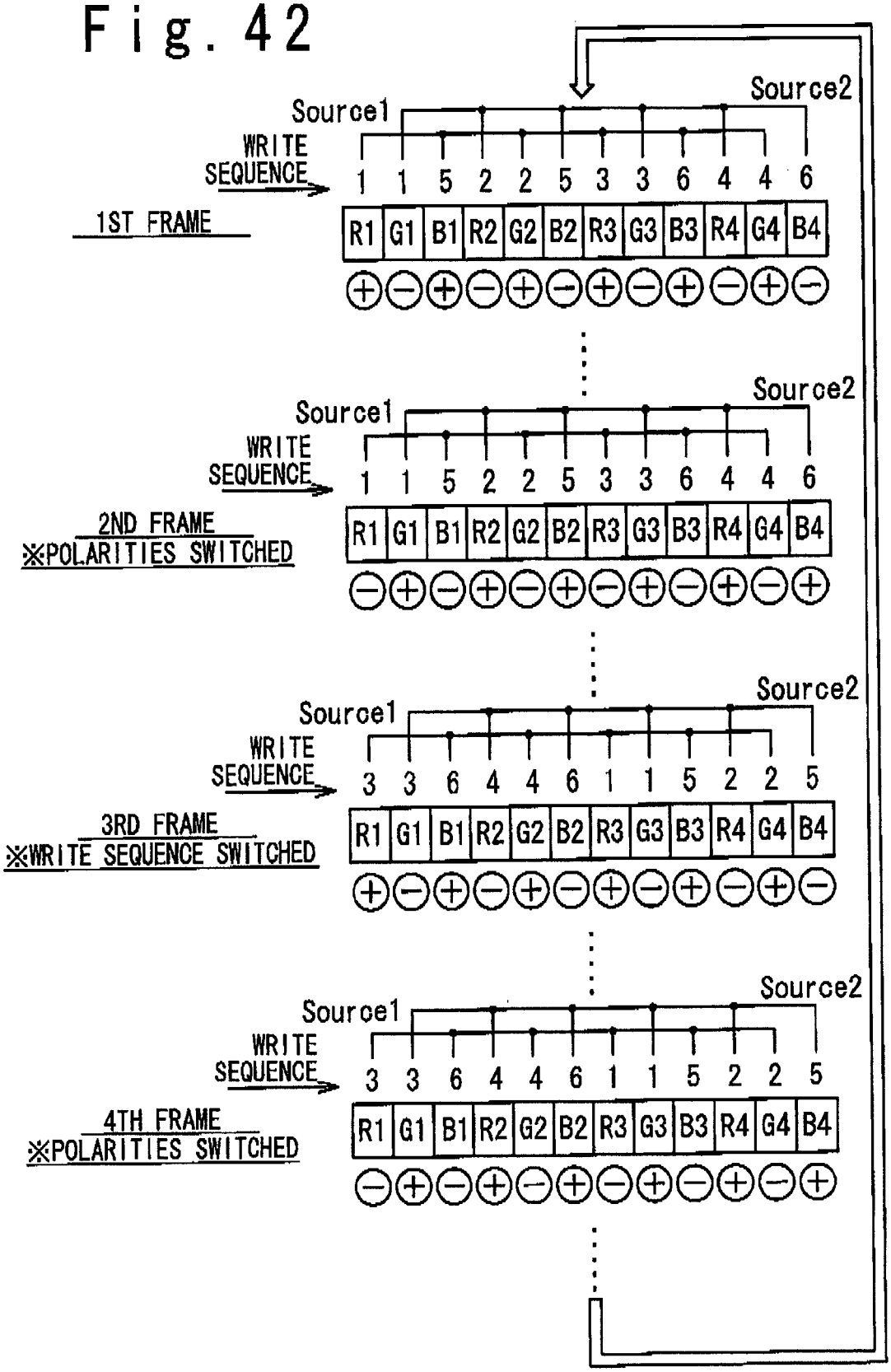
FIG. 42 is a diagram illustrating the write sequence of the pixels and the polarities of the data signals written into the respective pixels in the first to fourth frame periods in the seventh embodiment.

In detail, as shown in FIG. 42, in the odd-numbered horizontal periods of the third frame period, the LCD driver 2B sequentially outputs positive data signals to be fed to the R pixels $13_{R3}$, the G pixels $13_{G4}$, the R pixels $13_{R1}$, the G pixels $13_{G2}$, the B pixels $13_{B3}$ and the G pixels $13_{G1}$ (which are positioned in the first line) in this order from the odd output terminals Source1, Source3 . . . . Concurrently, the LCD driver 2B outputs negative data signals to be fed to the G pixels $13_{G3}$, the R pixels $13_{R4}$, the G pixels $13_{G1}$, the R pixels $13_{R2}$, the B pixels $13_{B4}$ and the B pixels $13_{B2}$ in this order from the even output terminals Source2, Source4 . . . . In the even-numbered horizontal periods of the third frame period, the write operations similar to those in the odd-numbered horizontal periods are implemented with the polarities of the data signals written into the pixels 13 inverted.

In the fourth frame period, data signals are written into the respective pixels 13 in the same write sequence as the third frame period with the polarities of the data signals written into the respective pixels 13 inverted. In the following frame periods, the write operations of the first to fourth frame periods are repeated.

As thus described, the image quality is preferably improved also in this embodiment through periodically switching the polarities of the data signals and the write sequence of the pixels 13 at a time cycle of four frame periods.

Although the specific embodiments are described in detail in the specification, it is apparent that the present invention is not limited to the above-described embodiments, which may be modified and changed without departing from the scope of the invention.

For example, although the write sequence of the data lines are switched every frame period in the above-described embodiments, the write sequence of the data signals may be switched every line and every frame period. In one embodiment, the write sequences of the data signals may be switched between the odd-numbered lines (that is, the odd-numbered horizontal periods) and the even-numbered liens (that is, the even-numbered horizontal periods. The switching of the write sequence of the data signals every line spatially and temporally disperses the pixels 13 suffering from the undesired change in the write voltages, and thereby effectively reduces vertical segments of unevenness.

Additionally, although liquid crystal display devices adapted to the dot inversion drive are disclosed in the above-described embodiment, it is understood that the present invention is applicable to any drive method in which data signals with opposite polarities are fed to pixels adjacent in the horizontal direction; the polarities of data signals fed to pixels adjacent in the vertical direction may be same or opposite. The present invention is applicable to a drive method in which data signals with the same polarity are fed to pixels adjacent in the vertical direction, such as the 2H dot inversion drive or V line inversion drive.

Figure 19B:
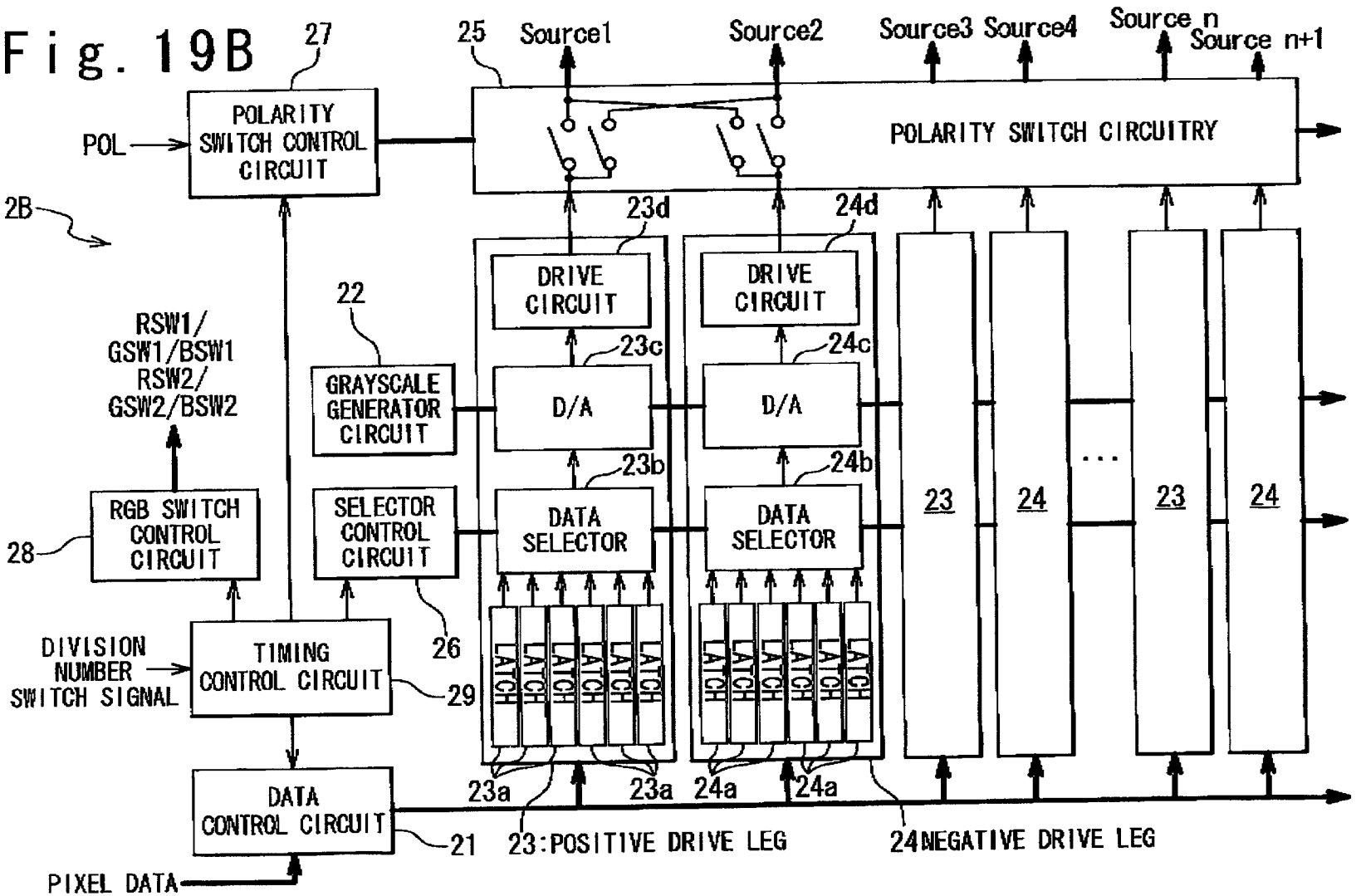
FIG. 19B is a block diagram illustrating another exemplary structure of the LCD driver.

Finally, as shown in FIG. 19B, the LCD driver 2B may be modified so that the LCD driver 2B is adapted to both of the operation in which the number of the data lines 12 time-divisionally driven in each horizontal period is three and the operation in which the number of the data lines 12 time-divisionally driven in each horizontal period is six. Specifically, the timing control circuit 29 is fed with a division number switch signal which indicates the number of the data lines 12 time-divisionally driven in each horizontal period, and controls the selector control circuit 26 and the RGB switch control circuit 28 in response to the division number switch signal. Such architecture allows the LCD driver 2B to drive LCD panels incorporating different numbers of pixels.

In one embodiment, the LCD driver 2B is designed to have 240 output terminals, and adapted to both of LCD panels in the QVGA (quarter video graphic array) format and the VGA (video graphic array) format.

When the LCD panel driven by the LCD driver 2B is designed in the QVGA format, the LCD driver 2B is set to drive the data lines 12 so that the number of the data lines 12 time-divisionally driven in each horizontal period is three. It should be noted that an LCD panel in the VGA format includes 720×320 pixels (240RGB×320 pixels). In this case, the timing control circuit 28 controls the selector control circuit 26 to use only three of the six latch circuits 23*a* in each positive drive leg 23, and only three of the six latch circuits 24*a* in each positive drive leg 24, while controlling the RGB switch control circuit 28 generates only three control signals: the control signals RSW1, GSW1 and BSW1; the control signals RSW2, GSW2 and BSW2 are kept deactivated.

When the LCD panel driven by the LCD driver 2B is designed in the VGA format, on the other hand, the LCD driver 2B is set to drive the data lines 12 so that the number of the data lines 12 time-divisionally driven in each horizontal period is six. It should be noted that an LCD panel in the VGA format includes 1440×320 pixels (480RGB×320 pixels). In this case, the timing control circuit 28 controls the selector control circuit 26 to use all of the six latch circuits 23*a* in each positive drive leg 23, and all of the six latch circuits 24*a* in each positive drive leg 24, while controlling the RGB switch control circuit 28 generates all of the six control signals RSW1, GSW1, BSW1 RSW2, GSW2 and BSW2.

Such architecture allows the LCD driver 2B to drive both of LCD panels in the QVGA and VGA formats.

What is claimed is:

1. A method of operating a liquid crystal display (LCD) device comprising:

time-divisionally driving pixels in a certain line of an LCD panel in a certain horizontal period so that pixels adjacent in a horizontal direction are driven with data signals with opposite polarities, wherein said time-divisionally driving pixels in the certain line comprises:

generating a first data signal with a first polarity on a first output terminal of a driver, and driving a first pixel out of said pixels in said certain line through electrically connecting said first output terminal to said first pixel;

generating a second data signal with said first polarity on said first output terminal and driving a second pixel out of said pixels in said certain line through electrically connecting said first output terminal to said second pixel, in succession to said driving of said first pixel; and generating a third data signal with the same signal level as said second data signal on said first output terminal, and driving said second pixel through electrically connecting said first output terminal to said second pixel before driving said first pixel.

2. The method according to claim 1, wherein said time-divisionally driving pixels in the certain line further comprises:

generating a fourth data signal with a second polarity opposite to said first polarity on a second output terminal of said driver, and driving a third pixel out of said pixels in said certain line through electrically connecting said second output terminal to said third pixel, at a same timing as said driving of said first pixel; and generating a fifth data signal with said second polarity on said second output terminal of said driver, and driving a fourth pixel out of said pixels in said certain line through electrically connecting said second output terminal to said fourth pixel, at a same timing as said driving of said second pixel.

3. The method according to claim 1, wherein said time-divisionally driving pixels in the certain line further comprises:

generating a fourth data signal on said first output terminal and driving a third pixel out of said pixels in said certain line through electrically connecting said first output terminal to said third pixel, and wherein said second and third pixels are used to display a same color.

4. The method according to claim 3, wherein said time-divisionally driving pixels in the certain line further comprises:

generating a fifth data signal on said first output terminal and then driving a fourth pixel out of said pixels in said certain line through electrically connecting said first output terminal to said fourth pixel, wherein said driving said first pixel is implemented in succession to said driving said fourth pixel, and wherein said first and fourth pixels are used to display a same color.

5. The method according to claim 1, wherein said time-divisionally driving pixels in the certain line further comprises:

generating a fourth data signal with a second polarity opposite to said first polarity on said first output terminal, and driving a third pixel out of said pixels in said certain line through electrically connecting said first output terminal to said third pixel, in a leading period of said certain horizontal period, generating fifth data signal with said second polarity on said first output signal and driving said third pixel out of said pixels in said certain line through electrically connecting said first output terminal to said third pixel, in a final period of said certain horizontal period.

6. The method according to claim 1, further comprising:

connecting a positive drive leg of said driver to said first output terminal of said driver to generate said first polarity.

7. The method according to claim 2, further comprising:

time-divisionally driving pixels in a next line adjacent to said certain line in a next horizontal period following said certain horizontal period so that pixels adjacent in said horizontal direction are driven with data signals of opposite polarities, wherein said LCD panel includes a first to a fourth data lines connected to said first to said fourth pixels, respectively, and a switch circuit adapted to electrically connect said first output terminal to any one of said first to fourth data lines, and to electrically connect said second output terminal to any one of said first to fourth data lines, wherein said time-divisionally driving pixels in the next line adjacent to said certain line comprises:

generating a sixth data signal with said first polarity on said first output terminal and driving a fifth pixel out of said pixels in said next line through electrically connecting said first output terminal to said fifth pixel, wherein said first data signal is fed from said first output terminal to said first pixel through said switch circuit and said first data line, in said driving of said first pixel, wherein said third data signal is fed from said second output terminal to said third pixel through said switch circuit and said third data line, in said driving of said third pixel, and wherein said sixth data signal is fed from said first output terminal to said fifth pixel through said switch circuit and said third data line, in said driving of said fifth pixel.

8. The method according to claim 2, wherein said time-divisionally driving pixels in the certain line:

generating a sixth data signal with the same signal level as said fifth data signal on said second output terminal, and driving in said fourth pixel through electrically connecting said second output terminal to said fourth pixel before driving said third pixel.

9. The method according to claim 2, further comprising:

connecting a positive drive leg of said driver to said first output terminal of said driver to generate said first polarity; and connecting a negative drive leg of said driver to said second output terminal of said driver to generate said second polarity.

10. A liquid crystal display device comprising:

a plurality of pixels arranged in rows and columns;

a driver generating data signals fed to said plurality of pixels, respectively; and a switch circuit switching connections between a plurality of output terminals of said driver and said plurality of pixels, wherein said driver controls said switch circuit to time-divisionally drive pixels out of said plurality of pixels in a certain line so that two of said plurality of pixels adjacent to each other in a horizontal direction are driven with data signals with opposite polarities, and wherein said driver drives a first pixel out of said plurality of pixels in said certain line through generating a first data signal with a first polarity on a first output terminal of said plurality of output terminals, and controls said switch circuit to electrically connect said first output terminal to said first pixel, and drives a second pixel out of said plurality of pixels in said certain line through generating a second data signal with said first polarity on said first output terminal, and controls said switch circuit to electrically connect said first output terminal to said second pixel in succession to the driving of said first pixel, and wherein said driver drives said second pixel out of said plurality of pixels in said certain line through generating a third data signal with the same signal level as said second data signal on said first output terminal, and controls said switch circuit to electrically connect said first terminal output terminal to said to said second pixel before driving said first pixel.

11. The liquid crystal display device according to claim 10, wherein said driver drives a third pixel out of said plurality of pixels in said certain line through generating a fourth data signal with a second polarity opposite to said first polarity on a second output terminal of said plurality of output terminals, and controls said switch circuit to electrically connect said second output terminal to said third pixel, at the same timing as the driving of said first pixel, and wherein said driver drives a fourth pixel out of said plurality of pixels in said certain line through generating a fifth data signal with said second polarity on said second output terminal, and controls said switch circuit to electrically connect said second output terminal to said fourth pixel at the same timing as the drive of said second pixel.

12. The liquid crystal display device according to claim 10, wherein said driver drives a third pixel out of said plurality of pixels in said certain line through generating a third data signal on said first output terminal, and controls said switch circuit to electrically connect said first output terminal to said third pixel, in succession to the driving of said second pixel, and wherein said second and third pixels are used to display a same color.

13. The liquid crystal display device of claim 10, said driver comprising:

a positive drive leg to generate positive data signals;

a negative drive leg to generate negative data signals; and a polarity switch circuit, wherein said polarity switch circuit switches connections of said plurality of output terminals of said driver with said positive drive leg and said negative drive leg.

* * * * *

UNITED STATES PATENT AND TRADEMARK OFFICE

CERTIFICATE OF CORRECTION

PATENT NO. : 7,804,473 B2
APPLICATION NO. : 11/561545
DATED : September 28, 2010
INVENTOR(S) : Masayuki Kumeta It is certified that error appears in the above-identified patent and that said Letters Patent is hereby corrected as shown below:

Column 3, Line 16: Delete "$112_{G2}$;" and insert -- $112_{G2}$, --
Column 5, Line 58: Delete "second," and insert -- second --
Column 8, Line 26: Delete "17," and insert -- $17_{O}$ --
Column 14, Line 47: Delete "$13_{G1}$," and insert -- $13_{B1}$, --
Column 21, Line 13: Delete "concurrently," and insert -- Concurrently, --
Column 22, Line 14: Delete "28" and insert -- 2B --
Column 29, Line 35: Delete "$19_{g4}$" and insert -- $19_{G4}$ --
Column 38, Line 5: In Claim 10, after "polarities," delete "and"
Column 38, Line 23: In Claim 10, delete "terminal output terminal to said to said" and insert -- output terminal to said --

Signed and Sealed this

Twenty-first Day of December, 2010

David J. Kappos

David J. Kappos
*Director of the United States Patent and Trademark Office*